US012465839B2

(12) United States Patent
Hermandorfer et al.

(10) Patent No.: US 12,465,839 B2
(45) Date of Patent: Nov. 11, 2025

(54) PITCHING MACHINE AND BATTING BAY SYSTEMS

(71) Applicant: HOME RUN DUGOUT LLC, Round Rock, TX (US)

(72) Inventors: Nicholas S. Hermandorfer, Austin, TX (US); Lauren West, Cedar Park, TX (US); John Kevin Gentry, Austin, TX (US); Tyler L. Bambrick, Austin, TX (US); Rodney D. Muras, Austin, TX (US); Scott Hudson, Georgetown, TX (US)

(73) Assignee: HOME RUN DUGOUT LLC, Round Rock, TX (US)

( * ) Notice: Subject to any disclaimer, the term of this patent is extended or adjusted under 35 U.S.C. 154(b) by 0 days.

(21) Appl. No.: 18/384,089

(22) Filed: Oct. 26, 2023

(65) Prior Publication Data

US 2024/0131413 A1 Apr. 25, 2024
US 2024/0226695 A9 Jul. 11, 2024

Related U.S. Application Data

(63) Continuation of application No. 16/826,180, filed on Mar. 21, 2020, now abandoned.
(Continued)

(51) Int. Cl.
*A63B 69/40* (2006.01)
*A63B 69/00* (2006.01)

(52) U.S. Cl.
CPC ..... *A63B 69/40* (2013.01); *A63B 69/0002* (2013.01); *A63B 2069/0008* (2013.01); *A63B 2069/401* (2013.01)

(58) Field of Classification Search
CPC ... A63B 69/0002; A63B 69/40; A63B 69/407; A63B 69/409; A63B 2069/0008; A63B 2069/401; A63B 2220/00
(Continued)

(56) References Cited

U.S. PATENT DOCUMENTS 4,074,905 A * 2/1978 High ..... A63B 47/025 473/421
4,091,791 A * 5/1978 Castelli ..... F41B 11/52 124/81

(Continued)

FOREIGN PATENT DOCUMENTS

CN 201454010 U 5/2010
JP S5854870 A 4/1983
JP H9122286 A 5/1997

OTHER PUBLICATIONS

"Operation of the Battery Powered Wheeler-Dealer", Athlonic Sports, https://static1.squarespace.com/static/54de6d91e4b05c3c8452e7e5/t/55564e59e4b0342593f8c84e/1431719513565/WD2Operation+Directions.pdf [retrieved from the Internet on Feb. 18, 2020].

(Continued)

*Primary Examiner* — Alexander R Niconovich
(74) *Attorney, Agent, or Firm* — Lando & Anastasi, LLP

(57) ABSTRACT

A ball pitching device including a launching surface for receiving balls, the launching surface being configured to receive and hold a ball in the launching position prior to the ball being launched, a launching system including at least one impulse mechanism configured to impact the ball in the launching position, and one or more control components configured to control at least one of a pitch power and a pitch trajectory of the ball launched from the launching position.

18 Claims, 54 Drawing Sheets

Related U.S. Application Data

(60) Provisional application No. 62/823,548, filed on Mar. 25, 2019, provisional application No. 62/822,624, filed on Mar. 22, 2019.

(58) Field of Classification Search
USPC ..... 124/51.1, 78; 473/451
See application file for complete search history.

(56) References Cited

U.S. PATENT DOCUMENTS 4,502,455 A * 3/1985 Stokes ..... A63B 69/409 124/56
4,915,384 A * 4/1990 Bear ..... A63B 69/3614 473/154
5,294,109 A * 3/1994 Meade ..... A63B 69/40 124/50
5,359,986 A * 11/1994 Magrath, III ..... A63B 69/406 124/78
5,401,018 A * 3/1995 Kelly ..... A63B 69/0002 473/421
5,464,208 A * 11/1995 Pierce ..... A63B 69/406 124/78
5,485,994 A * 1/1996 Underwood ..... A63B 63/00 473/451
5,575,482 A * 11/1996 Butler, Jr. ..... A63B 69/407 124/66
5,733,209 A * 3/1998 McIntyre, IV ..... A63B 69/409 473/133
5,768,151 A * 6/1998 Lowy ..... A63B 24/0021 273/317.1
5,897,445 A * 4/1999 Sanders ..... A63B 24/0003 473/421
6,082,350 A * 7/2000 Crews ..... A63B 69/406 124/78
6,167,878 B1 * 1/2001 Nickerson ..... A63B 69/409 24/63
6,237,583 B1 * 5/2001 Ripley ..... A63B 69/406 124/78
6,539,931 B2 * 4/2003 Trajkovic ..... A63B 24/00 124/78
6,675,792 B2 * 1/2004 Suba ..... A63B 69/406 124/78
6,684,872 B2 * 2/2004 Kao ..... A63B 69/40 124/56
7,066,845 B2 * 6/2006 Joseph ..... A63B 69/0071 124/78
7,294,071 B1 * 11/2007 Saumell ..... A63B 69/0053 473/418
7,736,249 B2 * 6/2010 Zhang ..... F41B 11/52 124/78
7,874,942 B2 * 1/2011 Auzoux ..... A63B 69/409 473/417
8,991,377 B2 * 3/2015 Jorgens ..... A63B 69/406 124/51.1
9,067,119 B1 * 6/2015 Vaught ..... A63B 69/408
9,259,631 B2 * 2/2016 Gowan ..... A63B 69/407
9,555,307 B1 * 1/2017 Lewis ..... A63B 65/12
10,052,544 B2 * 8/2018 Gowan ..... A63B 71/0619
10,245,489 B2 * 4/2019 Kim ..... A63B 69/40
10,556,166 B2 * 2/2020 Kim ..... A63B 69/0091
10,631,522 B2 * 4/2020 So ..... A01K 15/025
10,894,195 B2 * 1/2021 Pepe ..... A63B 63/004
11,083,953 B2 * 8/2021 Hermandorfer ..... G06T 11/60
11,458,378 B2 * 10/2022 Strickland ..... A63B 71/0669
11,612,800 B1 * 3/2023 Smith ..... A63B 69/0002 473/418
11,660,514 B1 * 5/2023 Black ..... A63B 69/406 273/395
11,944,888 B2 * 4/2024 Roel Cardama ..... A63B 71/02
2002/0005614 A1 * 1/2002 Krull ..... A63B 65/12 124/32
2002/0155907 A1 * 10/2002 Bewley ..... A63B 69/40 473/451
2007/0157915 A1 * 7/2007 Benetti ..... F16K 31/406 124/71
2009/0170642 A1 * 7/2009 Ono ..... A63B 24/0021 473/455
2011/0152011 A1 * 6/2011 Forrest ..... A63B 69/40 473/422
2014/0354381 A1 12/2014 Kohlhafer
2015/0165300 A1 * 6/2015 Vaught ..... A63B 69/408 473/459
2017/0304705 A1 * 10/2017 Hermandorfer ... A63B 69/0002
2017/0326458 A1 * 11/2017 Strickland ..... A63B 69/40
2017/0348582 A1 * 12/2017 Cho ..... A63B 69/40
2019/0324423 A1 * 10/2019 Kim ..... G06T 7/20

OTHER PUBLICATIONS

European Examination Report from corresponding European Application No. 20777291.4 dated Jun. 25, 2024.
Examination Report of the Intellectual Property Office of the Philippines from corresponding PH Application Serial No. 1-2021-552286 dated Aug. 16, 2023.
Japanese Final Office Action from corresponding Japanese Application No. 2021-559488 dated Jun. 3, 2024.
Japanese Office Action from corresponding Japanese Application No. 2021-559488 dated Feb. 19, 2024.
International Search Report and Written Opinion from International Application No. PCT/US2020/024069 dated Jul. 16, 2020.
Arab Search Report from corresponding Arab Application No. P60016812021 dated Nov. 18, 2024.

* cited by examiner (c)

(b)

(a)

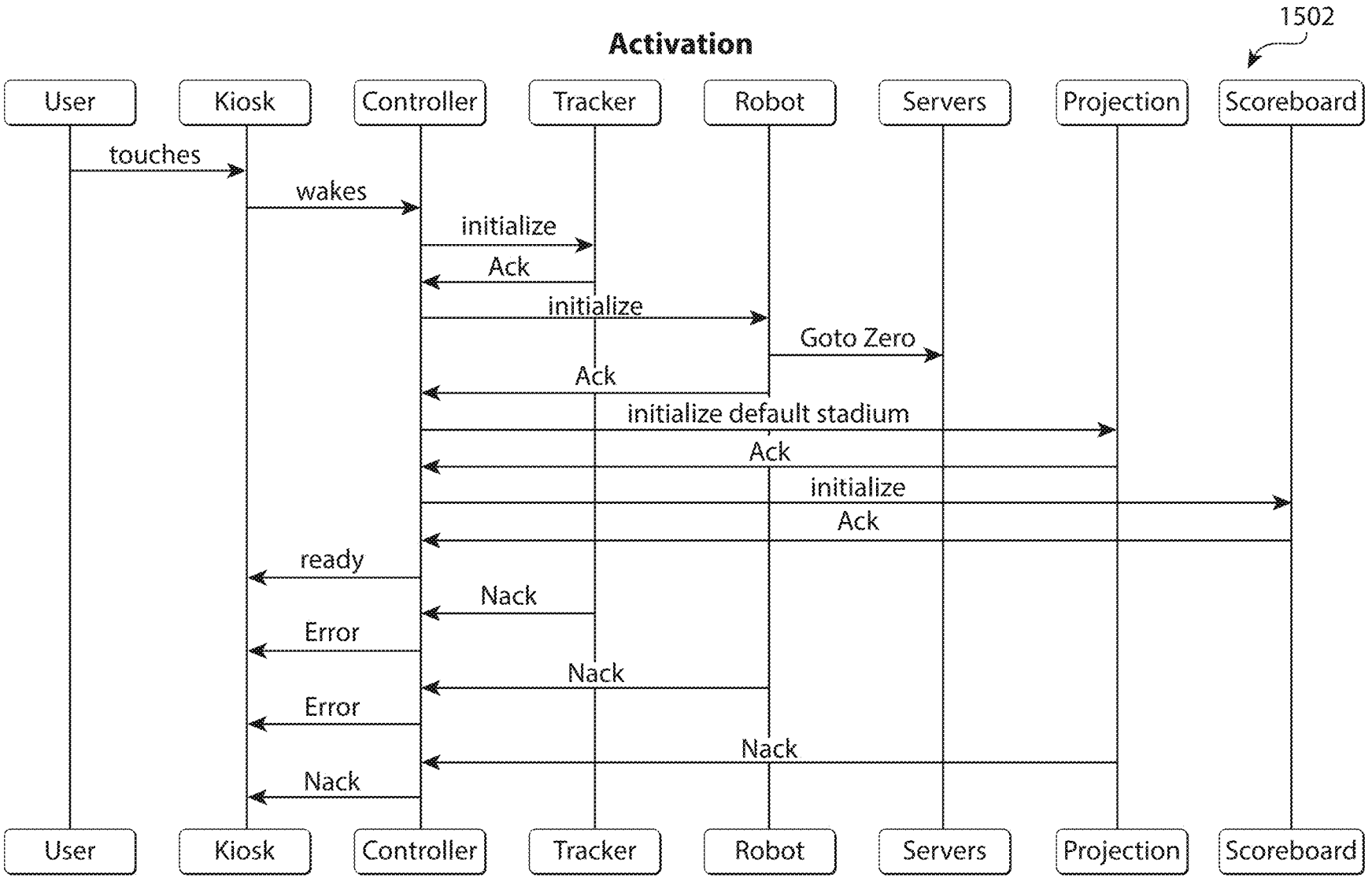
1502
Activation
User
Kiosk
Controller
Tracker
Robot
Servers
Projection
Scoreboard
touches
wakes
initialize
Ack
initialize
Ack
Goto Zero
initialize default stadium
Ack
initialize
Ack
ready
Nack
Error
Nack
Error
Nack
Nack
Nack

PITCHING MACHINE AND BATTING BAY SYSTEMS

CROSS-REFERENCE TO RELATED APPLICATIONS

This application is continuation of U.S. patent application Ser. No. 16/826,180 titled PITCHING MACHINE AND BATTING BAY SYSTEMS, filed on Mar. 21, 2020, which claims priority under 35 U.S.C. § 119(e) to U.S. Provisional Patent Application Ser. No. 62/822,624 titled PROGRAMMABLE SYSTEM FOR PITCHING, COLLECTING, AND TRANSPORTING BALLS FOR USE IN BAT-AND-BALL GAMES, filed Mar. 22, 2019, and also claims priority to U.S. Provisional Patent Application Ser. No. 62/823,548 titled TRAINING AND ENTERTAINMENT CENTER INCLUDING BALL LAUNCHER, PLAYER BAY, AND AUTOMATIC BALL COLLECTION, filed Mar. 25, 2019. Each of these applications is incorporated herein by reference in its entirety for all purposes.

FIELD OF THE DISCLOSURE

Aspects and embodiments disclosed herein are generally directed to a system for pitching, collecting, and transporting balls.

BACKGROUND

In many cases, it is often difficult to find enough people and an appropriate place to play sports. For example, a game of baseball (or softball) typically involves two teams of nine (or ten) players and a marked field with raised pitcher's mound, and a game of basketball typically involves two teams of five players and a marked court with two baskets. Though one can try and play team sports in small groups or alone, enjoyment is usually diminished. For example, while it may be fun for a few seconds for a player to toss a baseball in the air and hit it with a baseball bat, it's far less fun for the player to have to chase the baseball down so that the player can toss the ball in the air again and try to hit it again. Having to chase the ball down after each hit also makes it difficult for a baseball player to practice their baseball swing when they are alone and without any specialized practice equipment. In addition, such activities can provide limited availability for socializing. Likewise, other factors such as climate/weather, field reservations, and government mandated "social-distancing" can present additional obstacles when arranging team or group sport activities.

SUMMARY

At least one aspect of the present disclosure is directed to a ball pitching device including a launching surface for receiving balls, the launching surface being configured to receive and hold a ball in the launching position prior to the ball being launched, a launching system including at least one impulse mechanism configured to impact the ball in the launching position, and one or more control components configured to control at least one of a pitch power and a pitch trajectory of the ball launched from the launching position.

In one embodiment, a position of the impulse mechanism is configured to be adjustable relative to the launching position to control the pitch trajectory. In some embodiments, the ball pitching device includes a first mechanical system configured to adjust the position of the impulse mechanism in a first dimension and a second mechanical system configured to adjust the position of the impulse mechanism in a second dimension. In certain embodiments, the first and second dimensions correspond to dimensions of an x-y plane. In various embodiments, the one or more control components are further configured to control at least one of the first and second mechanical systems to adjust the position of the impulse mechanism and the pitch trajectory.

In some embodiments, the ball pitching device includes an angled mount on which the launching surface and the launching system are disposed. In certain embodiments, the ball pitching device includes a third mechanical system configured to adjust an amount of tilt provided by the angled mount, the one or more control components being configured to control the third mechanical system to adjust the amount of tilt provided by the angled mount and the pitch trajectory.

In one embodiment, the ball pitching device includes a casing on which the launching surface is disposed. In certain embodiments, the ball pitching device includes a first mechanical system configured to tilt the casing about a first axis and a second mechanical system configured to roll the casing around a second axis. In some embodiments, the one or more control components are configured to control at least one of the first and second mechanical systems to adjust the pitch trajectory.

In certain embodiments, the impulse mechanism includes a pneumatic cylinder disposed below the launching position and at least one moveable piston, the pneumatic cylinder configured to accelerate the at least one moveable piston toward the launching position. In some embodiments, the one or more control components are configured to adjust an amount of pressure in the pneumatic cylinder and to control the pitch power.

In one embodiment, the impulse mechanism includes an electromagnetic solenoid disposed below the launching position and at least one moveable piston, the at least one moveable piston being a ferromagnetic piston and the solenoid being configured to accelerate the at least one movable piston toward the launching position. In various embodiments, the launching system includes a power source configured to apply a current to the electromagnetic solenoid, the one or more control components being configured to control the pitch power by adjusting an amount of current applied to the electromagnetic solenoid. In some embodiments, the power source includes one or more capacitors, the one or more capacitors being selectively coupled to the electromagnetic solenoid to apply the current to the electromagnetic solenoid, and the one or more control components being configured to adjust a charging voltage applied to the one or more capacitors and to adjust the amount of current applied to the electromagnetic solenoid by the one or more capacitors.

In some embodiments, the launching position includes a circular aperture defined in the launching surface, the aperture having a diameter smaller than a diameter of the ball, allowing the ball to be held in the launching position and to be impacted by the at least one impulse mechanism.

In various embodiments, the launching surface is configured to receive a series of balls via a ball handling mechanism connected to the ball pitching device. In one embodiment, the ball handling mechanism includes a carousel system configured to rotate around a bearing to receive the series of balls and provide each ball of the series of balls to the launching surface one at a time. In certain embodiments, the one or more control components are further configured to operate the ball handling mechanism and control a pitch frequency of the ball pitching device.

In one embodiment, the one or more control components are configured to communicate with an external device, the external device being configured to control the ball pitching device.

Another aspect of the present disclosure is directed to a method of controlling a ball pitching device. The method includes receiving a ball at a launching surface, the launching surface being configured to hold the ball in a launching position prior to the ball being launched, determining a desired pitch power and pitch trajectory for the ball held in the launching position, adjusting a position of an impulse mechanism disposed under the launching position in at least two dimensions based on the desired pitch trajectory, and impacting, with the impulse mechanism, the ball held in the launching position with an amount of force corresponding to the desired pitch power to launch the ball from the launching position.

BRIEF DESCRIPTION OF THE DRAWINGS

Various aspects of at least one embodiment are discussed below with reference to the accompanying figures, which are not intended to be drawn to scale. The figures are included to provide illustration and a further understanding of the various aspects and embodiments, and are incorporated in and constitute a part of this specification, but are not intended as a definition of the limits of the aspects and embodiments disclosed herein.

In the figures, each identical or nearly identical component that is illustrated in various figures is represented by a like numeral. For purposes of clarity, not every component may be labeled in every figure. In the figures:

FIGS. 15A, 15B, and 15C are diagrams illustrating control processes for operating player bay layouts in accordance with embodiments described herein.

DETAILED DESCRIPTION

Figure 1A:
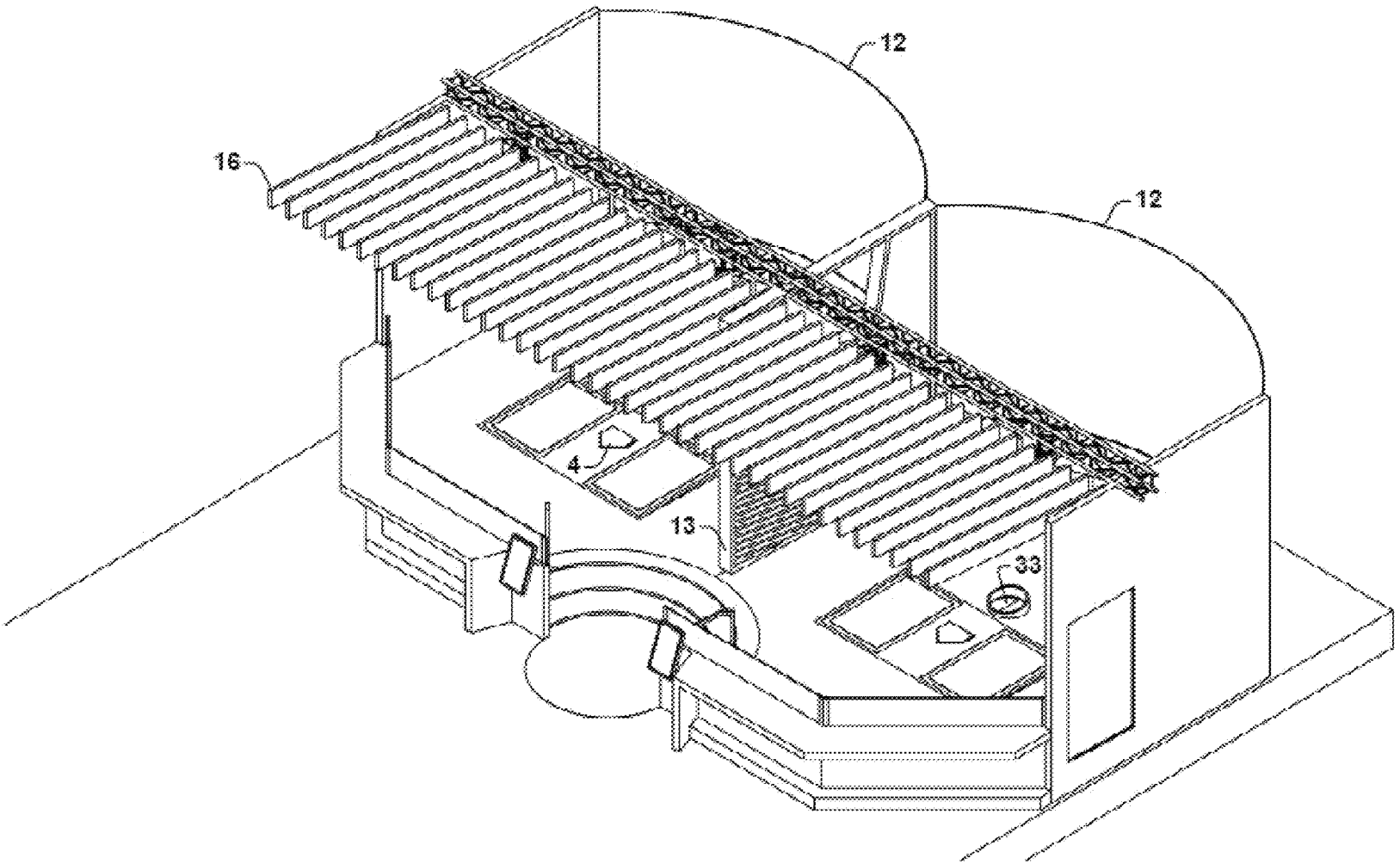
FIG. 1A is a diagram illustrating a perspective view of a side-by-side player bay layout in accordance with one embodiment described herein.
Figure 1B:
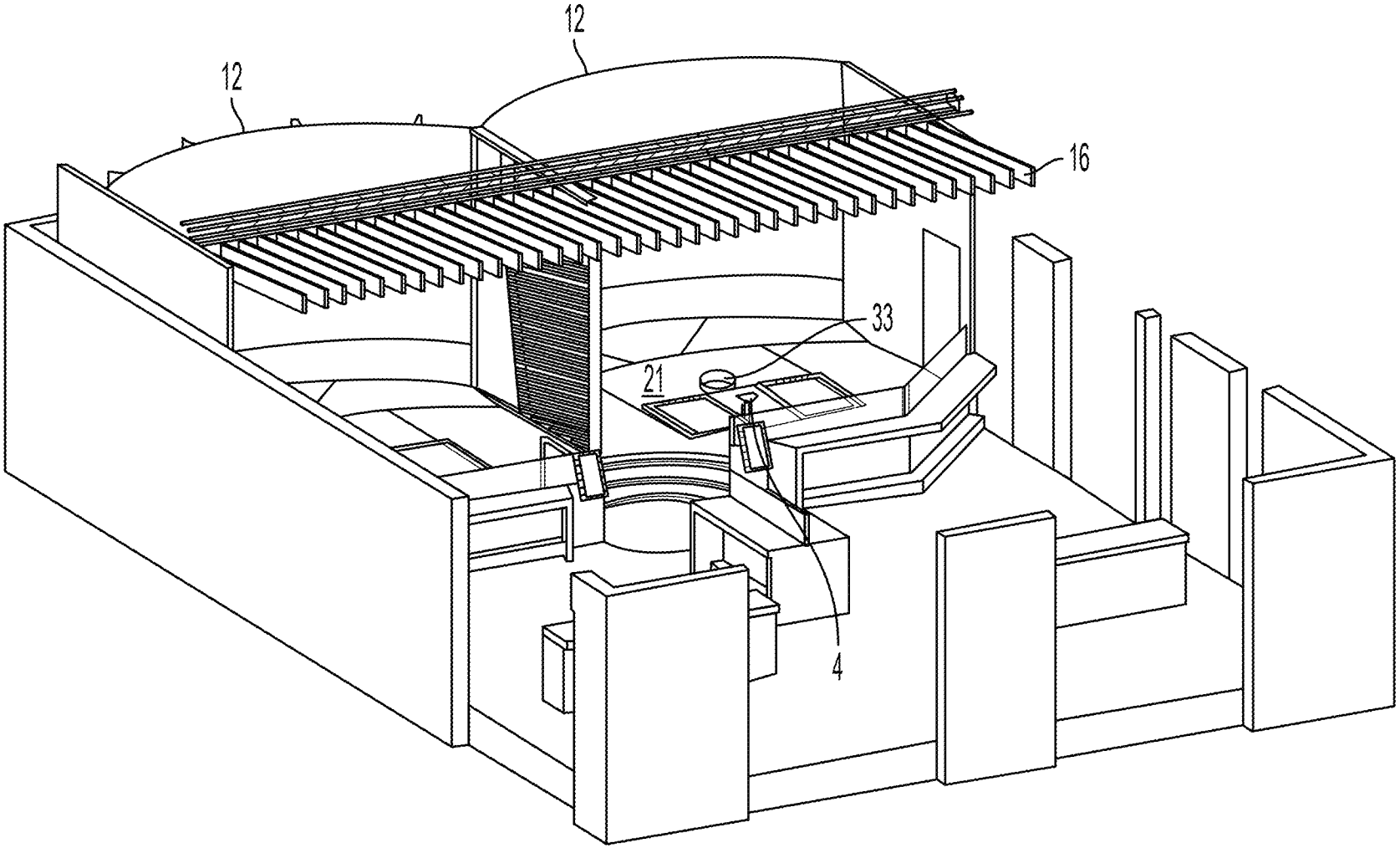
FIG. 1B is a diagram illustrating a three-dimensional (3D) rendering of the side-by-side player bay layout of FIG. 1A in accordance with one embodiment described herein.
Figure 1C:
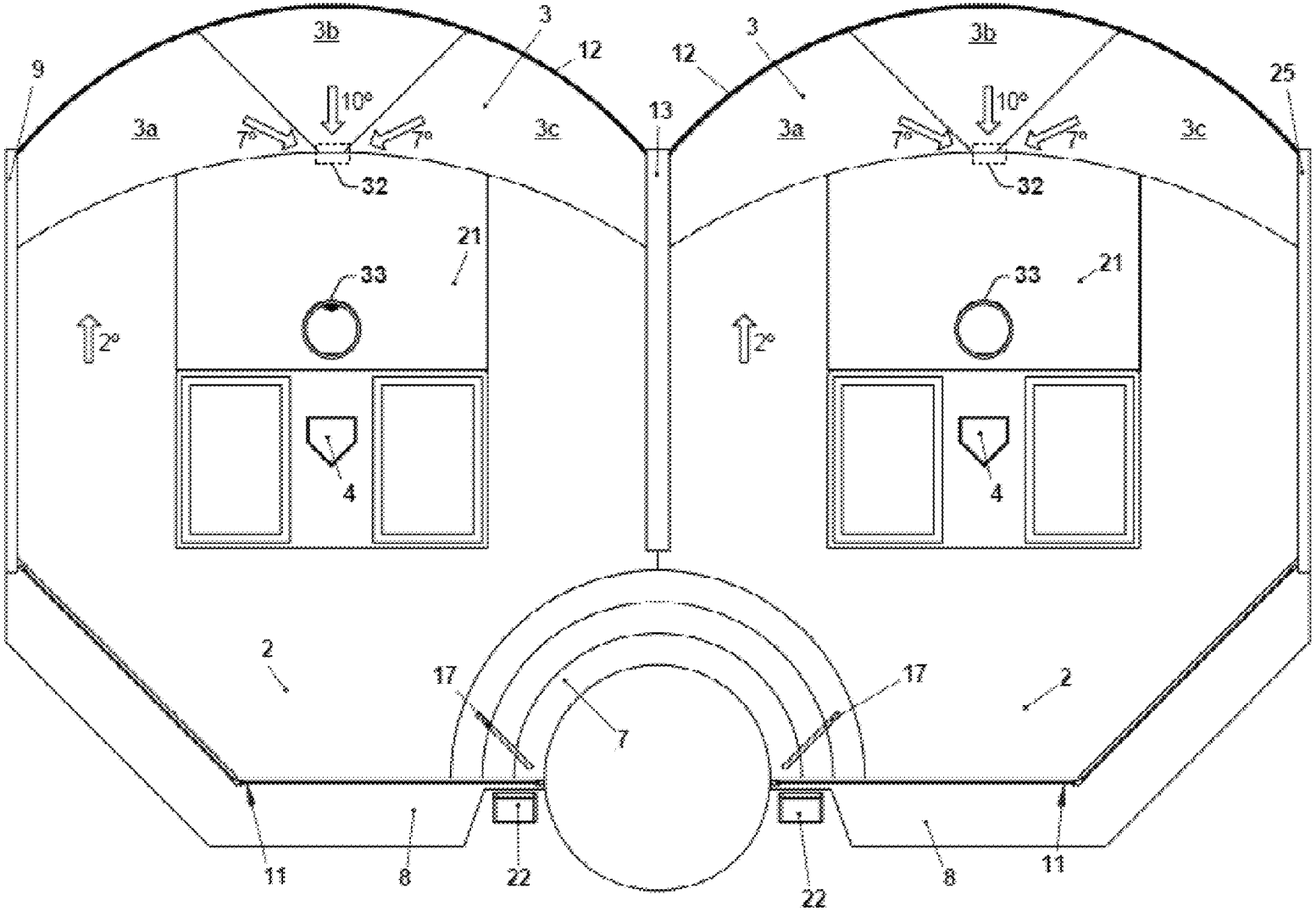
FIG. 1C is a diagram illustrating an overhead view of the side-by-side player bay layout of FIG. 1A in accordance with one embodiment described herein.
Figure 1D:
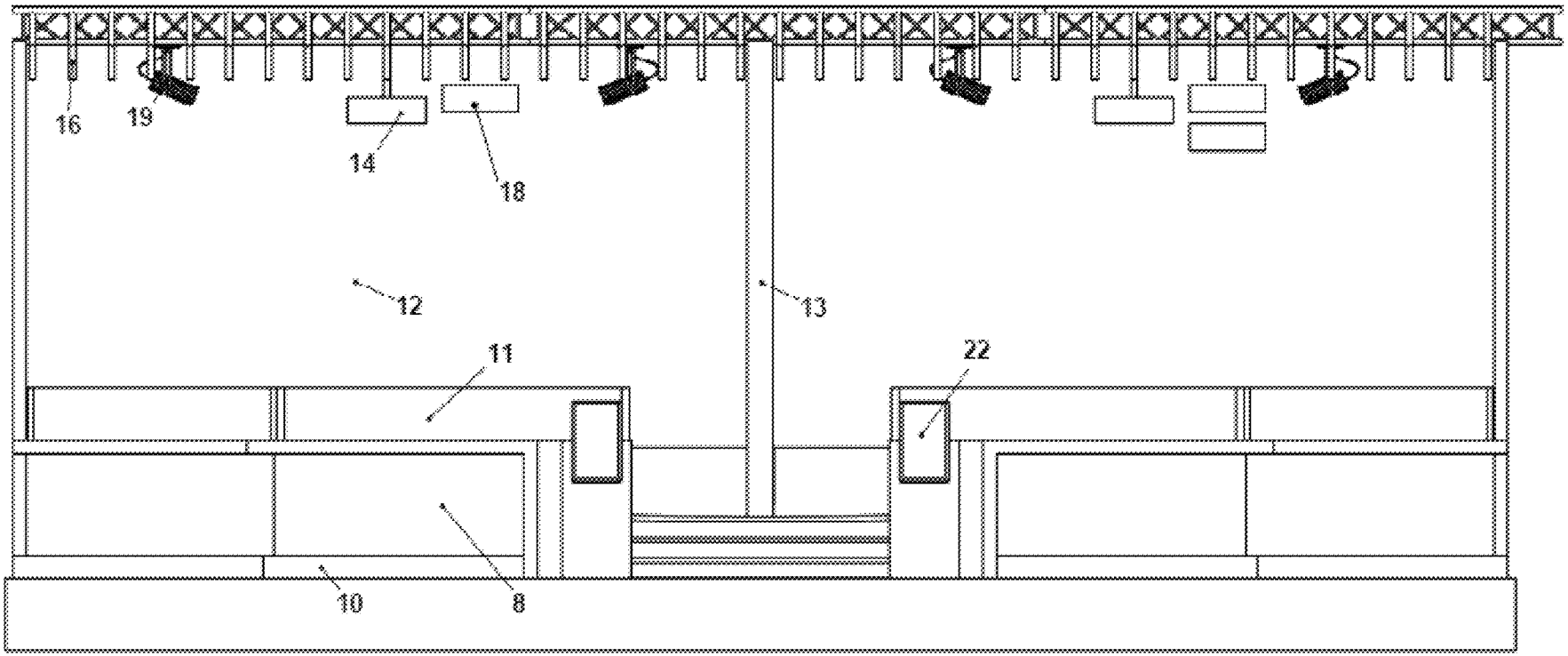
FIG. 1D is a diagram illustrating a front-facing view of the side-by-side player bay layout of FIG. 1A in accordance with one embodiment described herein.

Aspects described herein are directed to a system that enables a convenient use of a standalone pitching machine for pitching balls, with a capability to control the trajectory of the pitch. Aspects described herein may be designed such that they can be used in batting bays, which may include indoor or outdoor batting areas where players can practice hitting balls against a hitting screen or into an open field. Aspects described herein may also designed be for use in backyards as well as in youth games and practice sessions.

According to one implementation of the techniques described herein, a system includes a storage area configured to store a ball. The system also includes a ball launcher configured to impart a launching force to the ball received from the storage area. In some examples, the ball launcher is disposed below-ground. The launching force corresponds to a launch direction of the ball and a launch velocity of the ball, and the launching force causes the ball to travel upwards and to arc through the strike zone of a batter. In some examples, the ball may arc outside the strike zone, e.g., if the pitch is intended to be a "ball" pitch. In embodiments including a below-ground launcher, the ball may pass through a hole or an aperture in the ground or a surface below the level of the base of the batter's strike zone.

Examples of the methods and systems discussed herein are not limited in application to the details of construction and the arrangement of components set forth in the following description or illustrated in the accompanying drawings. The methods and systems are capable of implementation in other embodiments and of being practiced or of being carried out in various ways. Examples of specific implementations are provided herein for illustrative purposes only and are not intended to be limiting. In particular, acts, components, elements and features discussed in connection with any one or more examples are not intended to be excluded from a similar role in any other examples.

Also, the phraseology and terminology used herein is for the purpose of description and should not be regarded as limiting. Any references to examples, embodiments, components, elements or acts of the systems and methods herein referred to in the singular may also embrace embodiments including a plurality, and any references in plural to any embodiment, component, element or act herein may also embrace embodiments including only a singularity. References in the singular or plural form are not intended to limit the presently disclosed systems or methods, their components, acts, or elements.

The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. In addition, in the event of inconsistent usages of terms between this document and documents incorporated herein by reference, the term usage in the incorporated references is supplementary to that of this document; for irreconcilable inconsistencies, the term usage in this document controls.

As discussed above, it is often difficult to find enough people and an appropriate place to play sports. Sports entertainment experiences attempt to capture the enjoyment of sports by placing sports practice and game scenarios in a casual setting, often accompanied by food, drink, and a nightlife element. On occasion, the line between a sports entertainment facility and a sports practice facility can be blurred. One common example of a sports entertainment and/or sports practice facility is a golf driving range. Casual golfers visit driving ranges for entertainment and camaraderie, whereas amateur and professional golfers visit driving ranges to practice/improve their golf swings and specific golf shots.

For sports that involve striking a ball, there are at least two challenges for a training/entertainment facility: 1) presenting balls to a player for play, and 2) collecting balls once they have been presented to the player (and potentially, though not necessarily, struck by the player). In the case of a driving range, the first challenge is addressed by merely providing access to a bucket of golf balls, so that the player can place a golf ball on the ground or on a tee, as the rules of golf require the ball to be at rest when hit with a golf club. The second challenge is usually addressed by having collection vehicle(s) canvas the driving range and collect golf balls that have been hit, so that the collected balls can be dumped into a vending machine used to fill the buckets.

The driving range model may be unsuitable for other sports. For example, in a batted ball game such as baseball, softball, cricket, etc., the ball is generally moving towards the player when the player hits the ball. Further, although collection vehicles can be used to collect batted balls, such vehicles can be expensive and prone to mechanical failure due to constantly being in the line of fire.

As such, improved pitching machines and batting bay systems for training/entertainment facilities are provided herein. In at least one embodiment, the baseballs or softball are launched by a below-ground launcher towards a player. In one example, the player can attempt to hit the launched ball with a bat, and the balls are returned to the below-ground launcher. In other embodiments, the ball launcher can be disposed above ground level or a surface on which the batter stands.

FIGS. 1A-1G illustrate exemplary embodiments of a side-by-side player bay layout in accordance with aspects of the present disclosure. In other embodiments, a different layout or number of player bay(s) may be used. In FIGS. 1A-1G, the player bays are for baseball/softball. In each bay, baseballs/softballs are launched, by a respective ball launcher, upwards (though not necessarily vertically upwards), e.g., through a hole in the ground (for below-ground launchers), towards a player holding a bat, i.e., a batter. The player can swing the bat at the launched ball and try to hit the launched ball. Each bay is architected to provide automatic ball collection functionality. Thus, balls that are hit, as well as balls that are missed, can be automatically directed to a hopper that feeds the ball launcher, as further described herein. It should be noted that for ease of understanding, not all player bay components are labeled in all of FIGS. 1A-1G.

As shown in FIGS. 1A-1G, for baseball/softball embodiments, each player bay may include a home plate 4 between two batter's boxes. A region of the player bay including the home plate 4 and the batter's boxes may be substantially flat (i.e., horizontal). Each bay also may include a pitch deck 2 and a collection deck 3. In the illustrated example, each collection deck 3 is divided into three regions: 3*a*, 3*b*, and 3*c*. Each deck may be sloped so that balls landing on the decks are directed to a hopper 32. In certain embodiments, at least a portion of the collection deck 3 may form a surface (e.g., bottom surface) of the hopper 32.

In some examples, the pitch deck 2 has a slope of between one degree and ten degrees downwards towards a screen 12 and/or towards the hopper 32. In the embodiment illustrated, the pitch deck 2 has a slope of approximately two degrees. Portions of the pitch deck 2 behind the relatively flat batter's box area may also be sloped to funnel balls towards the sides of the bay. In some examples, the regions 3*a*, 3*b*, 3*c* of the collection deck 3 have a slope between one degree and fifteen degrees downwards towards the hopper 32 and/or away from the projection screen 12.

In the embodiment illustrated, the central region 3*b* has a downward slope of approximately ten degrees and the side regions 3*a*, 3*c* have a downward slope of approximately seven degrees. Generally, slopes of the decks 2, 3*a*, 3*b*, 3*c* may be greater than the "breakover angle" for the type of balls being pitched, where the breakover angle is the minimum angle of slope for the ball to reliably be expected to roll over its laces and make its way towards a ball collection mechanism.

In some examples, the pitch deck 2 is made of hardwood and the collection deck 3 is low pile carpeting or sport court material that does not hinder the ability of a ball to roll across the collection deck 3 to the hopper 32. When the pitch deck 2 is made of hardwood, the grain of the hardwood (and seams between boards of the hardwood) may be oriented parallel to the direction in which balls should roll towards the hopper.

In certain examples, the pitch deck 2 may include, without limitation, appropriate flooring or floor coverings, such as PVC, vinyl flooring, linoleum, synthetic turf, or other flooring or floor covering conducive to enabling balls to roll down the sloped surface, floor covering may also be conducive to reducing light reflection to optimize accuracy of IR and camera ball-tracking technology.

In some examples, a wall 13 separates the player bays. In the illustrated example, at least a portion of the wall 13 is an open lattice structure. Balls hitting the wall 13 or side walls 9, 25 are directed to the hopper 32 in each bay. In the illustrated embodiment, the player bays are raised and accessible via steps 7, and a handrail 17 is provided to aid in climbing the steps 7. In one embodiment, a touchscreen computing device 22 is located proximate to each bay and enables control of game functionality, as further described herein. In an entertainment setting, the player bays may be surrounded by features such as a bar counter 8, foot stop 10, and guard 11.

In certain examples, the guard 11 may extend from the top of a bar counter 8 or table to a height sufficient to protect patrons from tipped balls flying, bouncing or otherwise entering into a spectator lounge area, including patrons seated at or standing near the bar counter 8. In some embodiments, the guard may be from between six (6) inches and ninety-six (96) inches. The guard 11 may be transparent so that patrons in the spectator lounge area can watch the batter and the screen 12.

In each bay, the player's view is largely filled by the screen 12, which is configured to display high-definition (or ultra-high-definition) graphics while cushioning balls so that they land on the collection deck 3 and roll towards the hopper 32. Stage lights 19 and a trellis ceiling 16 may be present in some embodiments.

In some embodiments, the screen 12 comprises a display screen, capable of displaying video and/or animated graphics. In a particular aspect, the graphics displayed on the screen 12 indicate an estimated (e.g., computer calculated or simulated) ball flight trajectory when the player swings and makes contact with a ball.

For example, the bays may include a projector 18 that projects the graphics onto the screen 12, where the graphics are dynamically generated by a computing device based at least in part on data output by a ball tracking system 14. Although shown as being side by side, in alternative examples the ball tracking system 14 may be above home plate 4 and the projector 18 may be a slightly lower than the ball tracking system 14 and (e.g., 3 feet to 10 feet, or possibly 4 feet to 6 feet) behind home plate 4.

An illustrative non-limiting example of a ball tracking system is HitTrax® (HitTrax is a registered trademark of InMotion Systems, LLC of Westborough, MA). The ball tracking system 14 may output ball tracking data, such as exit velocity of the ball off the bat, launch angle of the ball off the bat, direction of the ball off the bat (e.g., horizontal angle), estimated distance that the ball would travel if its trajectory were not disturbed by the bay screen/walls/decks, etc.

The ball tracking system 14 may be suspended from the ceiling 16 or may be placed elsewhere in a bay (e.g., on a wall, in home plate 4, or on the pitching system 100 itself). In some examples, speakers or a sound bar may also be placed in the trellis ceiling 16 to output sound effects/music.

Although not shown in FIGS. 1A-1G, in some examples, cameras may be placed around the batting bay. For examples, cameras may have a view of the batter's swing from various angles, e.g., from "first base", "second base", and "third base", and footage from such cameras (which in some cases may include audience reactions captured from people behind the batter, such as at the bar counter 8, at other seating areas, etc.) may be used for ball tracking purposes, to generate entertaining instant replays, to generate content to automatically post to social media websites or display on various screens/devices in the establishment, etc.

Figure 1E:
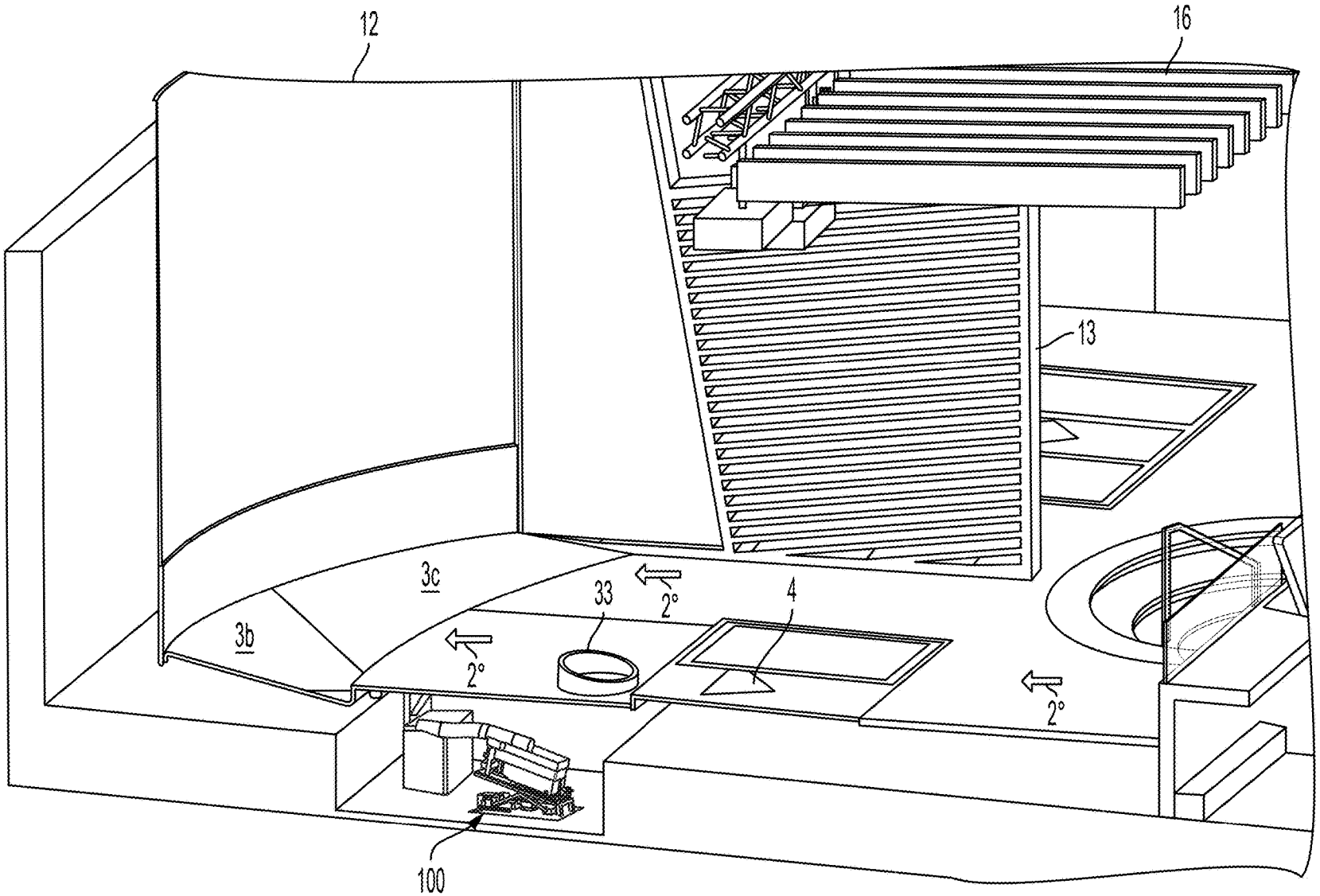
FIG. 1E is a diagram illustrating a cross-sectional view of the side-by-side player bay layout of FIG. 1A in accordance with one embodiment described herein.
Figure 1F:
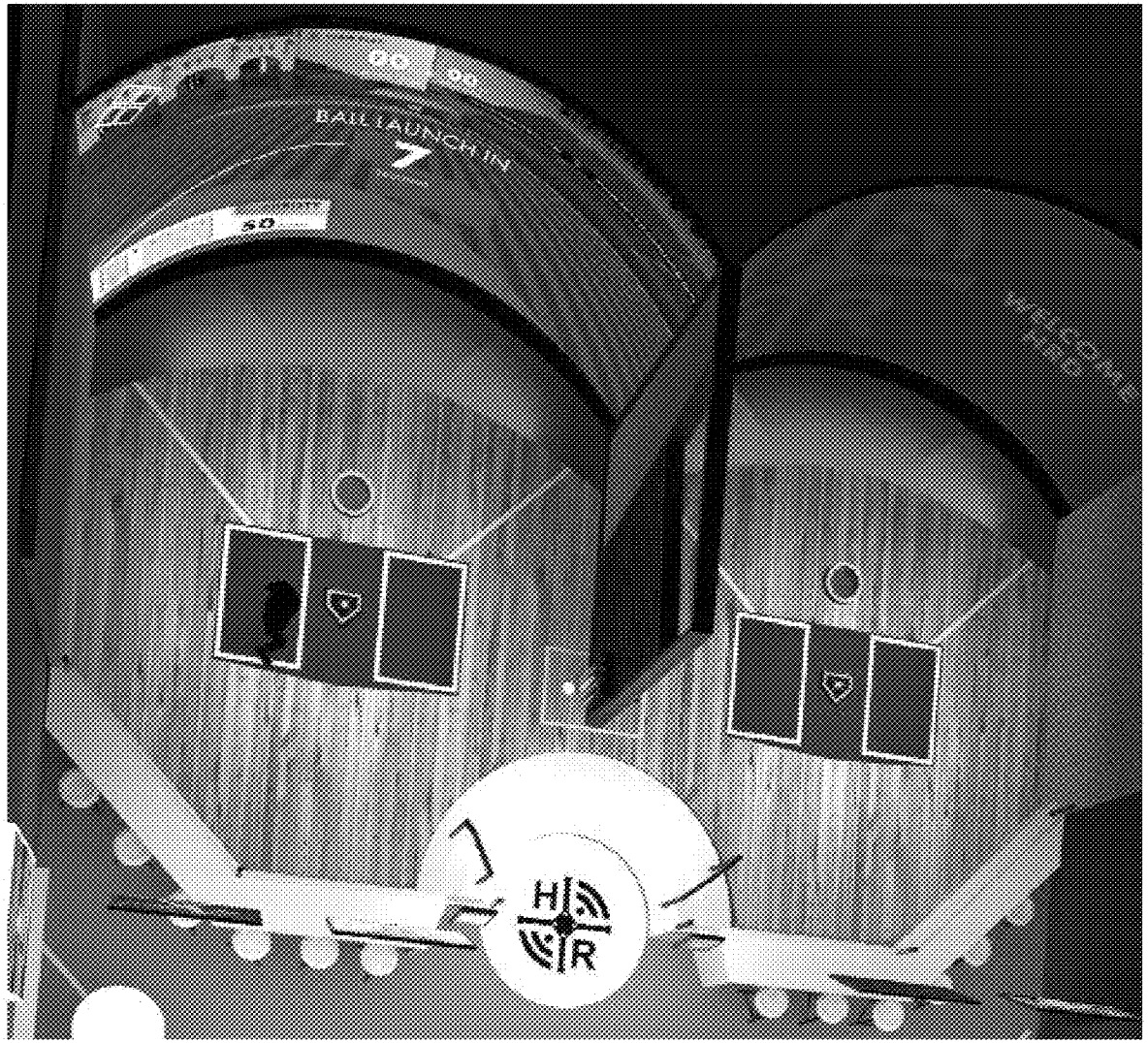
FIG. 1F is a diagram illustrating an overhead rendering of the side-by-side player bay layout of FIG. 1A in accordance with one embodiment described herein.

In a particular embodiment, balls may be launched by a ball launcher upwards through a hole 33 in the ground, which is also referred to herein as a "pitch circle." In some embodiments, the hole 33 is in an access door 21 that is part of the pitch deck 2 of each bay. FIG. 1E illustrates an example of a ball launcher (alternatively referred to herein as a ball pitching system, pitching machine, or ball pitching device) 100 configured to launch balls through the hole 33.

Figure 1G:
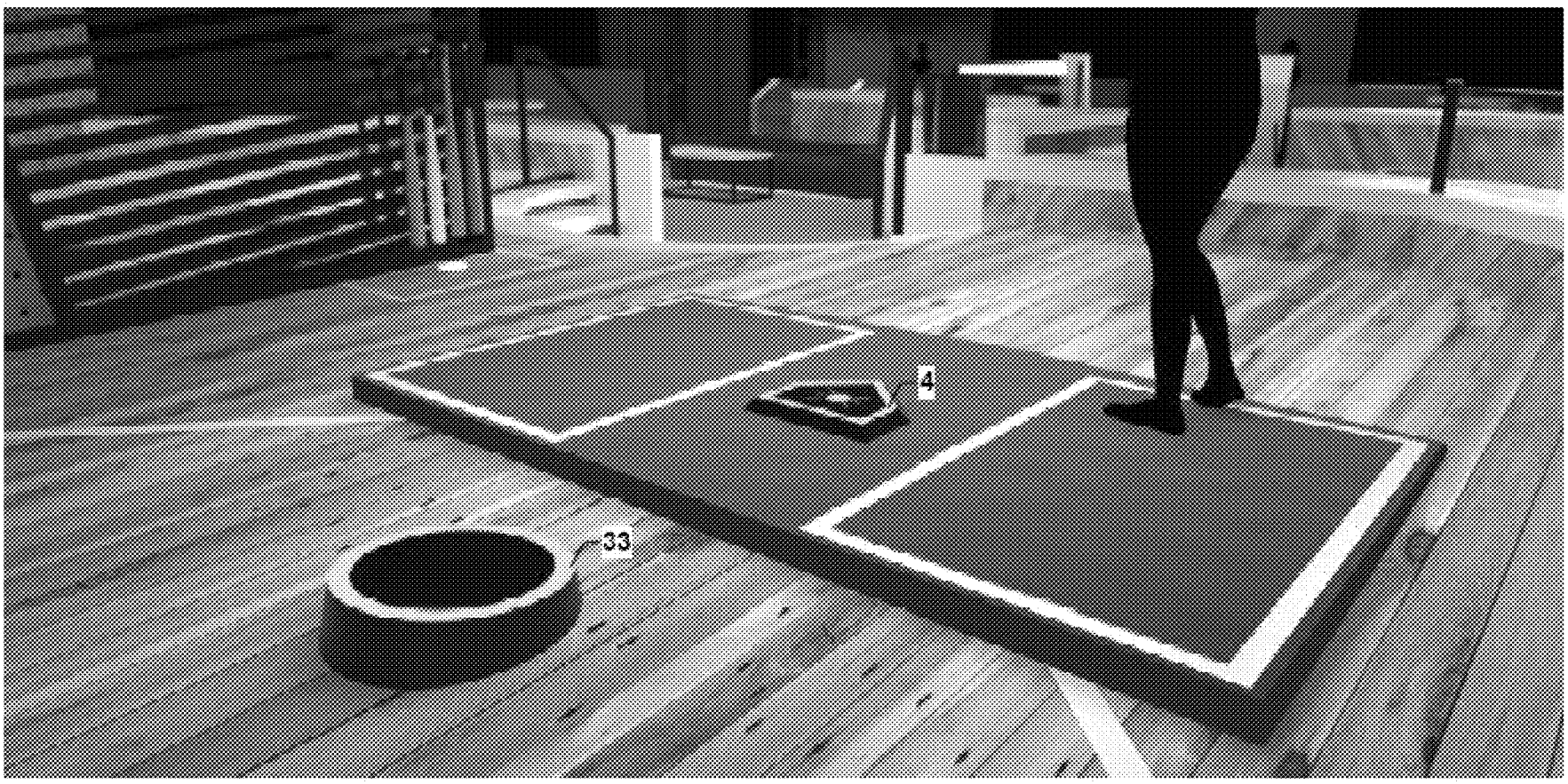
FIG. 1G is a diagram illustrating a portion of the side-by-side player bay layout of FIG. 1A in accordance with one embodiment described herein.

In some examples, the hole 33 and home plate 4 may support multi-color lighting that can convey information to a player, as shown in FIG. 1G. To illustrate, the periphery of the hole 33 and the periphery of home plate 4 may change to a particular color and/or flash in a particular pattern to indicate that a ball launch is forthcoming, that the ball launcher has encountered an error, that play is paused/suspended, gameplay targets on screen or in the field that platers should aim for, etc.

In a particular embodiment, the hole 33 has a shroud or other mechanism to provide at least some protection from ball ingress. In a particular embodiment, home plate 4 is infrared (IR)-transparent and includes an infrared sensor that is configured to detect when a player waves a bat over home plate 4. Waving a bat over home plate 4 may be interpreted as a signal that the player is ready for ball(s) to be launched. Waving a bat or making some other appropriate gesture (e.g., a single-wave, double-wave, triple-wave, or a vertical waving gesture) over home plate may also be used to indicate a type of pitch desired by the batter.

In other embodiments, a player may be recognized (and his/her data input into a computing device for practice/gameplay tracking), and pitches may be initiated, based on the player having a radio frequency identification (RFID) tag (e.g., in a batting glove, bat, etc.) and moving the RFID proximate to RFID reading circuitry in the player bay.

Operation of illustrative embodiments of the ball pitching system 100 is described with reference to FIGS. 2A-7. The ball pitching system 100 may be a standalone, programmable ball pitching system/device/robot with the capability to control the trajectory of a pitch. It is to be understood that trajectory control includes both launch angle control (e.g., in at least two dimensions) as well as initial launch velocity control. Trajectory control may also include imparting a spin to the ball. In one example, a ball pitching system having command of the trajectory of a pitch may accurately project a ball to various locations, for example in and around a strike zone.

For example, the strike zone may be a 3D volume of space over home plate extending from the hollow between a batter's kneecap to a midpoint between the top of the batter's pants and the top of the batter's shoulders. Thus, the bounds of the strike zone may change as the batter's stance changes. To illustrate, the top/bottom of the strike zone may be at a different height for a shorter player than for a taller player, and even for similar height players if one has a crouched batting stance and the other has a more upright batting stance.

For purposes of training or playing, a player's strike zone may be set, for example based on an "average" strike zone for players of a specific or similar height, or, based on player height and other bodily dimensions, including height of the player's knee, height of the player's shoulder, etc., a strike zone may be dynamically calculated. In some embodiments related to dynamic calculation of an "at bat" player's strike zone, cameras around the bay detect the batter's stance, and computer vision functions are used to determine the bounds of the strike zone for that batting stance.

Based on such a dynamically calculated strike zone, or on a preset or predetermined strike zone, the pitching machine can adjust the parameters of the ball pitch to place the ball within or around the defined strike zone for the player at bat. The pitching machine may achieve this placement by changing system parameters including but not limited to tilt, roll and launch velocity (i.e., power delivered to a piston, e.g., pneumatic, solenoid, etc., as further described herein).

Tilt, roll, and/or launch velocity determination functions at the pitching machine may be dynamically adjusted, so that when a pitch is supposed to be targeted at the top/bottom of the strike zone (e.g., using the GUI of FIGS. 13A-13C), the pitch is properly placed at the top/bottom of the strike zone as defined for the current batter/batting stance. Tilt and roll, which are further described herein, may correspond to two distinct, orthogonal axes of motion of the pitching machine (or at least portions thereof).

The trajectory control capability of the ball pitching system 100 may enable users (e.g., the batter or another user that is playing a game with or against the batter) to select where, within or outside the strike zone, the ball is to be pitched. Control over the flight of the ball through the strike zone may help hitters practice hitting balls in various locations in and around the strike zone as well as hitting balls pitched at various velocities.

Figure 11A:
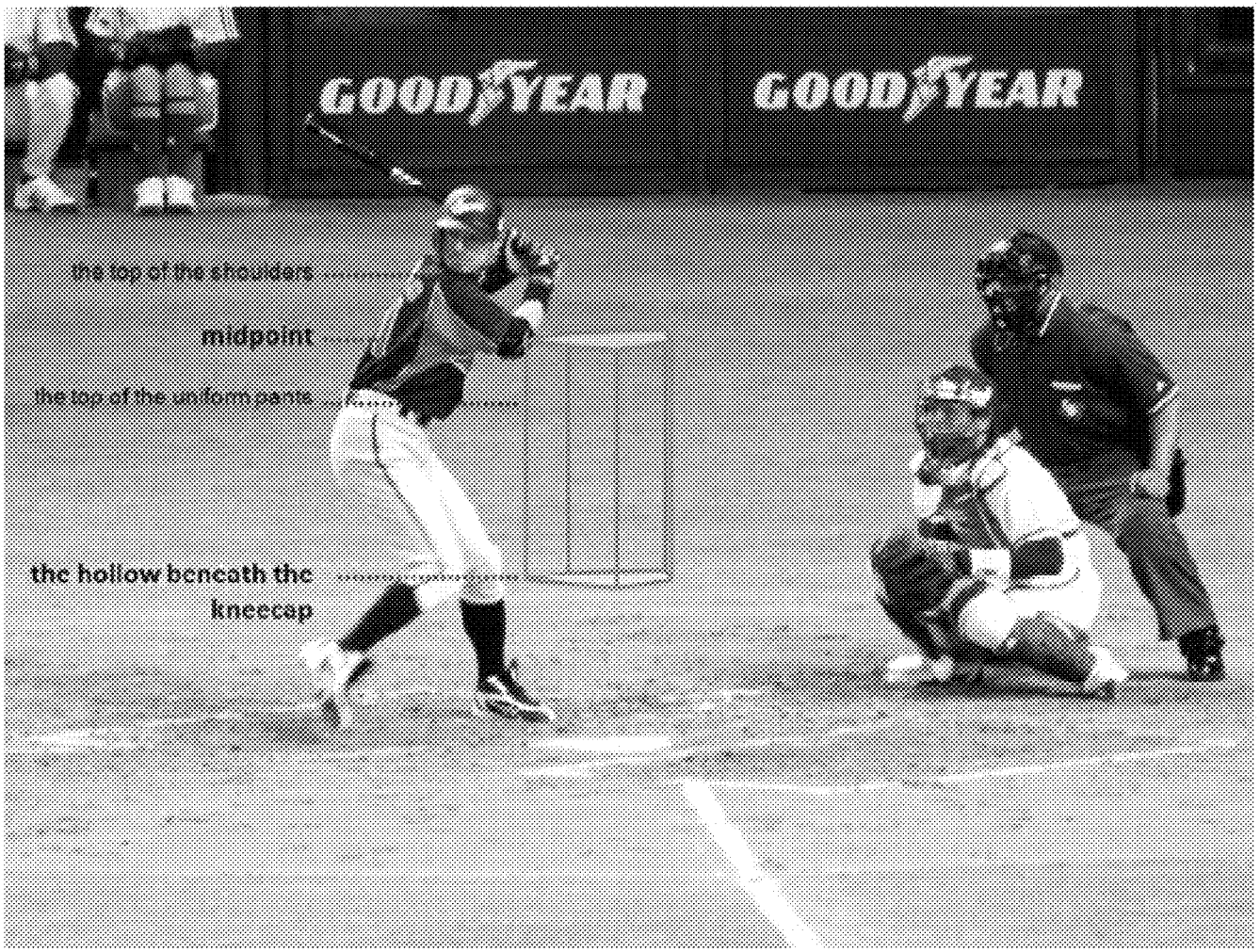
FIG. 11A is a diagram illustrating a strike zone in accordance with one embodiment described herein.

FIG. 11A illustrates the pentagonal prism shape of the strike zone. By controlling the launch direction and initial velocity of the ball, the ball pitching system 100 may control points at which the ball enters and exits the strike zone. The launch direction may be a 3D vector that can be expressed in accordance with a cartesian notation (e.g., X, Y, and Z components) or a cylindrical notation (e.g., R, Z, and Theta components). Therefore, adjusting the launch direction of a ball may include modifying one, two, or all three components.

Figure 11B:
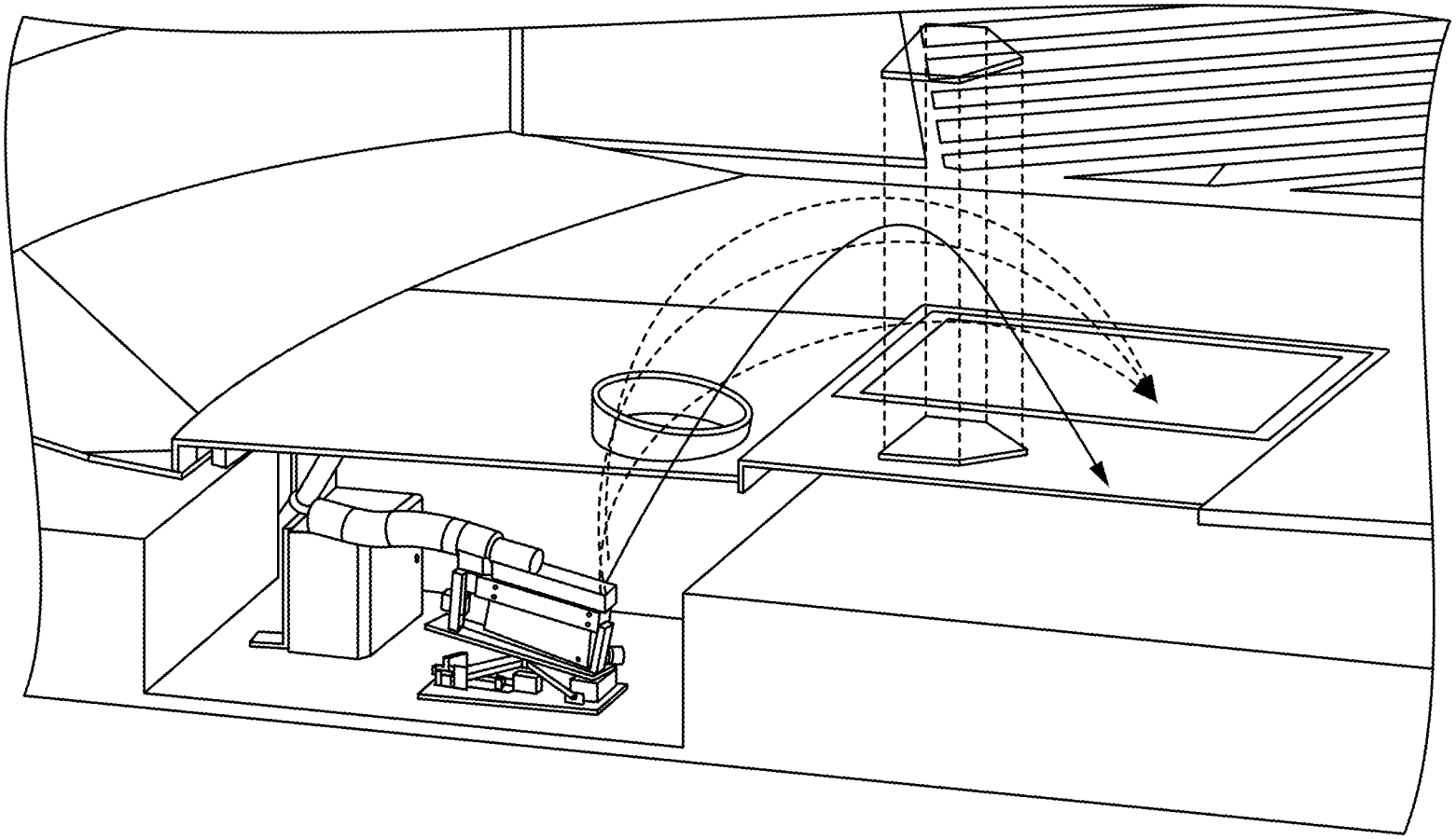
FIGS. 11B, 11C, 11D, and 11E are diagrams illustrating example pitch trajectories in accordance with embodiments described herein.
Figure 11C:
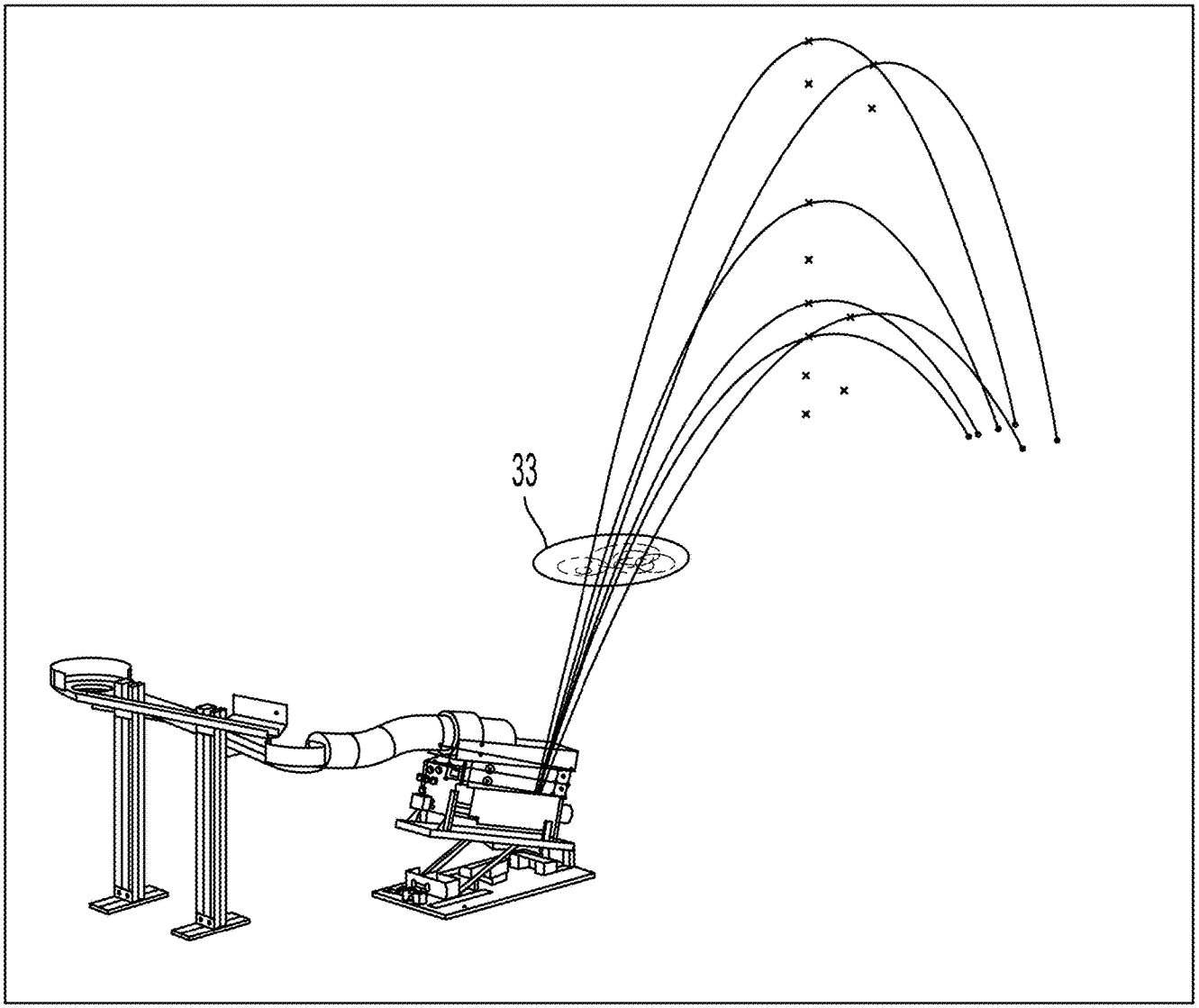
Figure 11D:
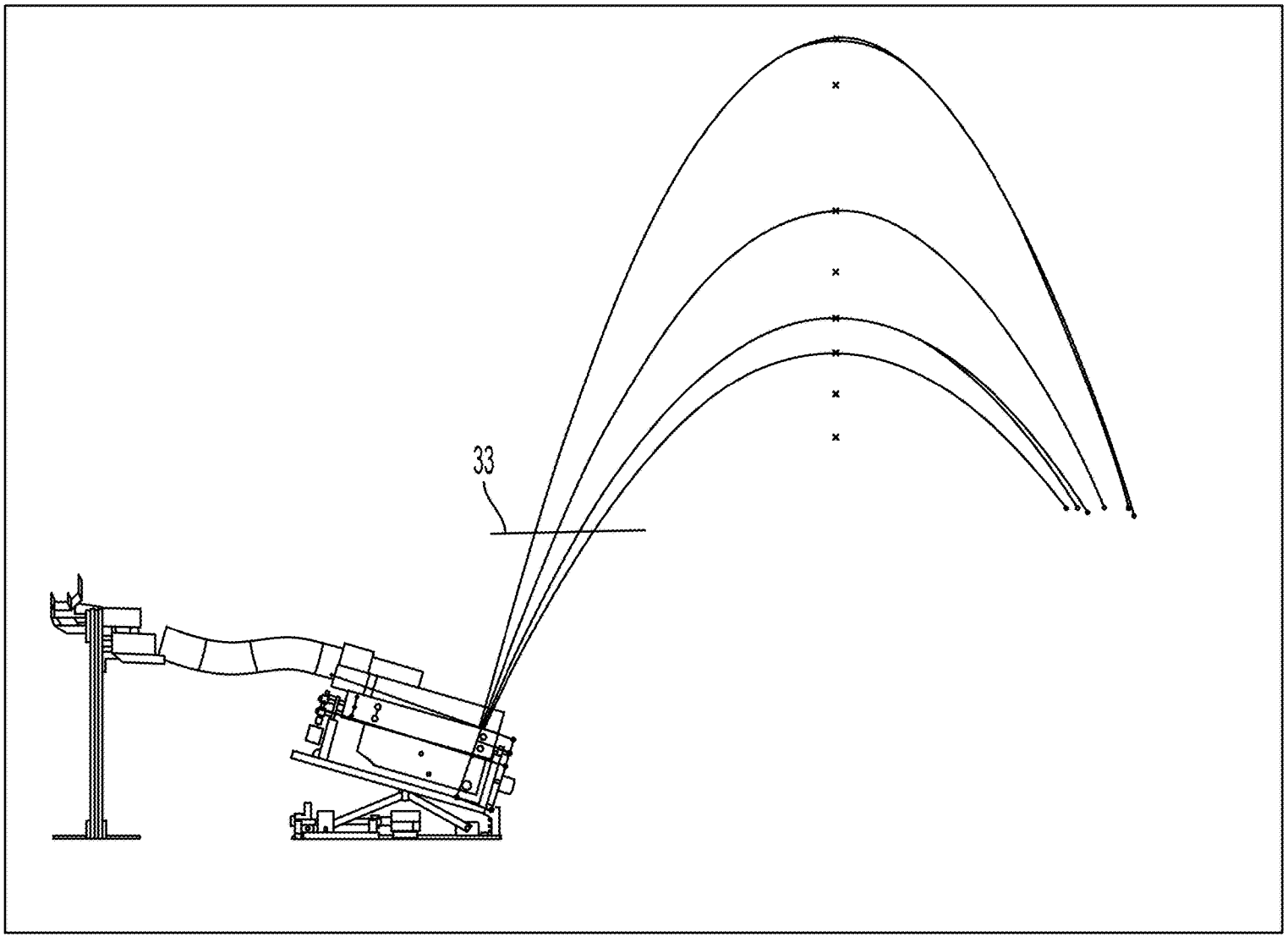
Figure 11E:
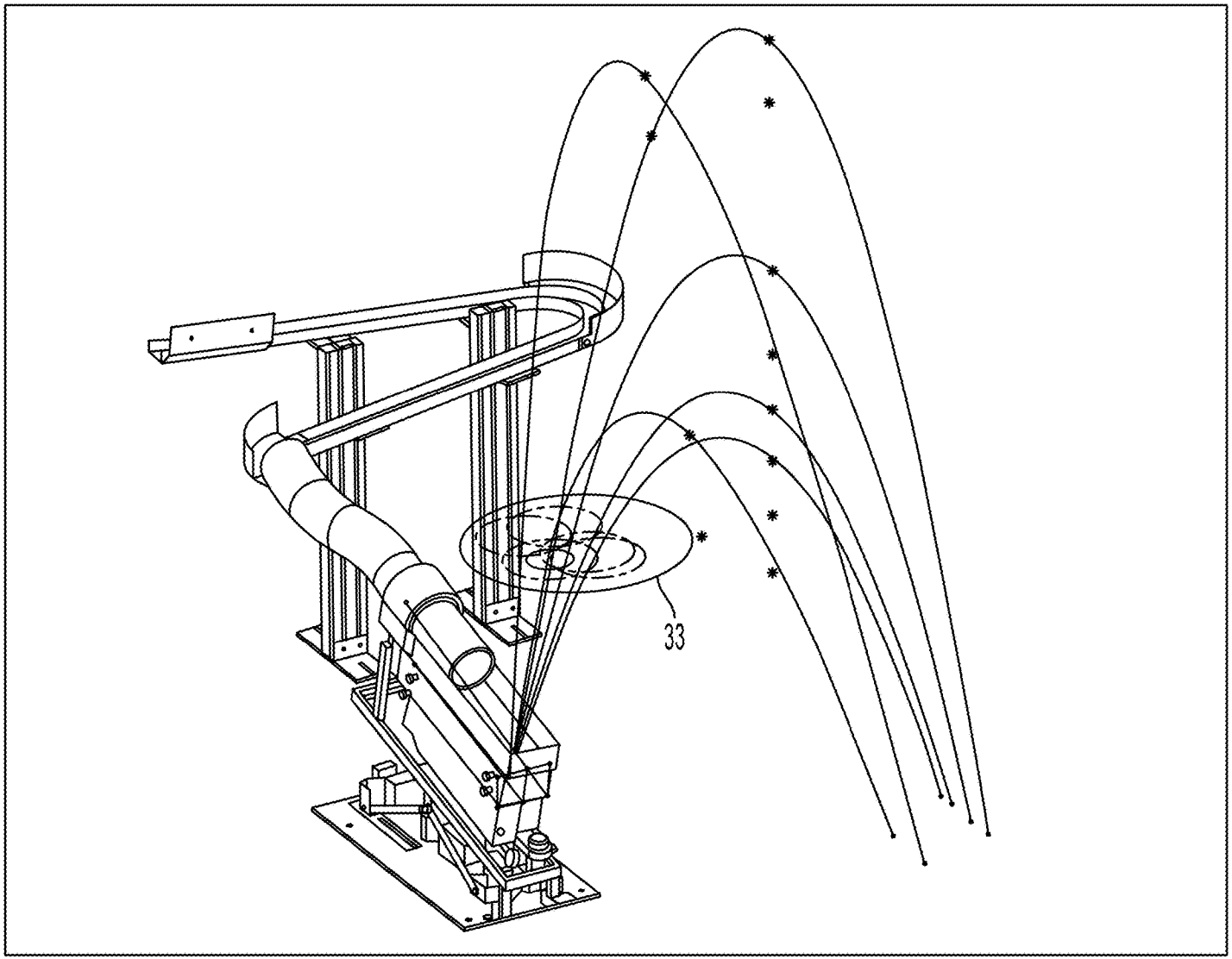

In entertainment settings, it is expected that the trajectory of launched balls will be slow arcs that pass (e.g., arcing descent) through the strike zone in a manner conducive to hitting. FIGS. 11B, 11C, 11D, and 11E illustrates examples of such trajectories (though a 3D volume as indicated in FIG. 11B, there is no batter shown and thus there is no specifically determined lower or upper bound for the strike zone in FIG. 11B). It will be appreciated that the pitching machine disclosed herein is capable of pitching balls for practice/gameplay to both right-handed batters and left-hand batters without requiring manual intervention when the handedness of the batter changes.

The disclosed pitching machine may thus be preferable to a "from-the-side" machine that lobs a ball to a right-handed hitter from a location in or behind the left-handed batter's box, and vice versa, because the "from-the-side" machine would need to be manually moved to the opposite side of home plate whenever the handedness of the batter changes. The disclosed pitching machine is also preferable to using an L-screen to protect a human practice pitcher, for example because there is no separate pitcher required for the disclosed pitching machine, because it can be time-consuming to put up and tear down the L-screen, and because struck balls would not be automatically returned to the human pitcher behind the L-screen.

The disclosed pitching machine may also be preferable to and provide a more ruggedized solution as compared to battery powered pitching machines. For example, although a battery powered pitching machine may offer control over the height of a pitch, as the battery is drained, a selected height setting (e.g., 7 out of 10) may result in lower and lower pitches. Even in pitching machines that run on rechargeable batteries, repeated recharge cycles can degrade battery performance, especially in the case of lead-acid batteries.

Further, the disclosed pitching machine may be preferable to those that launch balls from underneath plate, because baseball/softball players are typically taught to hit the ball before it crosses home plate so that their arms can be extended and the ball can be hit with more power.

Figure 2A:
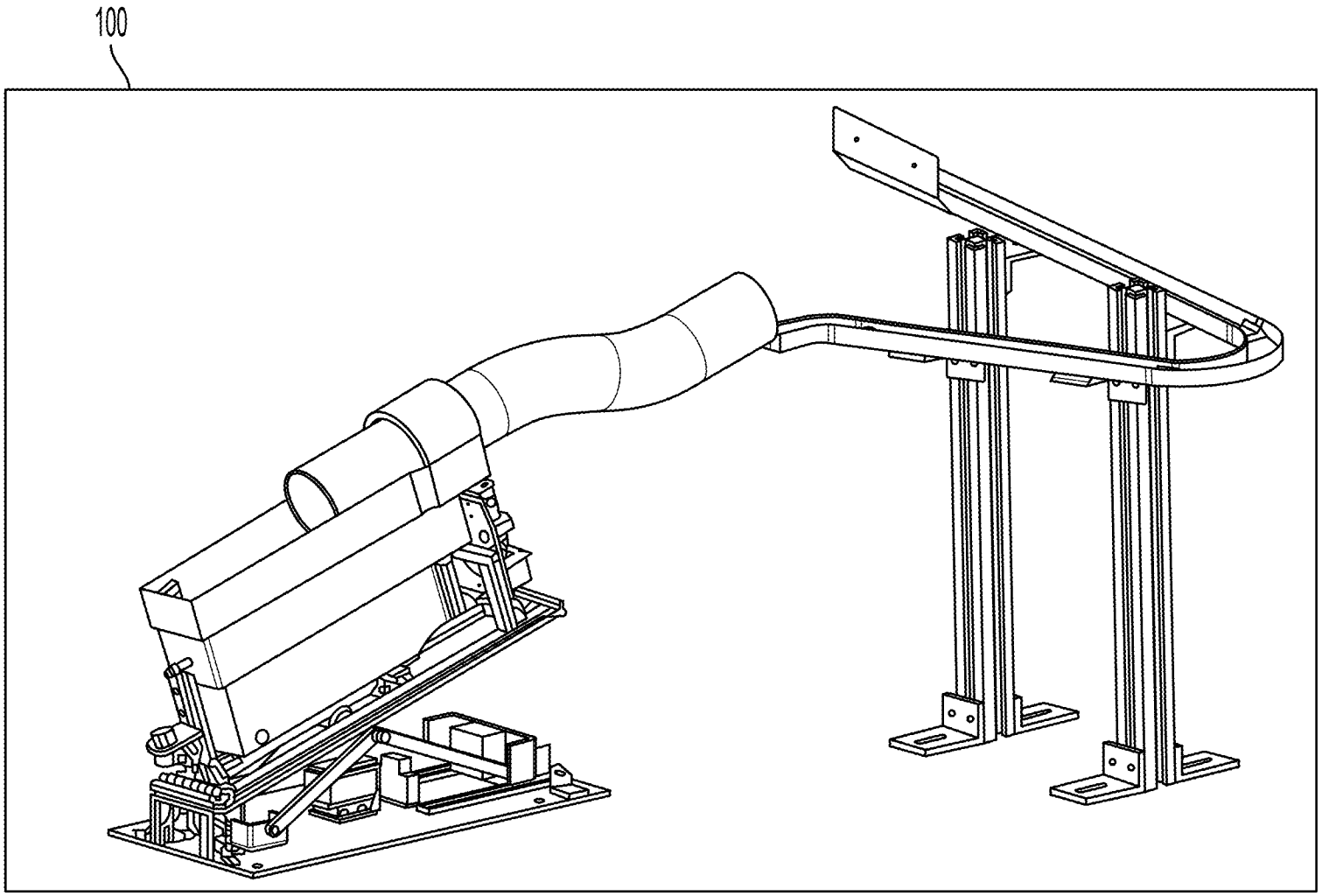
FIG. 2A is a diagram illustrating a ball pitching system in accordance with one embodiment described herein.
Figure 2B:
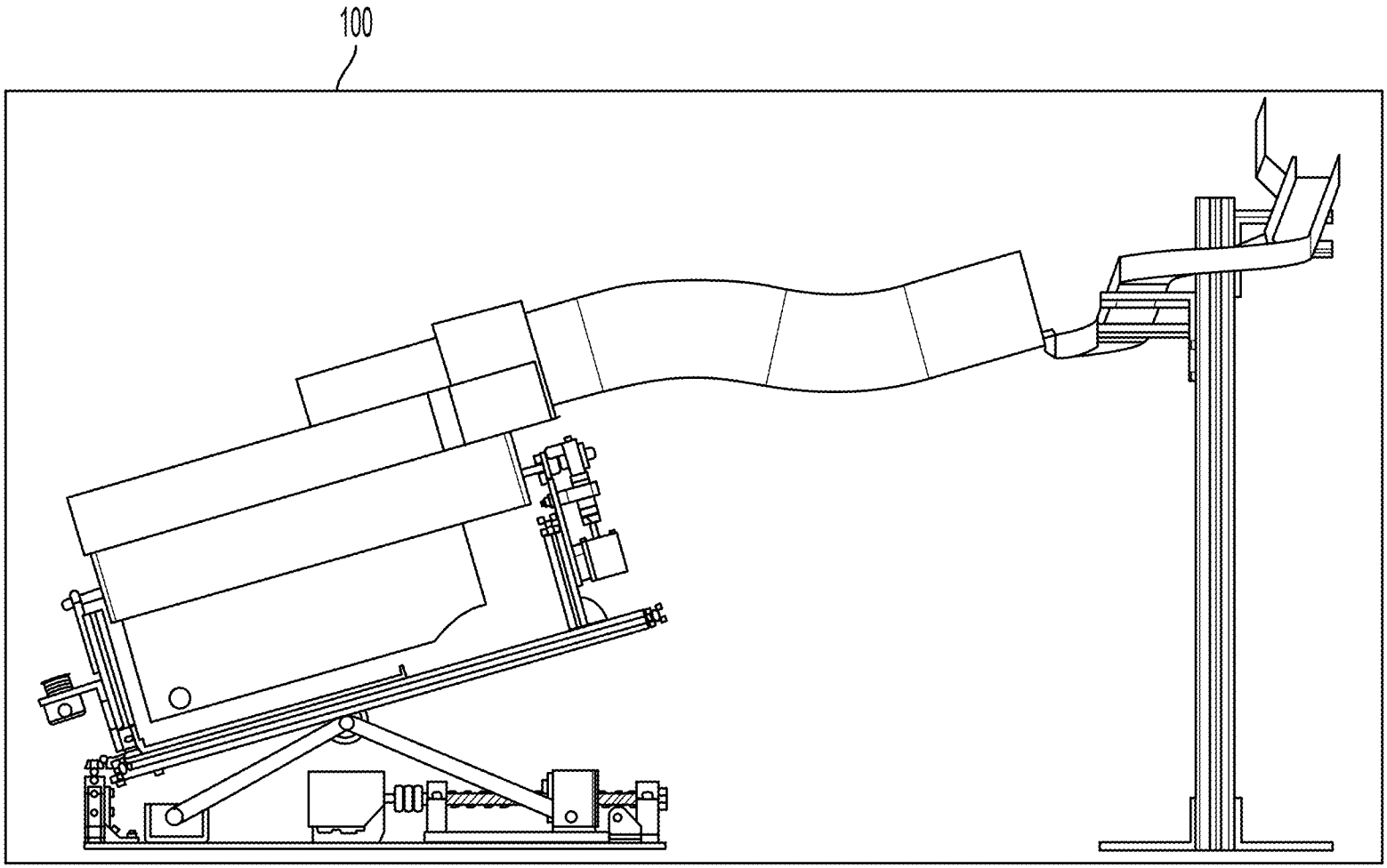
FIG. 2B is a diagram illustrating a side view of the ball pitching system of FIG. 2A in accordance with one embodiment described herein.
Figure 2C:
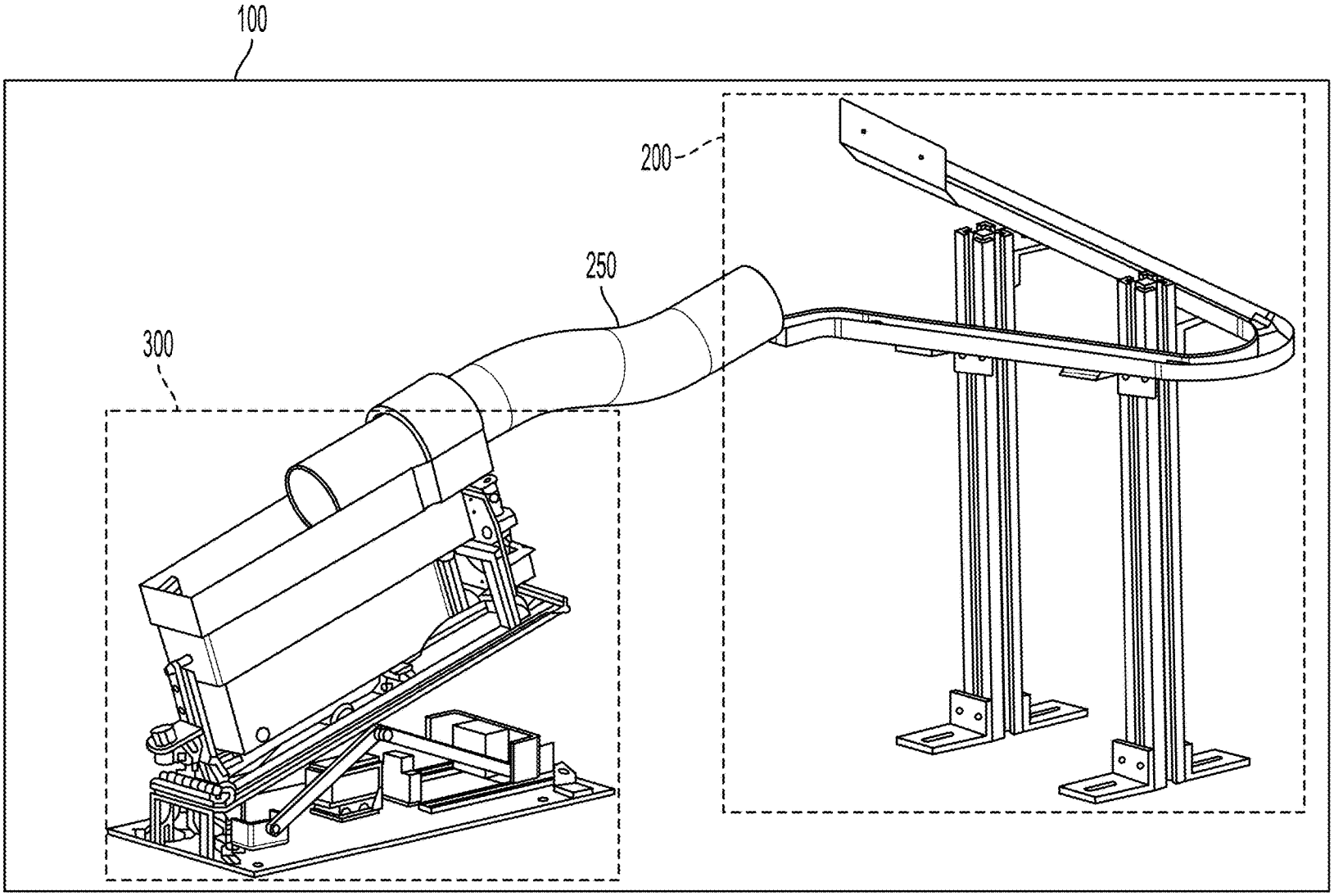
FIG. 2C is a diagram illustrating subsystems of the ball pitching system of FIG. 2A in accordance with one embodiment described herein.

Turning to FIG. 2A, an example of the ball pitching system 100 is illustrated. A side view of the ball pitching system 100 is shown in FIG. 2B. Referring to FIG. 2C, two subsystems may be included in the ball pitching system 100.

A first subsystem of the ball pitching system 100 is a ball collection and transport system 200, while a second subsystem is a ball pitching device 300 (i.e., the ball launcher). In one example, the ball collection and transport system 200 is connected to ball pitching device 300 via a length of flexible tubing, e.g., a hose 250. The functions and components of each subsystem are further explained below.

Figure 3A:
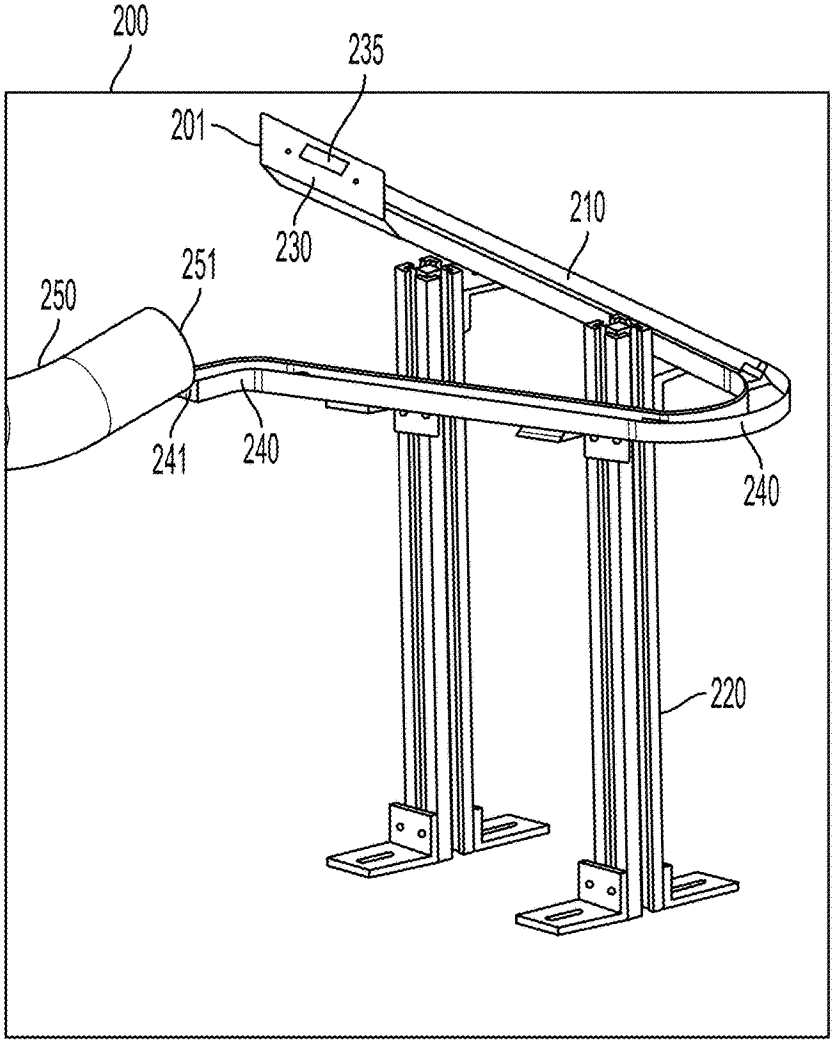
FIG. 3A is a diagram illustrating a ball collection and transport system in accordance with one embodiment described herein.

FIG. 3A shows the components of ball collection and transport system 200. Ball collection and transport system 200 is designed to collect, store, and transport balls to ball pitching device 300. As used herein, "ball collection" refers to a mechanism enabling balls to be collected or fed from external to the ball collection and transport system 200.

An external body that feeds balls to ball collection and transport system 200 can be a hopper, a funnel, or another mechanism that feeds balls that have been struck (or missed and rolled) to ball collection and transport system 200.

Figure 3B:
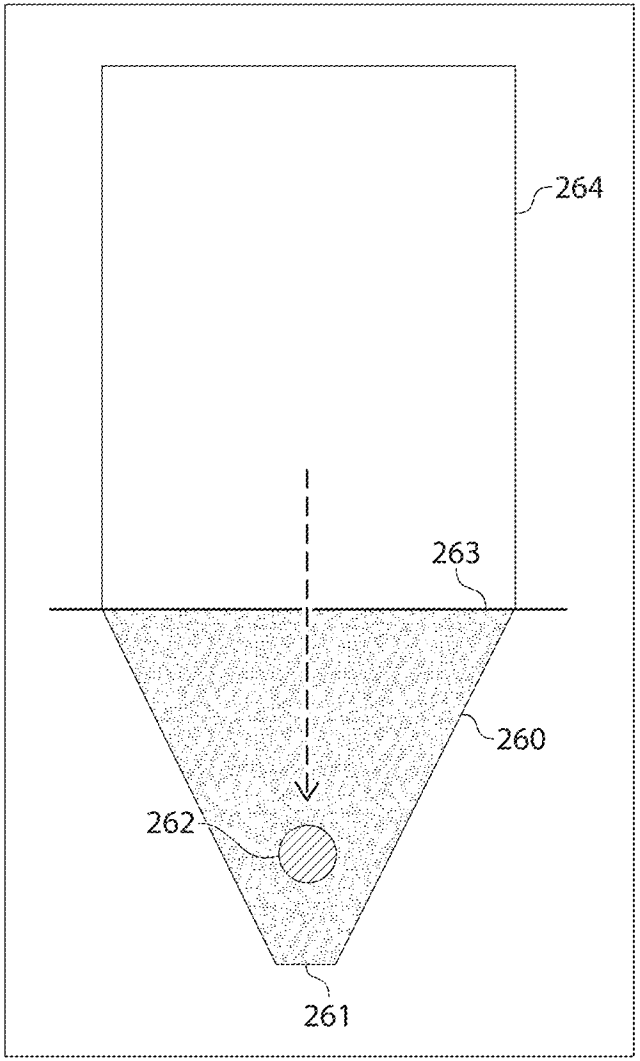
FIG. 3B is a diagram illustrating a ball feeding system in accordance with one embodiment described herein.
Figure 3B:
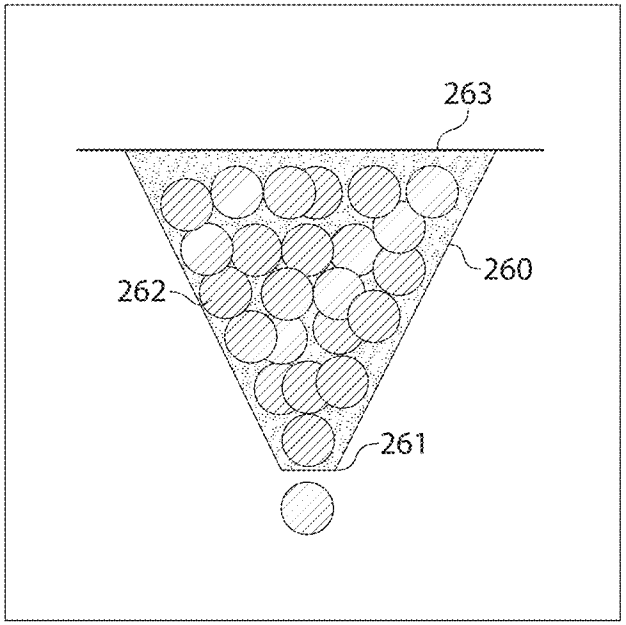

An example of an external body for feeding balls to ball collection and transport system 200 is shown in FIG. 3B. In this example, the mouth 263 of hopper 260 may receive balls 262 from another mechanism, such as the hitting screen 264 or a hitting target equipped with a receiving net, or a netting trap, that attaches to the outer circumference of the hopper mouth 263. Further, the hopper 260 feeds the ball in play through orifice 261 to ball collection and transport system 200.

Although the left side of FIG. 3B shows the hopper 260 full of balls, it is to be understood that such illustration is just to show an example of the relative size of the hopper 260 relative to the size of individual balls. For example, in practice, the hopper 260 may only be partially filled with balls.

In some examples, there may only be one ball at a time in the hopper 260, as shown on the right side of FIG. 3B, where the ball may be received after coming into contact with a hitting screen 264 (e.g., the screen 12). In certain examples, ball storage may occur in the ball collection system 200 and the hopper 260 may operate as a funnel or guide to provide the loose ball that was just hit (or missed) back into the ball collection track 210.

This type of implementation may be preferred, for example, because of the ultimate goal of eventually getting the balls in a single file line prior to feeding the ball pitching device 300. Thus, if the hopper 260 is too full, no matter the size of the orifice 261 or hopper 260, the balls may have an opportunity to bridge and/or jam within the hopper 260. This may be, for example, due to the weight, material, surface finish, size, and/or surface features of the balls in use.

In some implementations of hoppers, this may not be an issue based on geometry (e.g., implementations based on ball bearings or grains/feed hoppers), as such systems may effectively make use of passive hoppers. However, allowing the illustrated hopper 260 to become too full may require an agitation system or un-jamming mechanism (e.g., pinball flipper, vibrating motor, etc.) to deal with bridging.

Rather than introducing such an agitation system or un-jamming system, the described embodiment may maintain a passive hopper and attempt to have as few balls in the hopper at one time as possible. In some examples, the hopper 260 relies on other components, such as the ball collection rack, for ball storage.

The orifice 261 of hopper 260 may be connected to the front end 201 of the ball collection and transport system 200 shown in FIG. 3A. As will be discussed in greater detail below, the ball collection and transport system 200 may include a ball collection track 210. Ball collection track 210 may be a single-file track, enabling one ball to be fed, and to roll down, at a time. As such, the size of orifice 261 of hopper 260 may be advantageously reduced.

In a particular example, the ball collection track and hose (210, 240, and 250) will all be full of balls, ideally. In one example, the balls may fill up to the location of the shield 230 illustrated in FIG. 3A, allowing storage of the balls in a single file line. As each ball is launched, all the balls roll forward one ball diameter and make room for the pitched balls to roll back into the ball collection system. Thus, the track configuration may enable a single file line of numerous balls to be fed and eventually roll down to ball launching mechanism.

An orifice with a diameter small enough to enable one ball to be fed at a time into ball collection and transport system 200 may reduce a likelihood of "ball bridging." Ball bridging occurs when two balls are fed into a place that qualifies for one ball, which may cause a jam in the hopper and may require human or mechanical intervention.

A ball feeding system may be placed in a batting area (e.g., player bay), where the batting area is designed such that balls that have been struck and have fallen to the floor of the batting area are directed to the ball feeding system, which then feeds the balls to ball collection and transport system 200. As used herein, the term "batting area" includes, but is not limited to, backyards as well as indoor and outdoor areas designed for baseball and softball practice or gameplay.

Figure 3C:
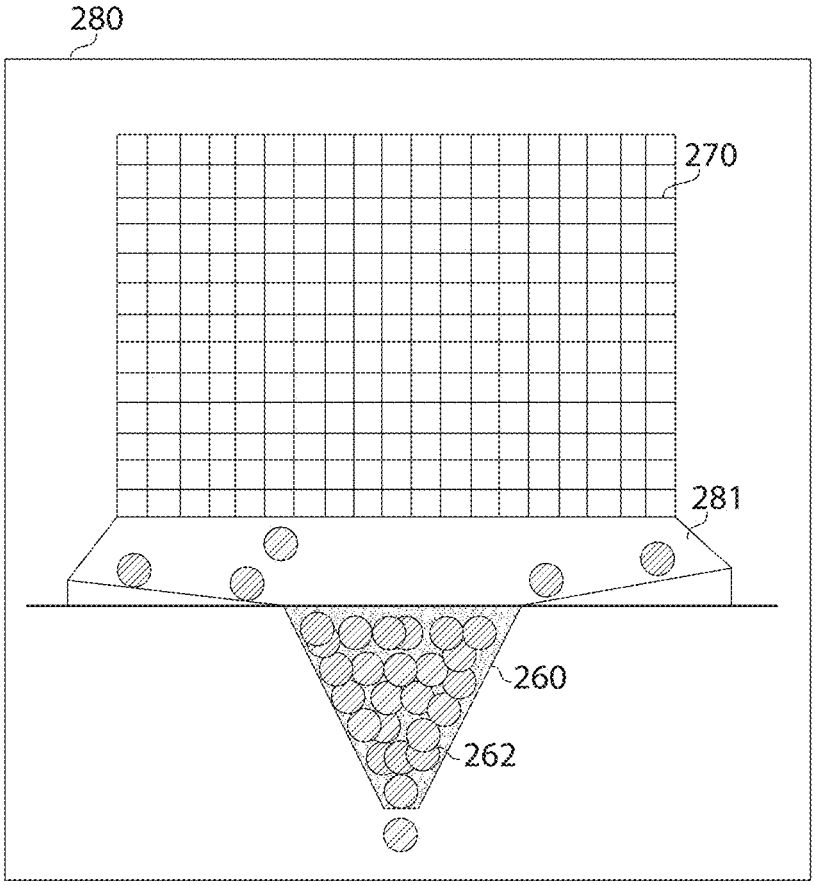
FIG. 3C is a diagram illustrating the operation of a ball feeding system in accordance with one embodiment described herein.

In one example, balls can be hit into a receiving net (which may or may not be further equipped with a hitting target) that directs hit balls to a ball feeding system. This example is illustrated in FIG. 3C. A ball feeding system, such as hopper 260, is placed in batting area 280. Balls 262 hit against receiving net 270 fall to floor 281 of batting area 280 and are directed to hopper 260. In some embodiments, the hopper 260 may be under (or directly under) the receiving net 270 (or alternatively, a screen, such as the hitting screen 264 or screen 12).

Figure 3D:
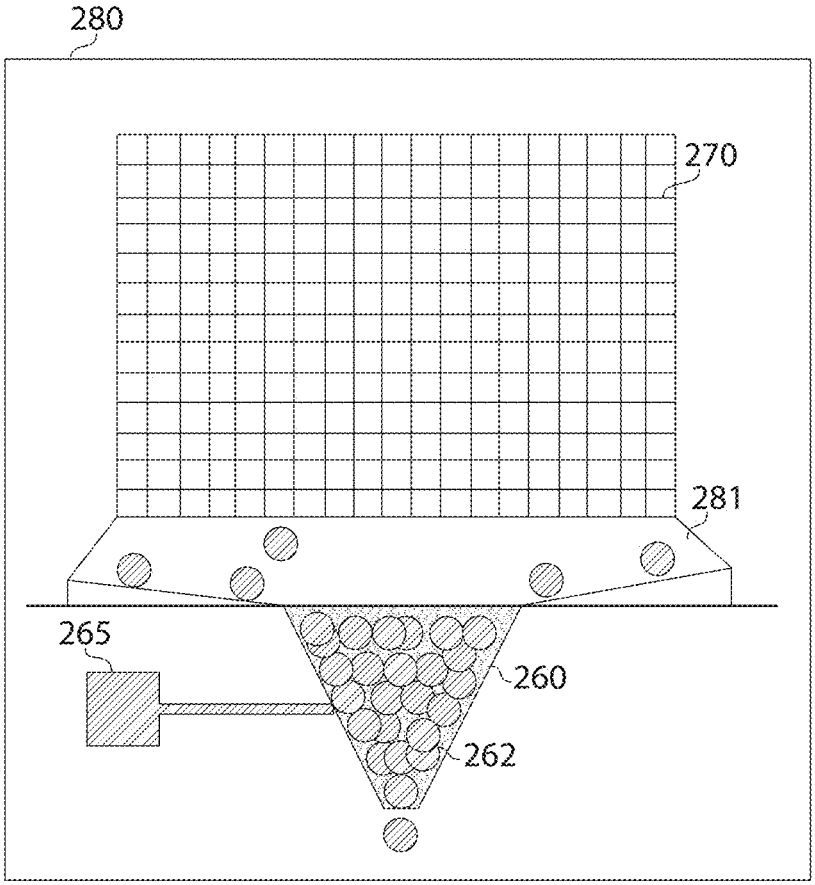
FIG. 3D is a diagram illustrating the operation of a ball feeding system in accordance with one embodiment described herein.

It should be appreciated that embodiments described herein are not limited to a specific type of hopper. While the use of a passive hopper is described above, in other examples, the ball feeding system may include an agitation system to prevent and/or resolve ball bridging within the hopper. For example, FIG. 3D illustrates a ball feeding system including an agitation system 265 configured to continuously or periodically provide physical agitations (e.g., bumps, vibrations, etc.) to the hopper 260.

Using a receiving net or the hitting screen 264 to funnel hit balls back into rotation may extend gameplay and provide users of ball pitching system 100 with a self-competitive advantage, because well struck balls may be hit into the net rather than being "fouled off" to places outside the collection purview of the ball collection system. Hitting balls into the net or screen helps keep the rotation of balls going without having to pause to collect errantly hit balls.

Referring to FIG. 3A again, when a ball is fed into front end 201 of ball collection and transport system 200, the ball rolls down on ball collection track 210. Ball collection track 210 is supported by support columns 220. Switchbacks 240 can be attached to ball collection track 210 at various locations to create any number of turns at various angles (for example, at 45, 60, 90, or 180 degrees), effectively changing the direction of the ball run.

Switchbacks 240 enable the formation of a longer ball collection track within a volume of space in comparison with a straight ball collection track design within the same volume of space. One or more shields 230 can be attached to ball collection track 210 at various locations to prevent balls from falling off ball collection track 210. In the illustrated example, the shield 230 is installed at front end 201 of ball collection and transport system 200 where balls are fed.

In other examples, shields can also or alternatively be installed around the turns of the ball collection track 210 that are created by switchbacks 240. In some examples, sensors to monitor and detect the ball queue may be present, for example via embedding into components such as shields 230. In certain examples, the sensors can be used to detect the quantity and/or quality of balls in the ball queue.

For example, the sensors may be density sensors configured to detect/determine a density of each ball. An example of such a sensor(s) is designated 235 in FIG. 3A. In one example, the sensor 235 is configured to detect balls of poor quality that should be removed from circulation.

Figure 4A:
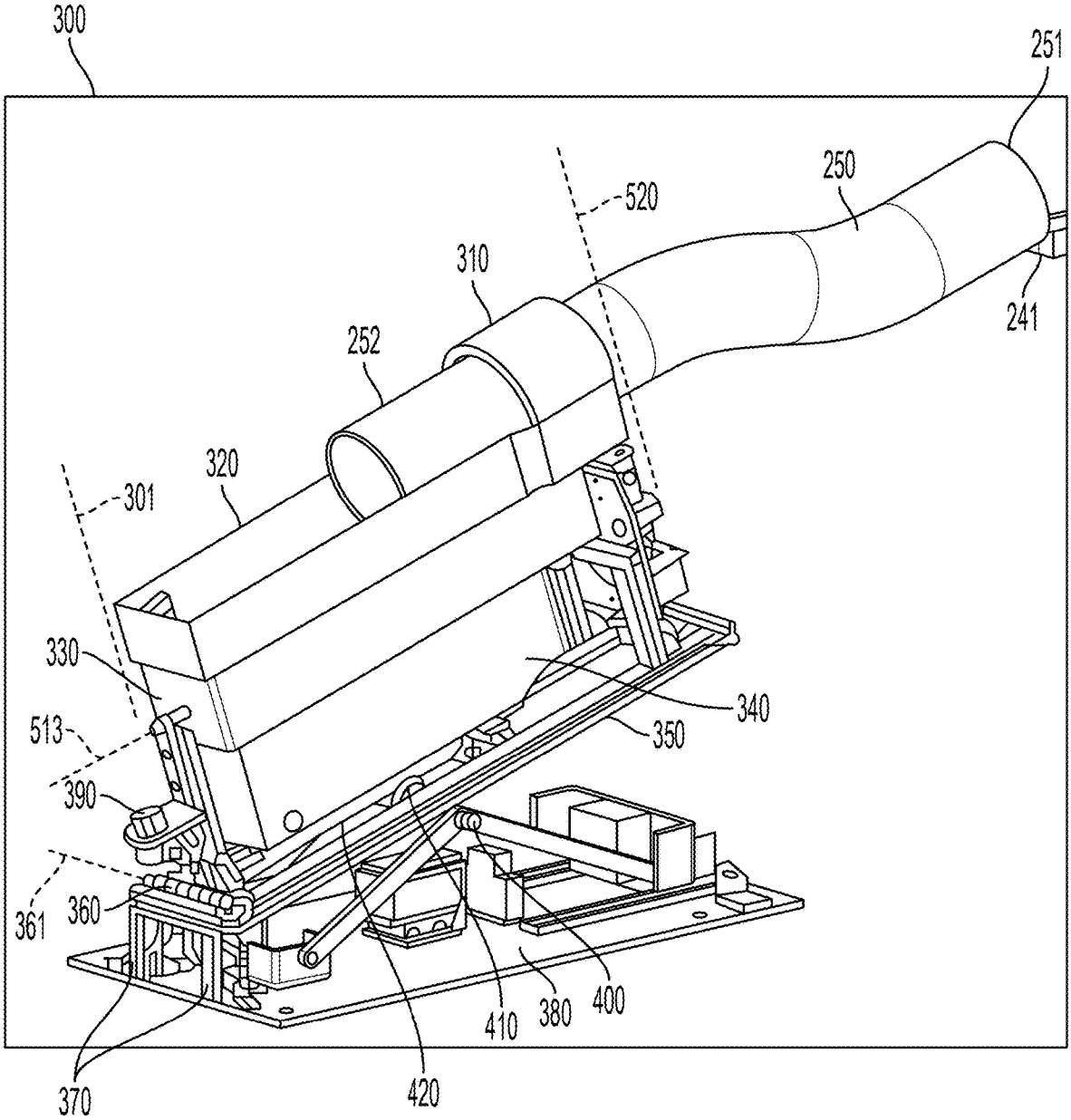
FIGS. 4A, 4B, 4C, 4D, 4E, 4F, 4G, 4H, 4I, 4J, 4K, and 4L are diagrams illustrating a ball pitching device in accordance with embodiments described herein.

As shown in FIG. 3A, rear end 241 of ball collection track 210 is connected to a first end 251 of flexible hose 250. Referring to FIG. 4A, a second end 252 of flexible hose 250 is fed through collar 310 situated at rear end 520 of the ball pitching device 300 (i.e., the ball launcher), connecting ball pitching device 300 to the ball collection and transport system 200.

In one example, the flexible hose 250 is not mechanically fastened to the collar 310. Rather, there is a slip fit between the collar 310 and the flexible hose 250, which means that the collar 310 holds the flexible hose 250, while also enabling it to translate therethrough and rotate therein (and therefore remain in the collar 310 when the roll and tilt are adjusted). Enabling the flexible hose 250 to translate through and rotate within collar 310 facilitates various types of motion achievable by the ball pitching device 300.

As will be discussed in greater detail below, the ball pitching device 300 is designed such that it can roll about or around a first axis and such that its rear end 520 can be lifted upward (i.e., the pitching device 300 can tilt on or around a second axis). The flexibility of the flexible hose 250 and its ability to translate through and rotate within the collar 310 enables the ball pitching device 300 to achieve tilting and rolling motions without causing any disturbances to the rest of the system, for example, the ball collection and transport system 200.

The ball pitching device 300 is designed to pitch balls over a specific area or within a specified volume. For example, the ball pitching device 300 can pitch baseballs over home plate and within the strike zone for a batter to strike at and hit balls against a screen or into an open field. The ball pitching device 300 is designed to have the capability to control variables such as trajectory (e.g., including initial velocity and launch direction) of the pitch. The capability to control such variables enables the ball pitching device 300 to pitch balls to very specific locations within the strike zone as well as to affect the apex of the pitch.

With continued reference to FIG. 4A, when a ball exits from the second end 252 of the flexible hose 250, it rolls onto the launching box 320. In one example, the launching box 320 is fixed to the cradle 330, and the cradle 330 is fixed to the base box 340. The launching box 320, the cradle 330, and the base box 340 are supported by the support frame 350. In some examples, the support frame 350 is attached via a hinge 360 to vertical supports 370, which effectively provide an axis 361, around which the ball pitching device 300 can tilt.

In one example, the vertical supports 370 are connected to the base plate 380. Also shown in FIG. 4A a safety sensor 390 may be situated near the front end 301 of the ball pitching device 300. As will be discussed in greater detail below, a ball is launched from a launching position within the launching box 320.

Figure 4B:
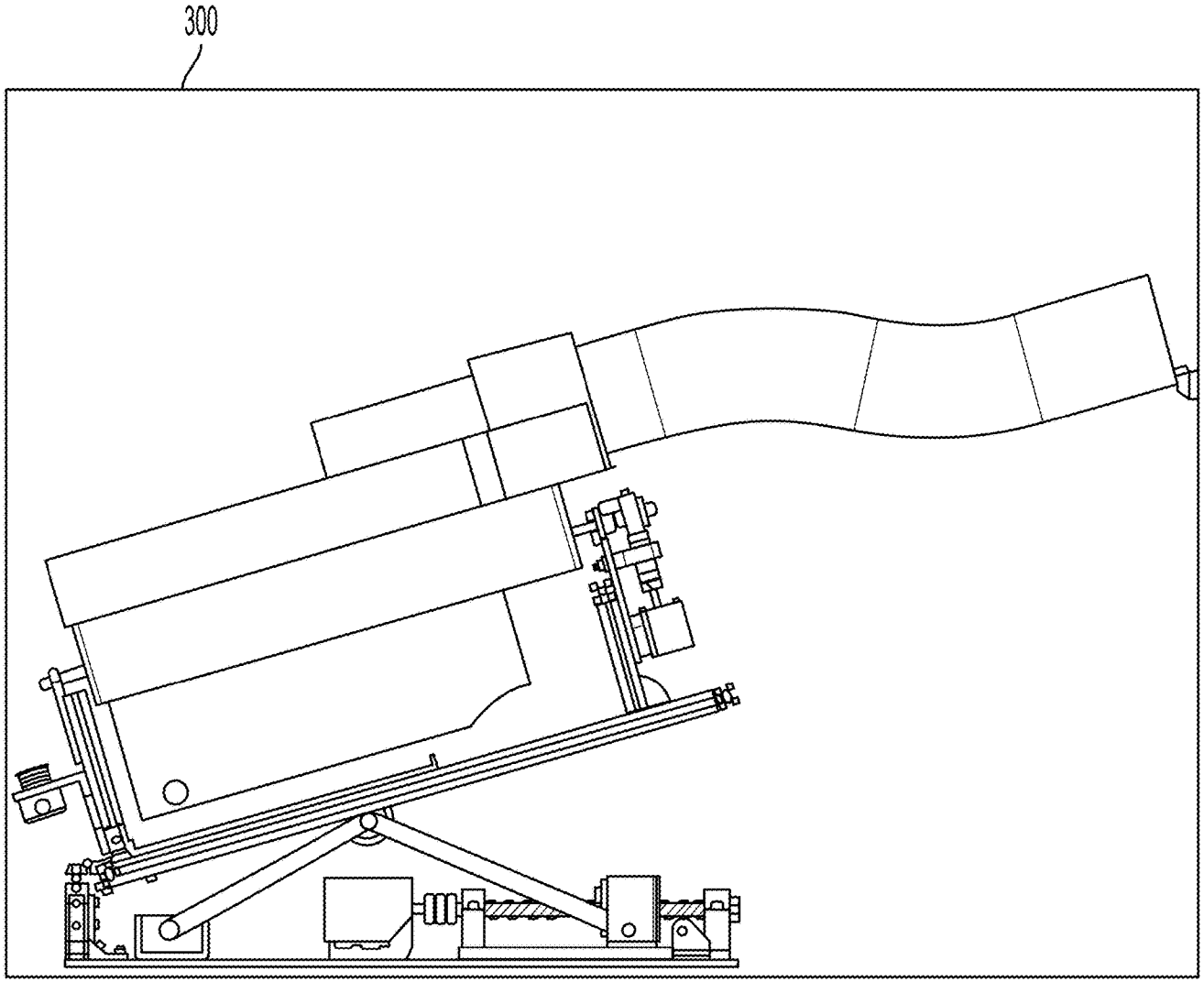

In some examples, the launching position is situated near the front end 301 of the ball pitching device 300. The safety sensor 390 may prevent the ball pitching device 300 from pitching a ball when there is an obstruction above the launching position (e.g., users looking over the launching position). In an embodiment, the safety sensor 390 is an ultrasonic sensor, the sensitivity of which is adjustable. A side view of the ball pitching device 300 is shown in FIG. 4B.

It is to be appreciated that the launching box 320, the cradle 330, and the base box 340 may each be manufactured separately and attached together mechanically or manufactured as a single integrated unit. The launching box 320, the cradle 330, and the base box 340, whether manufactured individually or as one integrated unit, are collectively referred to herein as a casing.

Figure 4C:
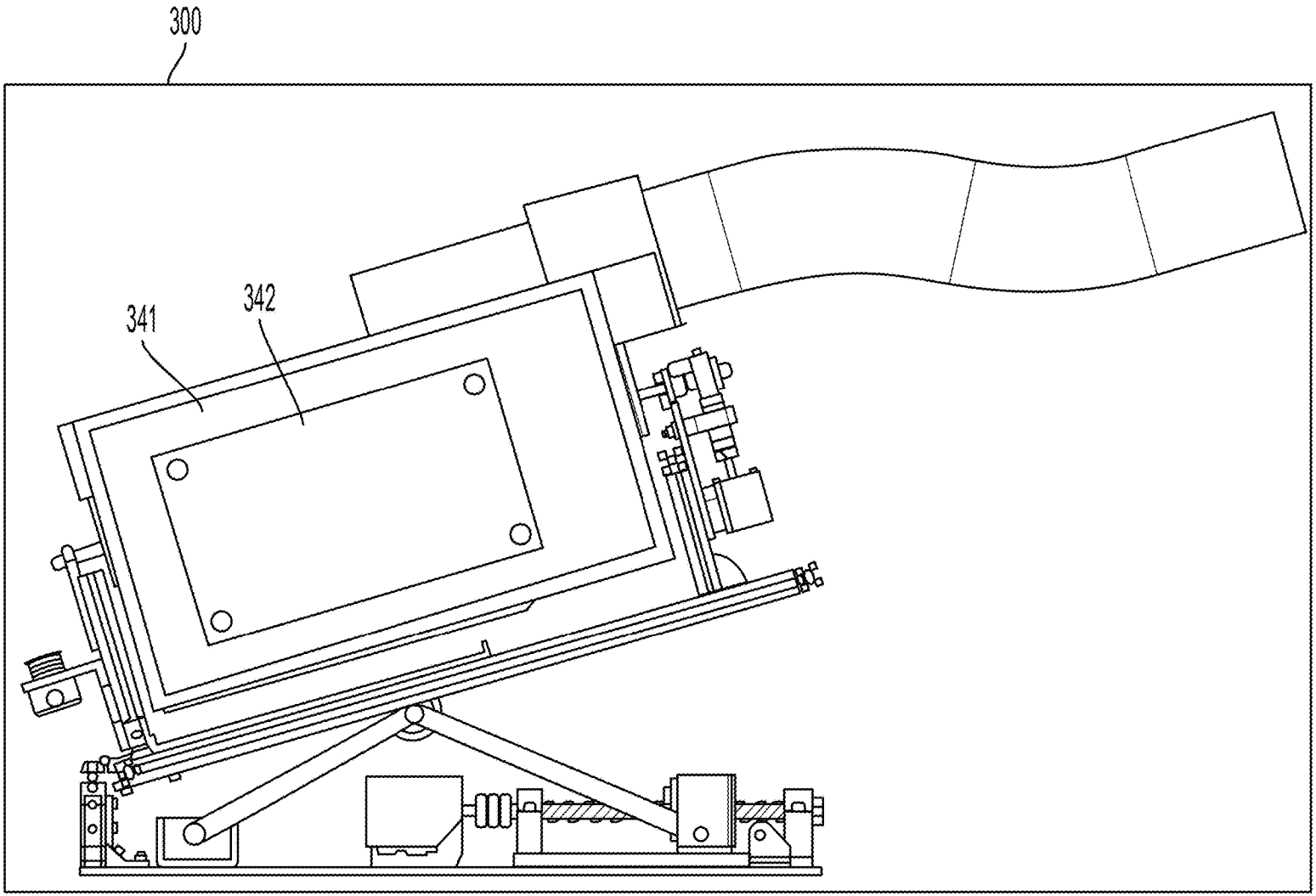

An embodiment where casing is manufactured as an integrated unit is shown in FIG. 4C. In this embodiment, the casing 341 may be manufactured such that it has a removable side panel 342 that allows easy access to the interior of the casing 341 for maintenance and repair of the components housed within the casing 341.

In some embodiments, components within the casing may be modular and thus replaceable. To illustrate, the same ball launcher may be used for different kinds of balls (e.g., baseballs, pickleballs, footballs, etc.), and only certain components may be swapped out depending on the type of ball being launched, the desired launch mechanism, etc.

Figure 4D:
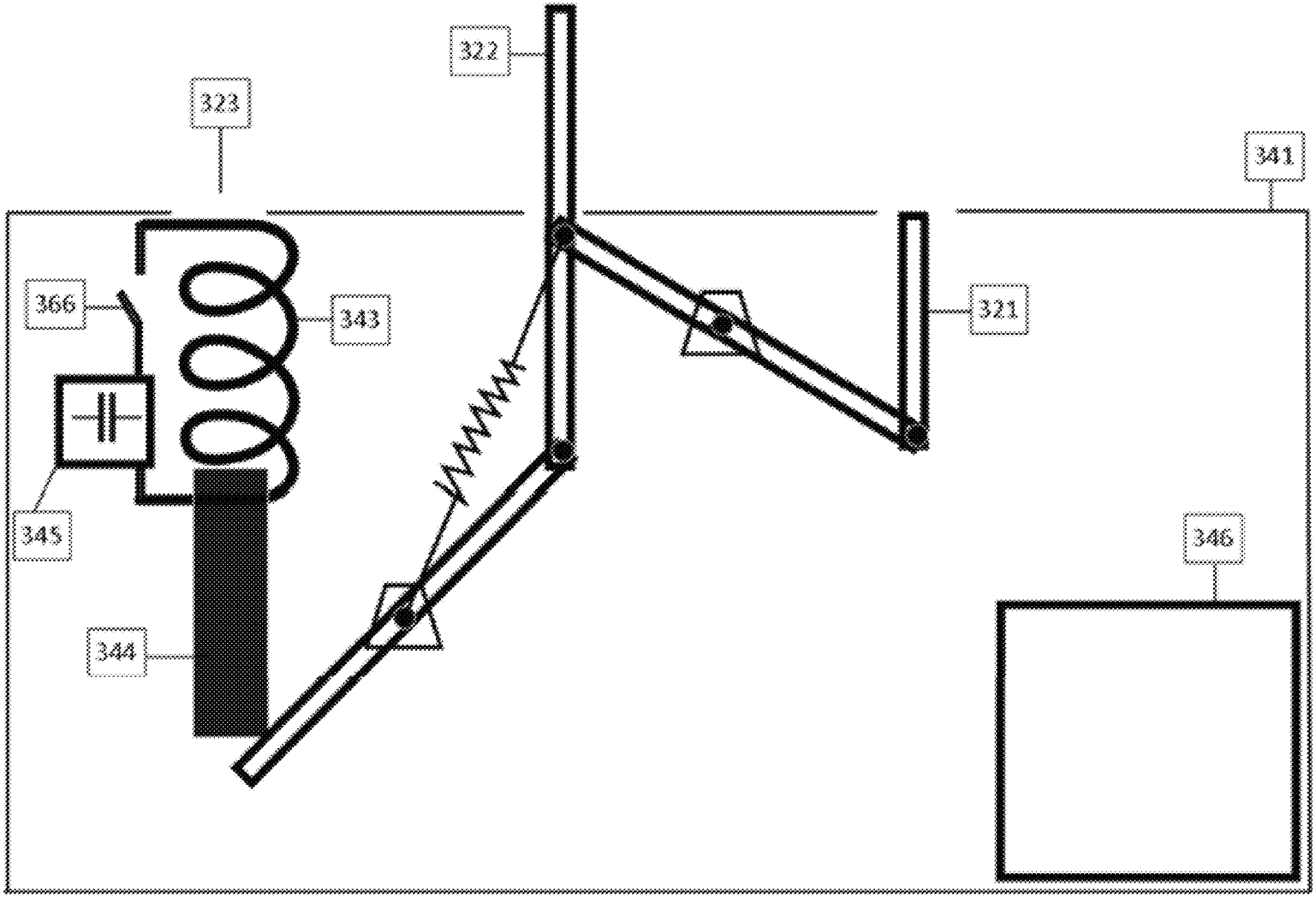

FIG. 4D illustrates components that may be housed within casing 341. For example, the casing 341 may house a solenoid 343, a capacitor bank 345, a storage gate 321, a launching gate 322, and a controller 346. In one example, an aperture in the upper surface of casing 341 defines the launching position 323. Thus, a portion of the launching box 320 that is "upstream" from the launching position 323 can be considered a ball storage area from which balls are delivered to the launching position 323 one-at-a-time.

Depending on implementation, hoppers, tubing, and/or ball collection tracks may also be considered ball storage areas. In some examples, the solenoid 343 includes a ferromagnetic piston (alternatively referred to herein as a plunger) 344 and is disposed below launching position 323.

Figure 4E:
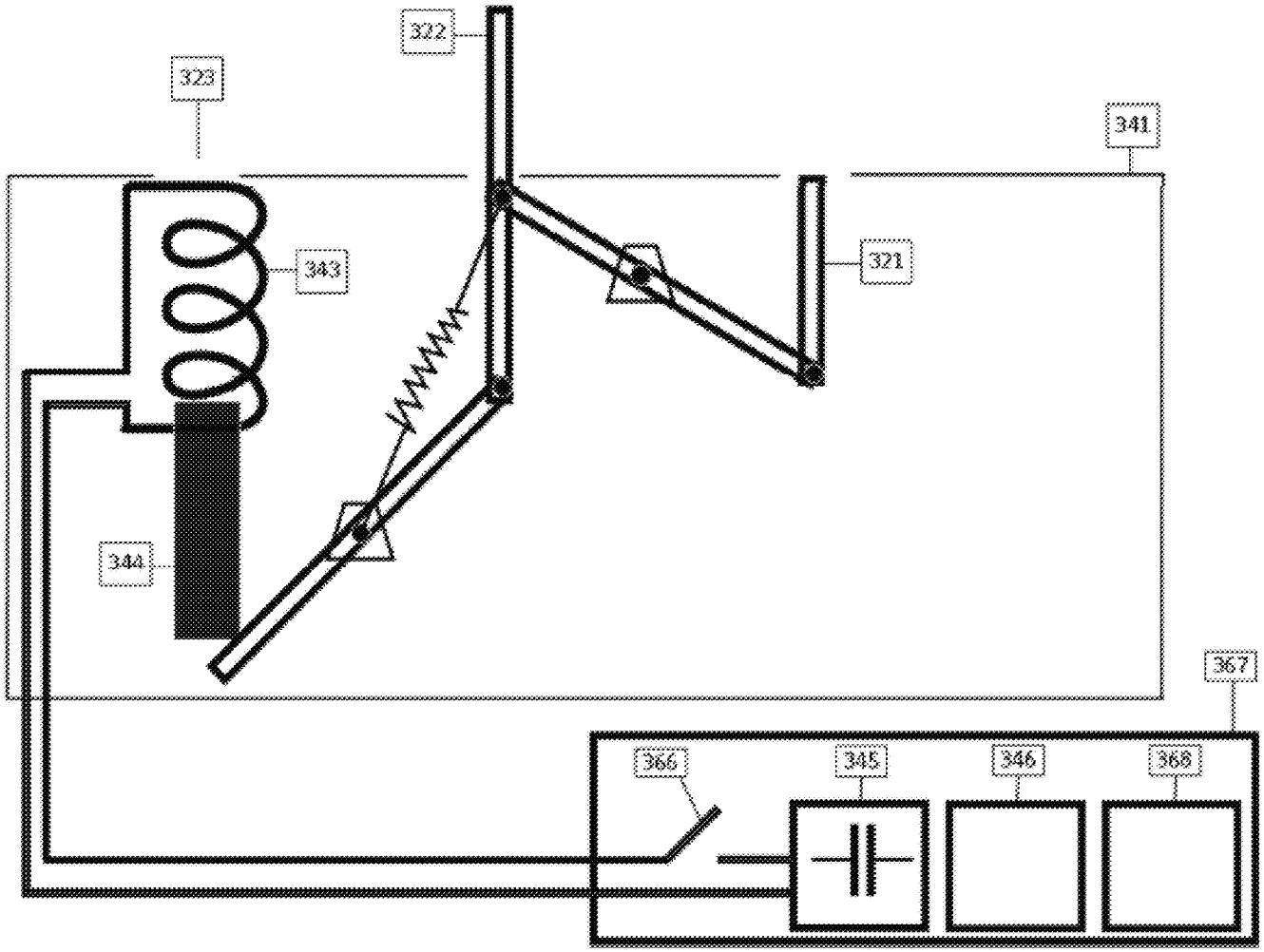

It should be understood that not all components shown in FIG. 4D may be housed in the casing 341. For example, as illustrated in FIG. 4E, components other than the solenoid 343, the piston 344, and the gates 321-322 may be included in a control cabinet 367 external to the casing 341. In one example, the external control cabinet 367 houses the capacitor bank 345 and the controller 346 as well as the electronics, power supplies, wiring, motor controllers, etc., collectively indicated at 368.

As shown in FIGS. 4D and 4E, the solenoid 343 can be selectively connected to the capacitor bank 345 using switch 366 (which may, for example, be a field effect transistor (FET) that in some embodiments is external to the casing 341). In other examples, the solenoid 343 may be connected to the capacitor bank 345 in a different manner.

The controller 346 is configured to control the ball pitching device 300. Together, the storage gate 321 and the launching gate 322 form a gating system having a see-saw configuration, enabling one ball to feed forward to the launching position 323 at a time. In this manner, the gating system regulates the movement of balls from the front end 201 of the ball collection track 210 shown in FIG. 3A to launching position 323.

In one example, the components housed within the casing 341 are the same components housed within the base box 340 in the embodiment shown in FIGS. 4A-4B. In the embodiment shown in FIG. 4A-4B, the gating system extends from the base box 340 and passes through the cradle 330. Additional information regarding embodiments of ball launch mechanisms and control is described with reference to FIGS. 9-10.

Figure 4F:
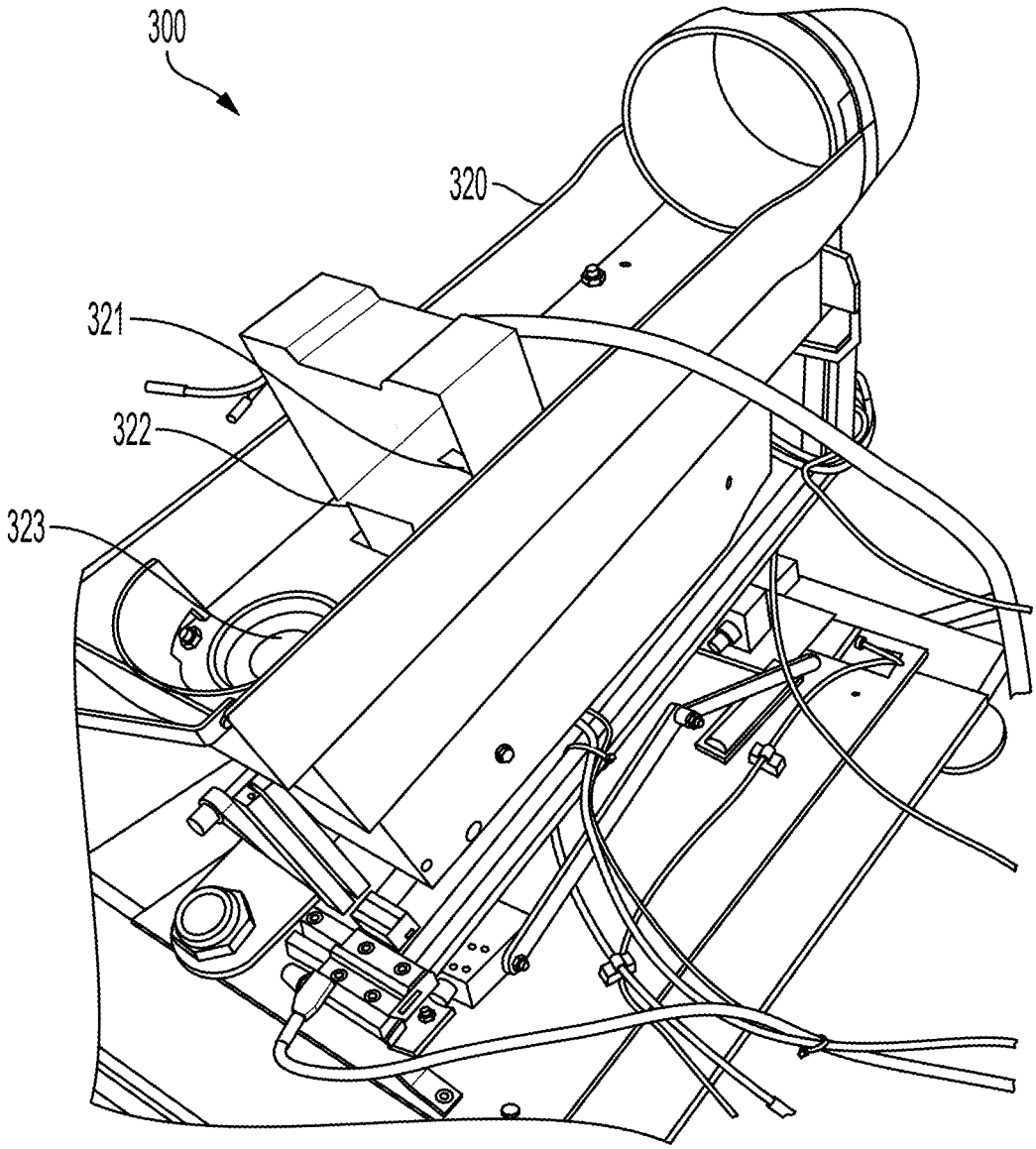

FIG. 4F shows the storage gate 321 and the launching gate 322 of the launching box 320, as well as the launching position 323 from which a ball is launched. In both embodiments, the gating system is designed such that when one gate is lowered the other gate is raised in a seesaw manner. In some examples, the storage gate 321 and the launching gate 322 are separated by a distance less than two times a diameter of a ball and greater than a diameter of the same ball.

Figure 4G:
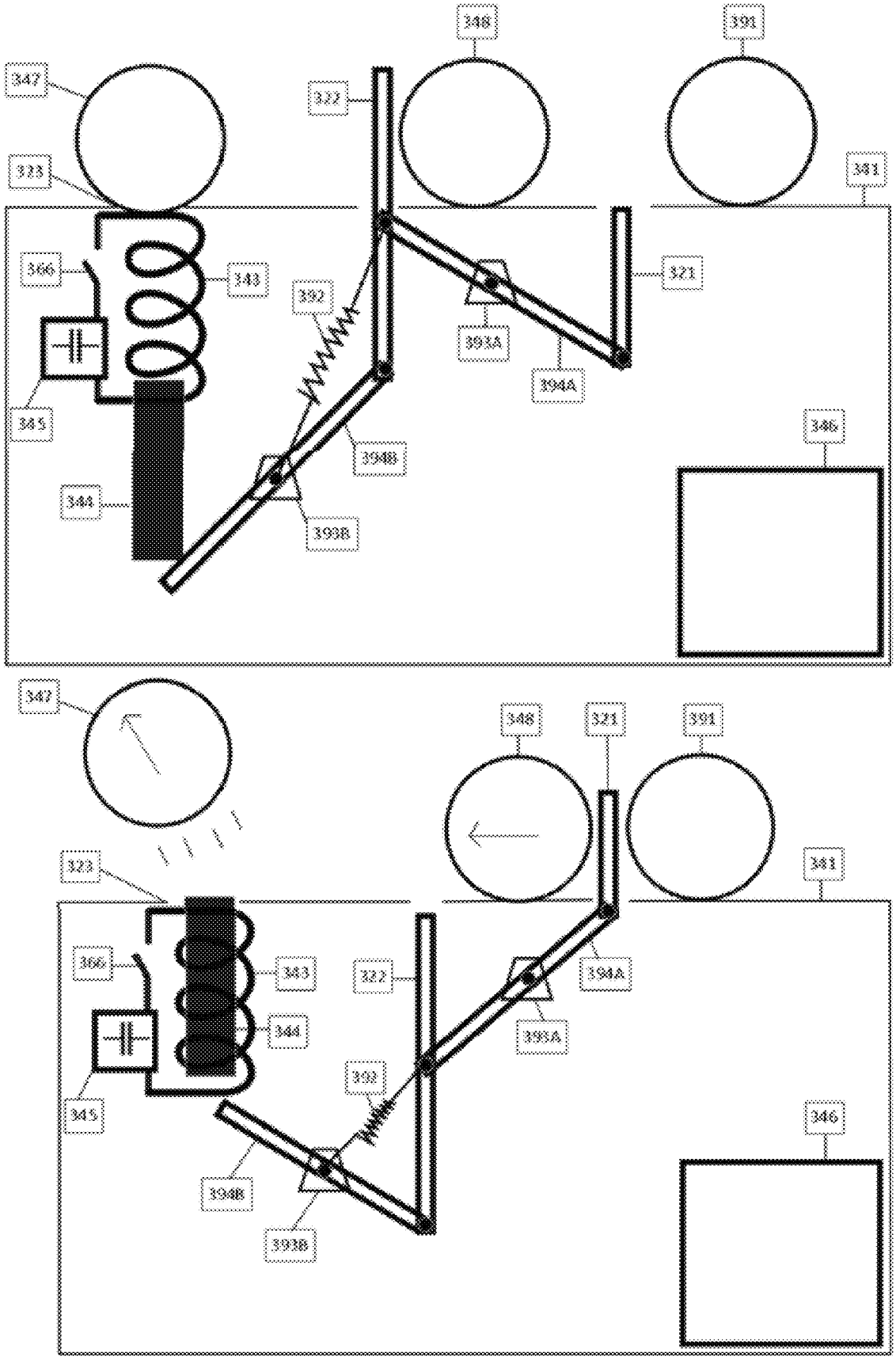

The operation of the gating system is further illustrated in FIG. 4G (the ball rolling path is shown as substantially horizontal in FIG. 4G, but it is to be understood that the path may actually slope downwards so that balls can roll to launching position 323). Referring to the top diagram of FIG. 4G, at rest, a first ball, ball 347, is sitting in the launching position 323. The weight of the piston 344 drives the launching gate 322 up to block a second ball, ball 348, from advancing forward to the launching position 323.

As the launching gate 322 drives up, it extends the tension spring 392 and lowers the storage gate 321. In one example, these relative motions are accomplished via a series of pivots, such as gate pivot 393A and piston pivot 393B, and linkages, such as gate linkage 394A and piston linkage 394B.

Referring to the bottom diagram of FIG. 4G, when the solenoid 343 energizes, the piston 344 moves upwards to impact the ball 347 in the launching position 323. The tension spring 392 returns to its retracted position which drives the launching gate 322 down and the storage gate 321 up. This enables the ball 348 to roll to the launching position 323 so that it is in position for launching.

In some examples, the storage gate 321 prevents a third ball, such as ball 391, from interfering with the ball 348 while it moves to launching position 323. Once the solenoid 343 de-energizes, the piston 344 falls down onto the piston linkage 394B, which drives the launching gate 322 up and the storage gate 321 down. This may enable the ball 391 to roll up to the launching gate 322 and the cycle is ready to repeat itself.

In one example, the apex of a pitch may depend on the force with which a ball is struck. In some examples, the mass of the piston 344 is fixed, and the acceleration can be varied to achieve the level of force, and, consequently, the apex of the pitch. The amount of current applied to the solenoid 343 may be adjusted to affect the acceleration of the piston 344.

In certain examples, a large amount of current may be utilized to accelerate the piston(s) 344 at a desirable rate. For this reason, the solenoid 343 may be connected to a high-voltage, high-capacity capacitor (for example, capacitor bank 345).

In some examples, the capacitor (i.e., capacitor bank 345) can be discharged in a way that is highly controllable. For example, by controlling a charging voltage applied to the capacitor, and thus a total charge stored in the capacitor prior to discharge, the initial launching velocity of the pitch may be controlled.

As such, the use of a capacitor allows a variable force to be applied to the ball. In another example, the voltage applied to the capacitor may be kept fixed, and the variable force may be controlled based on the duration of time current is provided through the coil (e.g., changing the coil ON time) and/or a pulse width modulated (PWM) signal applied to a switch (e.g., a switching FET).

And further, current may be provided to the coil on and off at a very high frequency at varying duty cycles, which may have the same effect as adjusting voltage without modulating a voltage source.

In a particular embodiment, the ball pitching device 300 may be configured with a solenoid piston array, and each piston of the array may be configured to fire at various time differentials, e.g., microseconds or less of time. By introducing slight variations in piston firing timings, spin may be applied to a ball upon launch, enabling approximation of different types of pitches (e.g., cutters, curveballs, etc.).

In yet another embodiment, spin dampers may also be present in the launch path of the ball to negate ball spin so that a knuckleball can be approximated. For example, two spin dampers may "sandwich" the ball on launch to negate spin and approximate a knuckleball.

The gating system shown in FIGS. 4D-4G may be used in conjunction with the ball collection track 210 shown in FIG. 3A to store balls prior to launching. As described above, when a ball is fed into the front end 201 of the ball collection and transport system 200 shown in FIG. 3A, the ball rolls down on the ball collection track 210. The ball collection track 210 is designed to be a single-file track, enabling one ball to be fed to ball pitching device 300 at a time.

In one example, a first ball, from a series of balls, that is fed into the ball collection and transport system 200 rolls down on the ball collection track 210 until it is stopped by storage gate 321 shown in FIGS. 4D-4G. A second ball that is fed into the ball collection and transport system 200 rolls down on the ball collection track 210 until it is stopped by the first ball at the storage gate 321, and so on.

Together, the single-file track design of the ball collection track 210 and the storage gate 321 may enable the formation of a queue of balls that extends from the front end 201 of the ball collection track 210 to the storage gate 321 in the ball pitching device 300. Such a system effectively creates a storage mechanism for storing and monitoring balls prior to launching.

As discussed earlier with reference to FIG. 3A, the switchbacks 240 can be attached to the ball collection track 210 in various locations to create any number of turns at various angles. The switchbacks 240 enable the formation of a longer ball collection track within a smaller volume of space in comparison with a straight ball collection track design within the same amount of space. The switchbacks 240 effectively enable more balls to be stored on ball collection track 210 than if ball collection track 210 were straight.

Figure 4H:
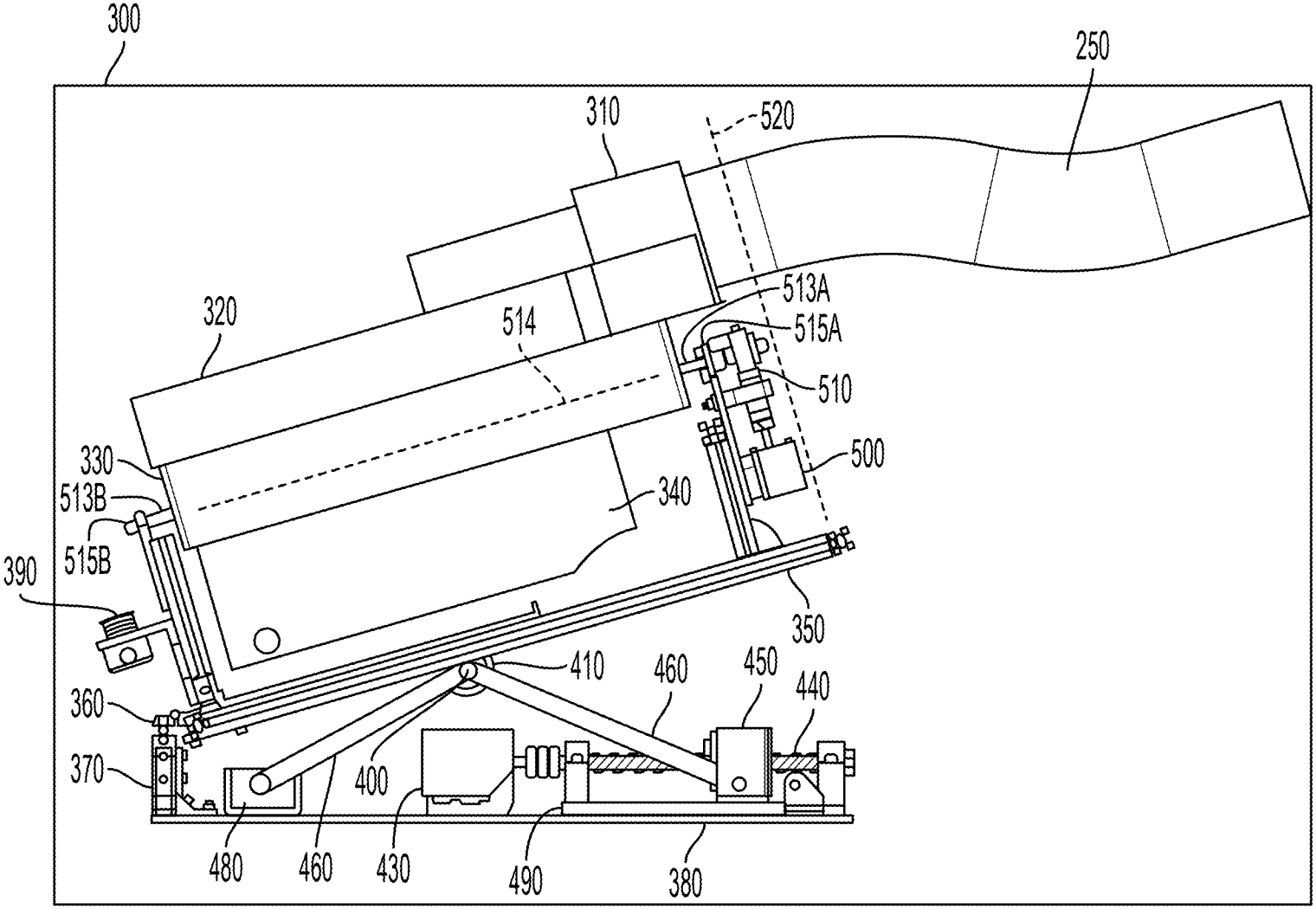

Referring to FIG. 4H, a side view of the ball pitching device 300 is shown. In one example, the ball pitching device 300 is designed to have at least two degrees of freedom. In some examples, the ball pitching device 300 can tilt and roll. These two types of motions can affect the launch direction (or launch vector) of a pitch.

The components of the ball pitching device 300 responsible for producing a tilting motion include a motor 430, which may be a stepper motor (or DC servo motor, or another motor with position control), lead screw 440, carriage 450, mechanical retainer 480, slide guide 490, linkages 460, shaft 400, and v-roller 410.

As shown in FIG. 4H, the stepper motor 430 is connected to the lead screw 440; the carriage 450 is a screw-driven carriage, the movement of which is facilitated by the slide guide 490; both of the carriage 450 and the mechanical retainer 480 are connected to the shaft 400 via the linkages 460; and the v-roller 410 rides on the shaft 400. The stepper motor/lead screw design may enable adjustable tilt while keeping the motor in place, which is advantageous for wire/cable management.

It should be noted that the carriage 450 and the mechanical retainer 480 extend across the width of the base plate 380 (i.e. into the page, with reference to FIG. 4H) and that there are two sets of linkages connecting the carriage 450 and the mechanical retainer 480 to each end of the shaft 400. The first set of linkages, linkages 460, are shown in FIG. 4H, while the second set of linkages, not shown, run parallel to the linkages 460 on the other side of the base plate 380.

FIG. 4A provides a different perspective that shows the v-roller 410 riding on the shaft 400. In one example, the v-roller 410 rolls on a v-groove track. As shown in FIG. 4A, the support frame 350 has a bar 420 with a v-groove that effectively acts as the v-groove track on which the v-roller 410 rolls up or down. Other alternatives to the v-roller and the v-groove track system include, but are not limited to, sliding joints and vertical lead screws.

Referring to FIG. 4H again, when the stepper motor 430 operates, the lead screw 440 turns. As the lead screw 440 turns, the carriage 450 moves to either the left or the right side of the slide guide 490 depending on the direction of rotation of the lead screw 440. As the carriage 450 moves on the slide guide 490, the shaft 400 either moves upward or downward depending on the direction in which the carriage 450 moves.

For example, as the carriage 450 drives to the left, toward the stepper motor 430, the shaft 400 moves upward. The carriage 450 pushes the shaft 400 upward or downward using the linkages 460 and the mechanical retainer 480. As the shaft 400 moves upward or downward, the v-roller 410 rolls along the v-bar 420 in the same direction.

The movement of the shaft 400 and the v-roller 410 against the support frame 350 (including v-bar 420) causes the ball pitching device 300 to tilt around the axis 361 (axis 361 is shown in FIG. 4A). In this manner, the linear motion of the carriage 450 is converted into the rotary or tilting motion of the ball pitching device 300 using the components described above.

Figure 4I:
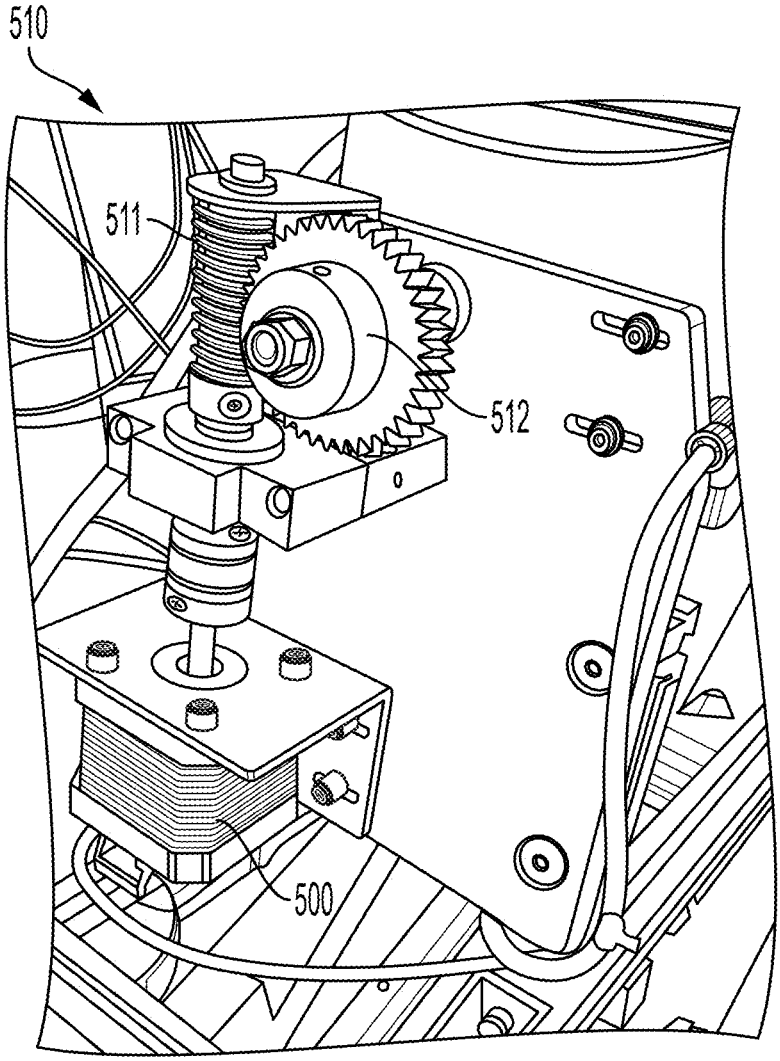
Figure 4J:
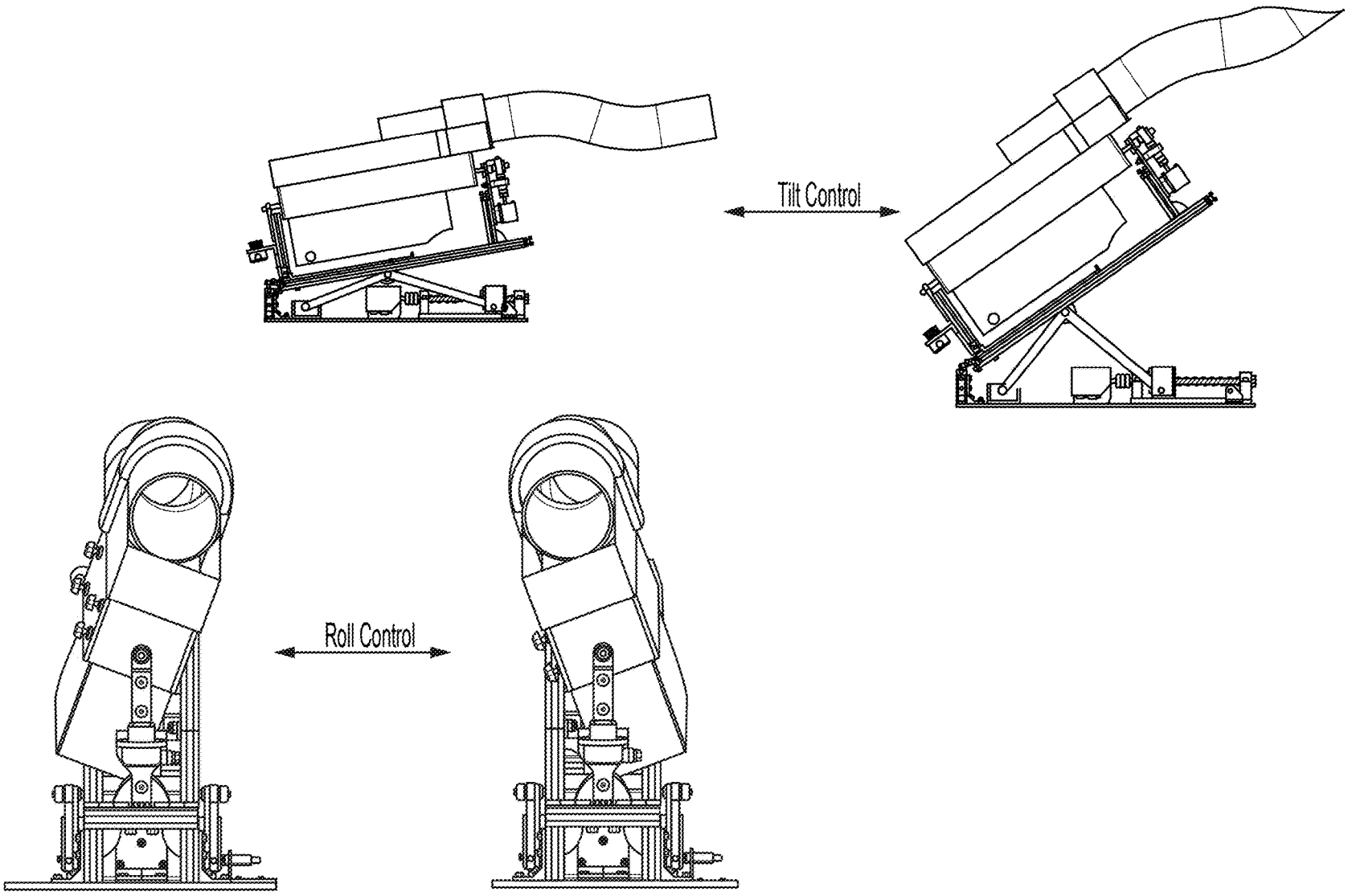

The tilting motion of the ball pitching device 300 can range, in one example, over an approximately 40-degree arc (e.g., from approximately 5 degrees to approximately 45 degrees), as shown in FIG. 4J.

It should be appreciated that, in the embodiment shown in FIG. 4H, serviceability of the ball pitching device 300 can be easily performed. Various components of the ball pitching device 300 can be separated to enable for targeted maintenance.

For example, because there is a slip fit between the collar 310 and the flexible hose 250, the flexible hose 250 can be easily pulled out. Once the flexible hose 250 is pulled out, and because the support frame 350 is not permanently secured to the shaft 400 and the roller 410, the support frame 350 can be lifted and tilted manually from the end that is unhinged, separating the components above the support frame 350 from the components below.

As described above, in addition to tilting, the ball pitching device 300 is capable of rolling. Referring to FIG. 4H, the ball pitching device 300 is designed to roll around the axis 514 using stepper motor 500, worm gear system 510, and shafts 513A and 513B. The stepper motor 500 and the worm gear system 510 are positioned at the rear end 520 of the ball pitching device 300.

It should be appreciated that the shafts 513A and 513B do not pass through the cradle 330. Rather, the shafts 513A and 513B are attached to the outside of the cradle 330, one shaft at each of the two ends of the cradle 330 as shown in FIG. 4H. The shafts 513A and 513B are aligned along the same axis, axis 514. The shafts 513A and 513B are supported by mechanical bushings in the mounts 515A and 515B, respectively, and can be supported by other types of bearings as well.

Referring to FIG. 4I, the components of the worm gear system 510 are shown. The worm gear system 510 is comprised of the worm 511 and the worm gear 512. The worm gear 512 shares the same axis, axis 514 shown in FIG. 4H, as the shafts 513A and 513B. When the stepper motor 500 operates, it turns the worm 511. The worm 511 then turns the worm gear 512, which turns the shaft 513A.

The worm gear 512 changes the rotational movement of the worm 511 (e.g., at a 90-degree angle) by virtue of how the worm 511 and the worm gear 512 are placed relative to each other. The rotation of the shaft 513A causes the cradle 330 to roll around the axis 514 using the shaft 513B. The launching box 320 and the base box 340 roll in the same manner as the cradle 330 due to their attachment to the cradle 330 on each side.

The rolling motion of the ball pitching device 300 can range, in one example, over an approximately 60-degree arc (e.g., from approximately −30 degrees to approximately +30 degrees with 0 degrees being vertical/centered), as shown in FIG. 4J. The stepper motor/worm gear/worm design may enable adjustable roll while keeping the motor in place, which is advantageous for wire/cable management.

Figure 4K:
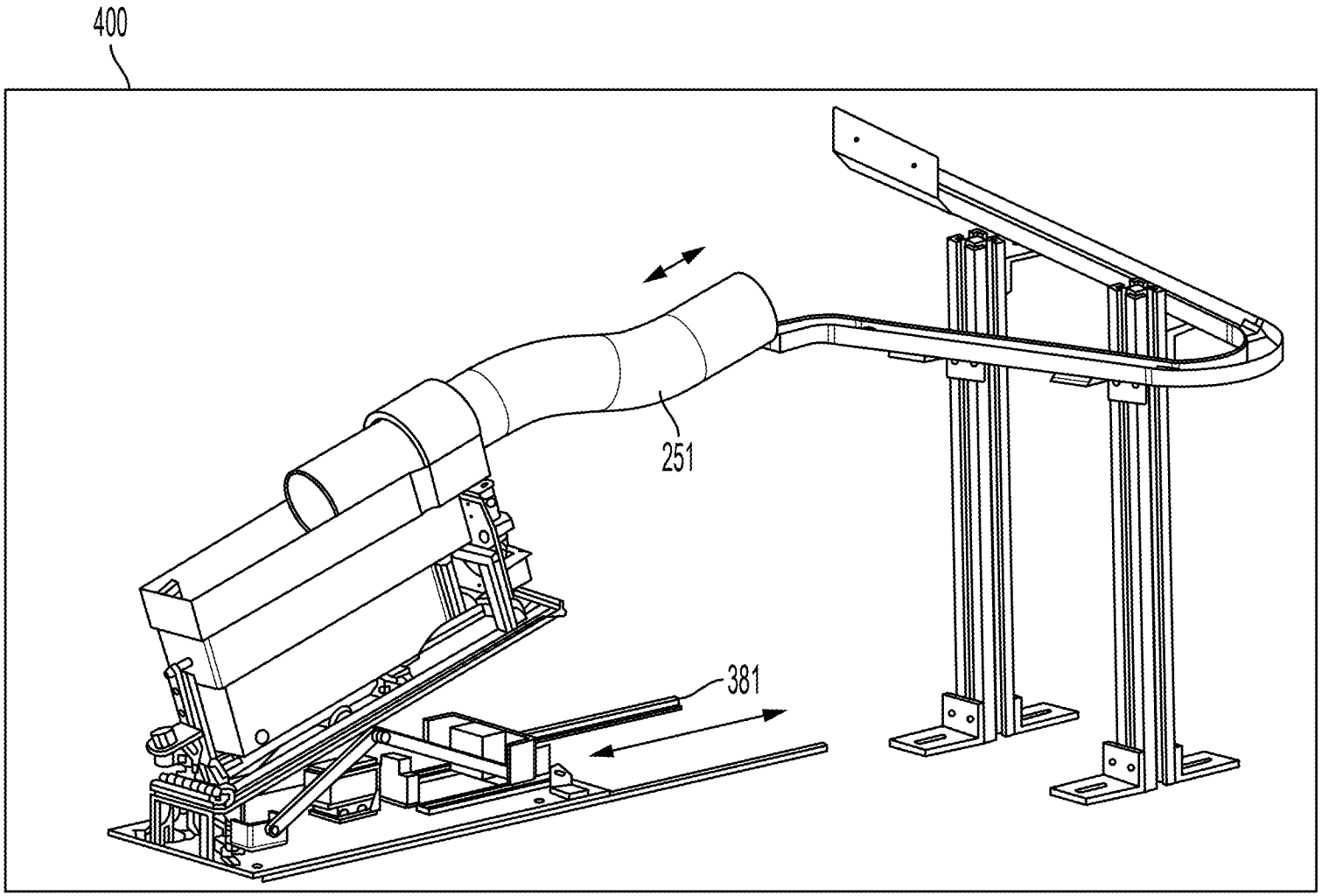

As described above, the hose 250 may be flexible. This may include an accordion-style extendibility/contractibility and/or an ability to be pushed inwards or pulled outwards through the slip joint. To illustrate, as shown in FIG. 4K, an embodiment of the ball pitching system is designated 400 and includes a hose 251 that can extend/contract and/or be pushed inwards or pulled outwards through the slip joint as the ball launcher moves on rails 381.

In an illustrative example, the ball launcher can move in a range from a location that is approximately one foot laterally in front of home plate 4 to a location that is approximately thirty feet laterally in front of home plate 4. More specifically, the ball launcher can move in a range from a location that is approximately five feet laterally in front of home plate 4 to twenty feet laterally in front of home plate 4.

In some examples of such embodiments, the ball launcher may remain vertically below home plate and launch balls through the hole 33 in the floor. The hole 33 may be non-circular (e.g., ovular or teardrop shaped) or it may itself be movable (e.g., to various locations in the access door 21) to match the movement of the ball launcher along the rails 381.

When dynamic strike zone calculation is enabled, sensor(s) (e.g., inertial sensor(s), motion sensor(s), computer vision sensor(s), etc.) may be configured to determine how far in front of home plate 4 the pitching machine is, and this distance may be used to determine tilt, roll, and/or launch velocity adjustment to place a ball in a particular part within (or outside) the strike zone.

Figure 4L:
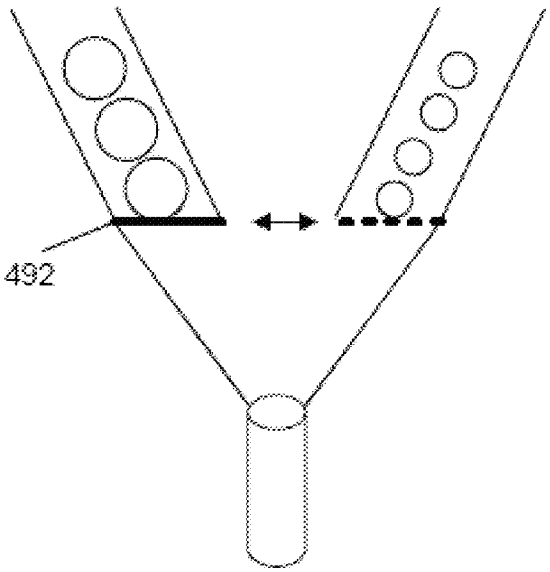
Figure 4L:
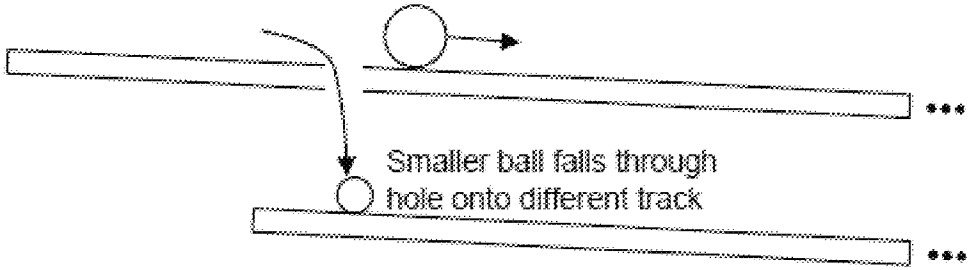

In some embodiments, the ball collection system may have built-in sorting for balls of different types. For example, the same hopper may feed multiple ball collection tracks. The track for larger balls (e.g., softballs) may have a hole small enough for the larger balls to roll over but small enough for smaller balls (e.g., baseballs) to fall through onto a different ball collection track, as shown in FIG. 4L.

At the flexible tubing 250, a mechanical switch 492 may be actuated to select which size ball should be fed to the ball launching mechanism. The mechanical switch 492 may be controlled electronically, for example via user input at a touchscreen so that different users can select whether they want to hit baseballs or softballs.

FIGS. 5A-5E illustrate a ball pitching device 600 in accordance with aspects described herein. In one example, the ball pitching device 600 can be utilized as the second subsystem (i.e., ball pithing device) included in the ball pitching system 100 of FIG. 2A.

As shown in FIGS. 5A-5E, the ball pitching device 600 includes a ball holder 602, an impulse mechanism 604, a first adjustment stage 606, a second adjustment stage 608, a carousel ball feed 610, a gear assembly 612, an angled mount 614, and a loading chute 616. In some examples, the ball pitching machine 600 includes a ball parameter sensor 618.

Figure 5A:
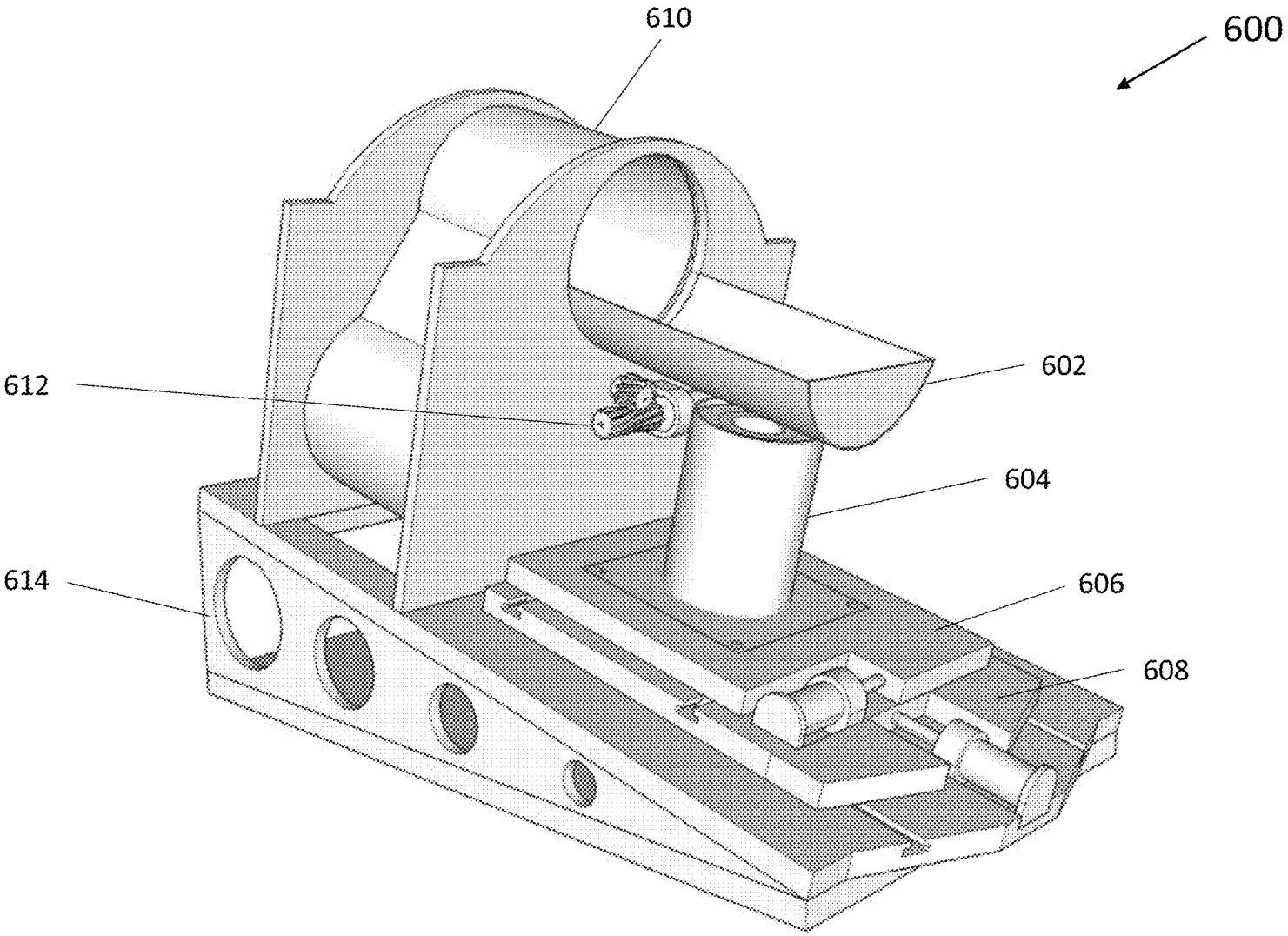
FIGS. 5A, 5B, 5C, 5D, and 5E are diagrams illustrating a ball pitching device in accordance with embodiments described herein.
Figure 5B:
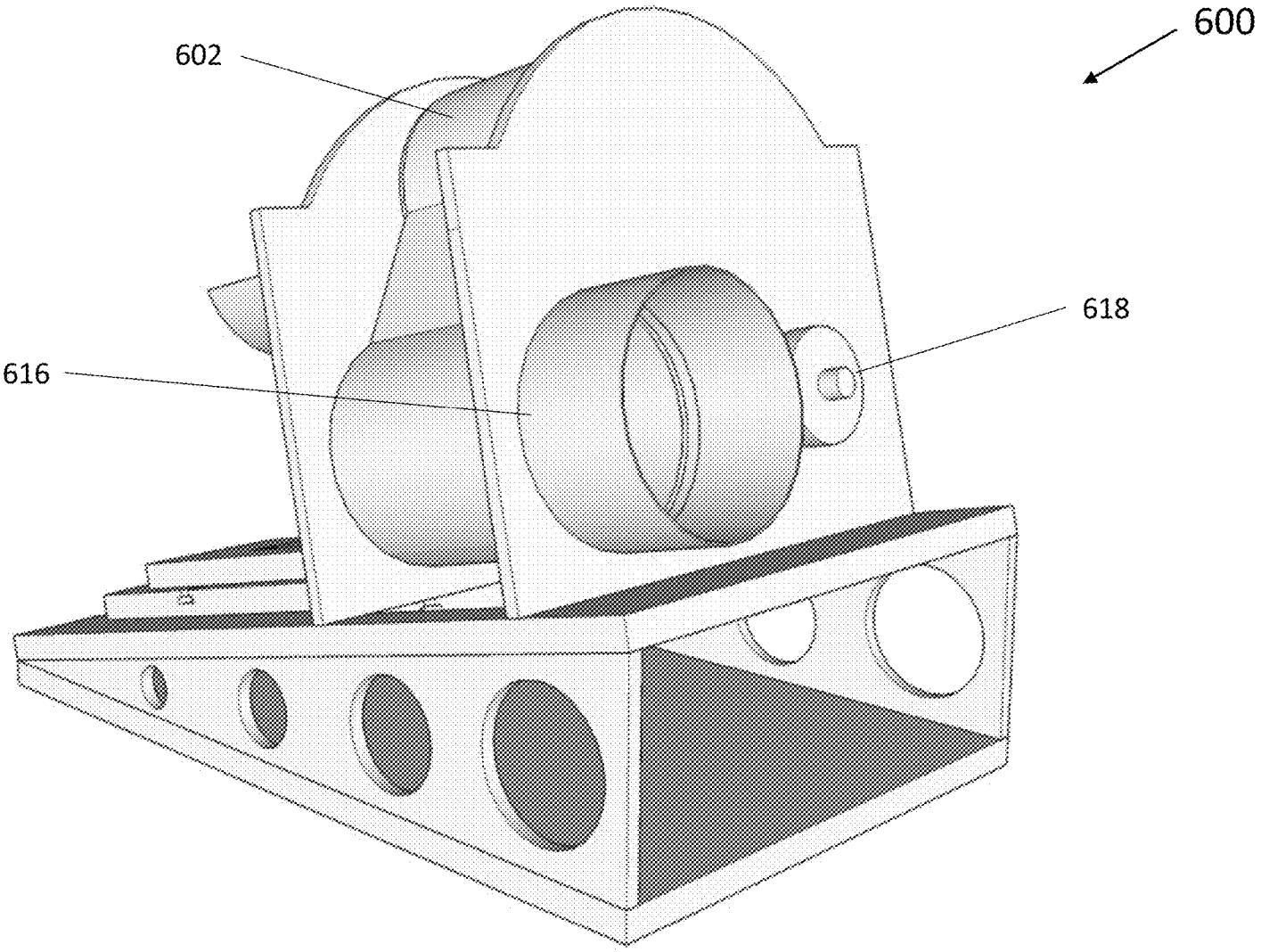
Figure 5C:
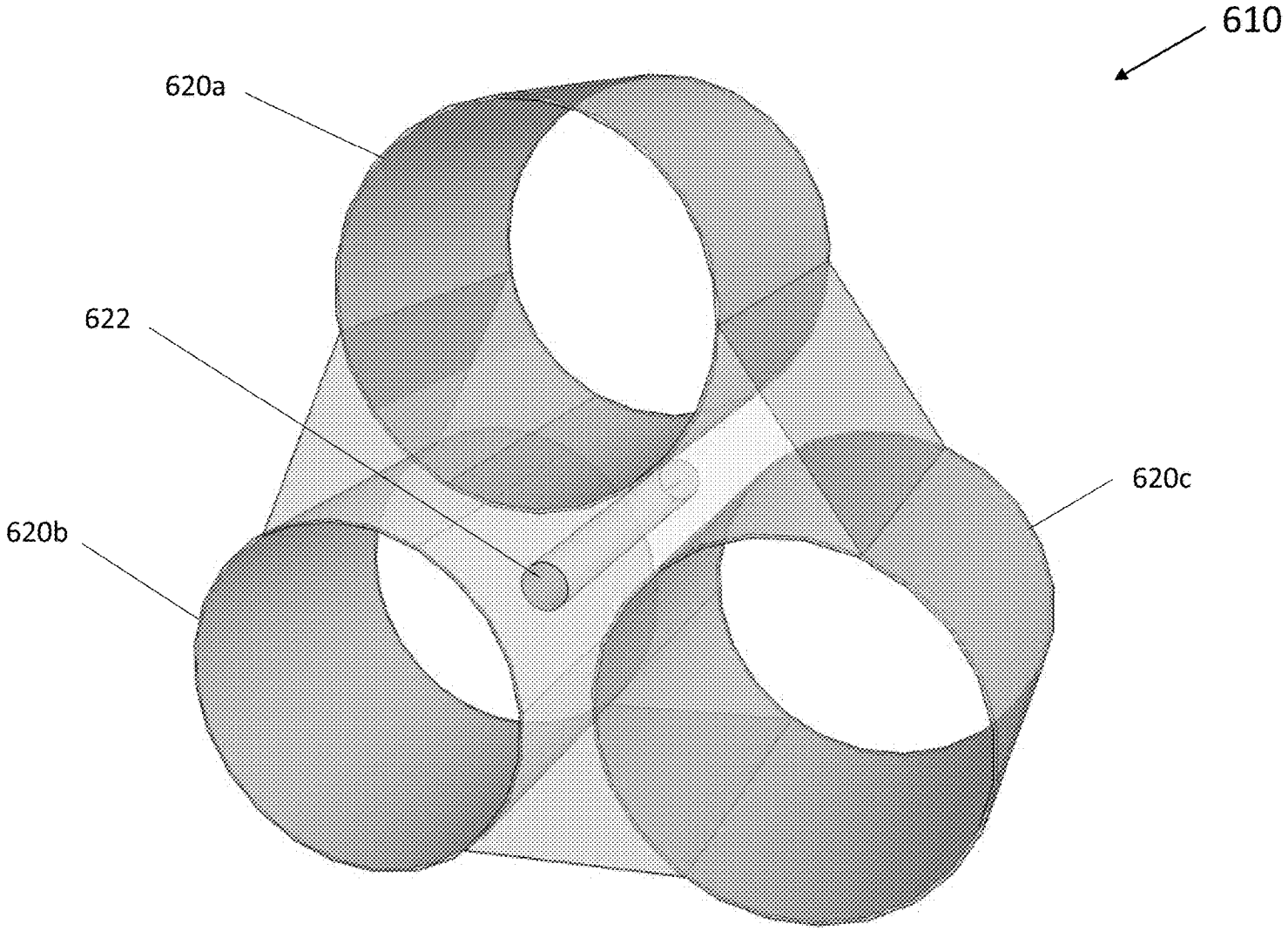
Figure 5D:
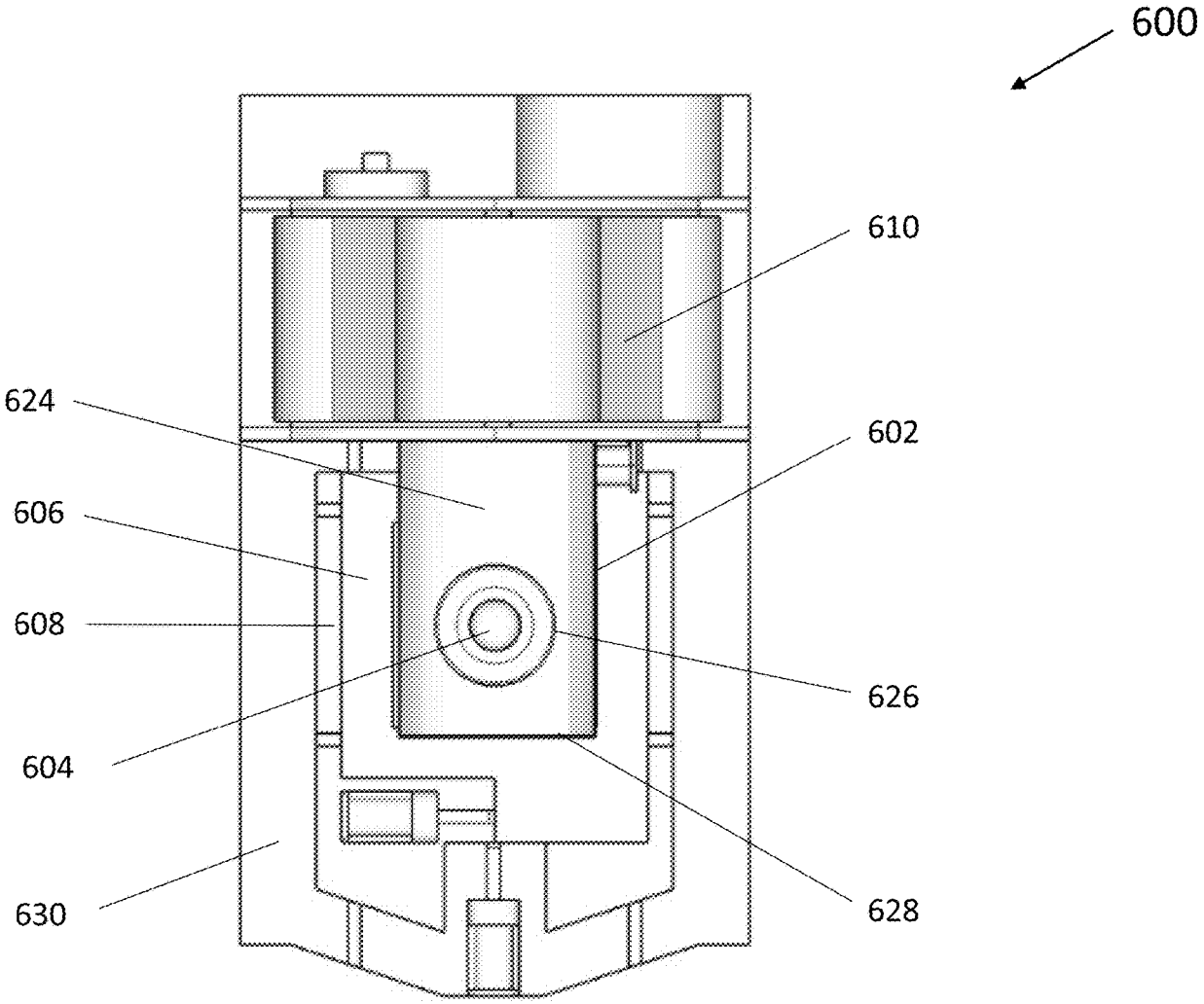

In one example, the loading chute 616 is connected to a ball source (e.g., the ball collection and transport system of the ball pitching system 100) to receive a ball or series of balls. The carousel ball feed 610 may be operated to receive the balls from the loading chute 616. As shown in FIG. 5D, the carousel ball feed 610 may include a plurality of ball slots 620*a*, 620*b*, 620*c* that can be rotated around a bearing 622.

In other examples, the carousel ball feed 610 may include a different number of ball slots. In one example, the gear assembly 612 is configured to rotate the carousel ball feed 610 such that each ball received at the loading chute 616 is provided to one of the ball slots 620*a*, 620*b*, 620*c*. The angled mount 614 may provide a slope or tilt that allows the balls received at the loading chute 616 to be passively transferred (i.e., via gravity) to the slots 620*a*, 620*b*, 620*c*.

In some examples, the carousel ball feed 610 includes one or more sensors configured to determine which slots are empty (or full), and the gear assembly 612 can be operated to rotate the carousel ball feed 610 accordingly.

In one example, the dimensions of each ball slot 620*a*, 620*b*, 620*c* are slightly larger than the ball diameter such that balls can be transferred from the loading chute 616 with minimal friction. In certain examples, the ball pitching device 600 is configured to support multiple types of balls (e.g., baseballs and softballs) and the dimensions of the ball slots may correspond to the largest ball diameter supported (e.g., softballs). In other examples, the carousel ball feed 610 may be removable and different ball feeds can be swapped in/out to support various ball types.

As shown in FIG. 5D, the ball holder 602 includes a launching surface 624 configured to receive and hold a ball in a launching position 626. The launching position 626 may correspond to an aperture (i.e., circular cutout) defined in the launching surface 624 of the ball holder 602.

The carousel ball feed 610 is rotated to deliver a ball from one of the ball slots 620*a*, 620*b*, 620*c* to the launching surface 624. Based on the slope provided by the angled mount 614, the balls may be passively transferred (i.e., via gravity) from the ball slot to the launching surface 624 of the ball holder 602. As shown, the ball holder 602 includes a stop ridge 628 allowing the ball to roll down the launching surface 624 and settle in the launching position 626.

In some examples, the rotation of the carousel ball feed 610 is controlled to set the pitch frequency. For example, the carousel ball feed 610 may be rotated to provide balls to the launching surface 624 at a desired rate. In other examples, the launching surface 624 can include a gating system similar to the gating system of the ball pitching device 300 shown in FIGS. 4D-4E to control pitch frequency.

The impulse mechanism 604 is disposed beneath the launching position 626 and configured to impact the ball being held in the launching position 626. Similar to the ball pitching device 300 of FIGS. 4A-4L, the impulse mechanism 604 may include an electromagnetic solenoid (i.e., coil) configured to accelerate a moveable piston 632.

In one example, the electromagnetic solenoid is selectively connected to a power source, such as a capacitor bank. As described above, a current may be applied to the electromagnetic solenoid from the power source to accelerate the piston 632 and impact the ball being held in the launching position 626.

The amount of current applied to the electromagnetic solenoid can be adjusted to control the amount of force (or power) delivered by the impulse mechanism 604 when impacting the ball. In some examples, the amount of power (or force) delivered by the impulse mechanism 604 can be adjusted to control pitch trajectory.

In one example, the ball pitching device 600 includes a thermal sensor configured to measure the temperature of the electromagnetic solenoid or a temperature associated with the electromagnetic solenoid (e.g., the impulse mechanism 604). In some examples, the temperature measured by the thermal sensor may be used to adjust the amount of current applied to the electromagnetic solenoid.

For example, if the ball pitching device 600 has been operating for an extended period of time, the temperature of the electromagnetic solenoid may increase, and a larger amount of current may be needed to generate an expected amount of force.

In another example, the impulse mechanism 604 includes a pneumatic cylinder. The pneumatic cylinder may be configured to accelerate the moveable piston 632 using compressed air or other gasses to impact the ball being held in the launching position 626. The amount of pressure in the pneumatic cylinder can be adjusted to control the amount of power (or force) delivered by the impulse mechanism 604 when impacting the ball.

Likewise, the amount of pressure in the pneumatic cylinder can be adjusted to control pitch trajectory. In some examples, the ball pitching device 600 includes a reservoir of compressed air (or gas) connected to the pneumatic cylinder of the impulse mechanism 604.

In some examples, the moveable piston 632 can be adjusted to maintain an optimal point of impact between the impulse mechanism 604 and the ball being held in the launching position 626. For example, the length of the moveable piston 632 may be adjusted based on the type of ball being launched (e.g., baseball or softball) to maintain the optimal point of impact and provide consistent performance for different types of balls. In one example, the optimal point of impact refers to the point of impact at which a maximum amount of energy is transferred from the moveable piston 632 to the ball being launched.

In some examples, the amount of force delivered by the impulse mechanism 604 may correspond to a physical property of the ball being held in the launching position 626. For example, the quality of balls in circulation may degrade over time and the amount of force delivered by the impulse mechanism 604 may be adjusted/calibrated for each ball to maintain consistent performance regardless of potential variations in the ball's coefficient of restitution (e.g., elasticity or resiliency).

In addition, the amount of force delivered by the impulse mechanism 604 may correspond to the type of ball being launched (e.g., baseball, cricket ball, or kickball). As shown in FIG. 5B, the ball parameter sensor 618 is positioned in proximity to the loading chute 616 and configured to detect/measure various parameters of the balls received at the loading chute 616. In one example, the ball parameter sensor 618 is configured to measure the density of each ball received at the loading chute 616.

Each time a ball is transferred from the carousel ball feed 610 to the launching position 626, the impulse mechanism 604 may be adjusted to provide an amount of force corresponding to the desired pitch trajectory and the measured density of the ball. For example, a larger force may be needed to launch a ball having a higher density than a ball having a lower density for the same pitch trajectory. As such, the force delivered by the impulse mechanism 604 can be adjusted based on individual ball parameters (e.g., density) to achieve consistent execution of pitch trajectories.

In one example, based on the measured/detected ball parameters, the quality of a ball received at the loading chute 616 may be deemed unacceptable and the carousel ball feed 610 may be operated to remove the ball from circulation (or to prevent the ball from being transferred to the launching surface 624). In some examples, the measured/detected ball parameters can be used to improve the accuracy of tracking pitch exit velocities and computing the distance of hit balls.

In addition to adjusting the amount of force delivered by the impulse mechanism 604, the position of the impulse mechanism 604 can be adjusted to control the trajectory of the ball launched from the launching position 626. For example, the position of the impulse mechanism 604 may be adjusted in at least two dimensions relative to the launching position 626 to alter the location at which the impulse mechanism 604 impacts the ball.

As shown in FIGS. 5A-5D, the impulse mechanism 604 is attached directly to the first adjustment stage 606, the first adjustment stage 606 is stacked on top of the second adjustment stage 608, and the second adjustment stage 608 is stacked on top of a base plate 630 attached to the angled mount 614.

In some examples, the base plate 630 includes one or more linear guides and the second adjustment stage 608 may move along the linear guide(s) to adjust the position the first adjustment stage 606 and the impulse mechanism 604 in a first dimension (e.g., y-axis).

Likewise, the second adjustment stage 608 may include one or more linear guides and the first adjustment stage 606 may move along the linear guide(s) to adjust the position of the impulse mechanism 604 in a second dimension (e.g., x-axis).

In some examples, the ball pitching device 600 includes one or more adjustment devices (e.g., electro-mechanical actuators, transducers, servo motors, etc.) configured to control the adjustment of the first and second adjustment stages 606, 608.

In certain examples, the ball pitching device 600 may include a third adjustment stage configured to adjust the position of the impulse mechanism 604 in a third dimension (e.g., z-axis). For example, the third adjustment stage may adjust the slope/tilt of the angled mount 614 to further alter the trajectory of the ball launched from the launching position 626.

In some examples, the ball pitching device 600 may sit flat on the base plate 630 (i.e., no angled mount 614) and the third adjustment stage may be configured to provide desired amounts of tilt corresponding to pitch trajectories, loading/unloading of balls, etc.

Figure 5E:
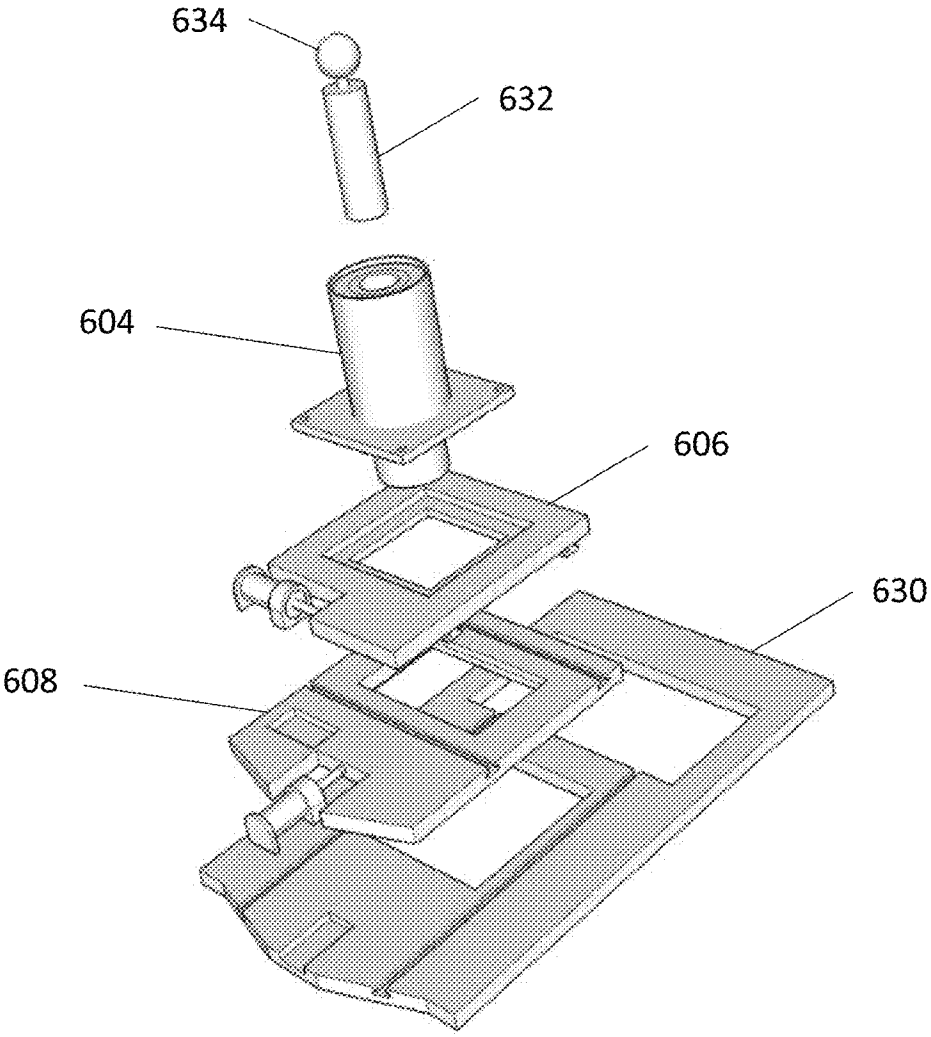

As shown in FIG. 5E, the moveable piston 632 of the impulse mechanism 602 includes an end effector 634. In one example, the end effector 634 is attached to the end of the moveable piston 632 configured to impact the ball being held in the launching position 626. In some examples, the end effector 634 may have a shape or form corresponding to a desired impact response of the impulse mechanism 604.

For example, certain end effector shapes (e.g., spherical) may allow for increased flexibility in positioning the impulse mechanism 604 relative to the launching position 626 (e.g., larger adjustment ranges). In some examples, different end effector shapes may be optimized for different ball types and can be swapped in/out as needed.

Figure 6A:
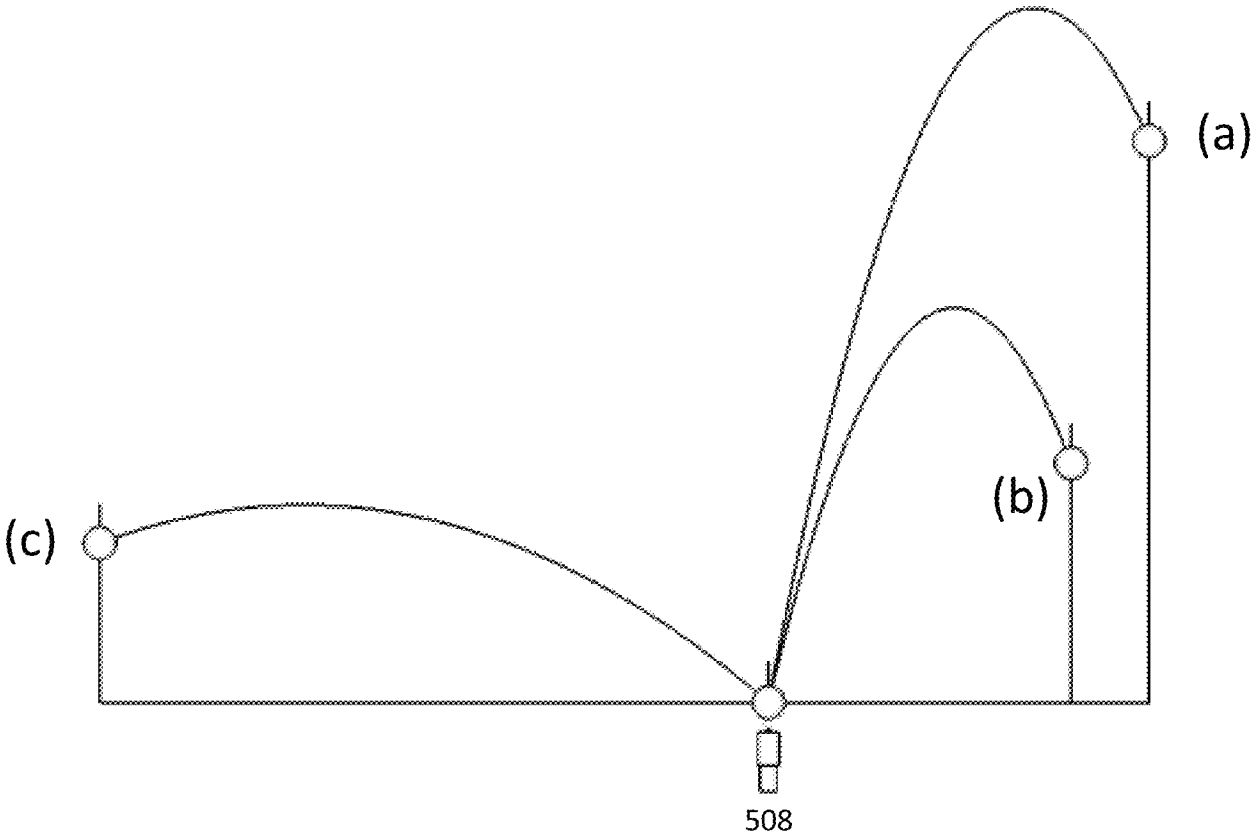
FIGS. 6A and 6B are diagrams illustrating the operation of a ball pitching device in accordance with embodiments described herein.
Figure 6B:
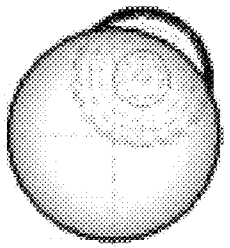
Figure 6B:
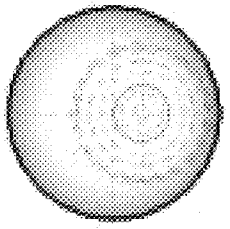
Figure 6B:
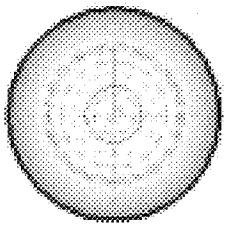

FIGS. 6A-6B illustrate various example pitch trajectories and impulse mechanism positions according to aspects described herein. It should be appreciated that the positions and trajectories shown are merely examples of pitches provided to demonstrate operation of the ball pitching device 600. As shown, the trajectory of example pitch A may correspond to the impulse mechanism 604 being positioned directly under ball in the launching position 626.

Likewise, the trajectory of example pitch B may correspond to the impulse mechanism 604 being positioned slightly off-center relative to the launching position 626. Similarly, the trajectory of example pitch C may correspond to the impulse mechanism 604 being positioned substantially off-center relative to the launching position 626.

As described above, the power (or force) delivered by the impulse mechanism 604 may also be adjusted to provide the trajectories of example pitches A, B, and C.

In some examples, being that the ball pitching device 600 controls pitch trajectory by adjusting the position of the impulse mechanism 604, the ball pitching device 600 may require less space to operate. For example, when incorporated into the player bay layouts of FIGS. 1A-1G, the clearance between the pitch deck 2 and the ball pitching device 600 may be reduced.

In addition, being that the ball pitching device 600 can provide various pitch trajectories without rotating, the ball pitching device 600 may be connected directly to the ball source (e.g., the ball collection and transport system of the ball pitching system 100). As such, flexible tubing (e.g., flexible hose 250) may be optional.

In some examples, the ball pitching device 600 can be positioned in the player bay layouts of FIGS. 1A-1G to minimize the length of ball return tracks and number of switchbacks.

FIGS. 4A-5E thus illustrate the components and mechanisms employed in embodiments to control the trajectory of a pitch and a frequency of pitches. Through a software application on a mobile device or a computer system, users of the ball pitching devices 300, 600 can send commands to the ball pitching devices 300, 600 to pitch balls to specific locations within or near a strike zone.

Figure 7:
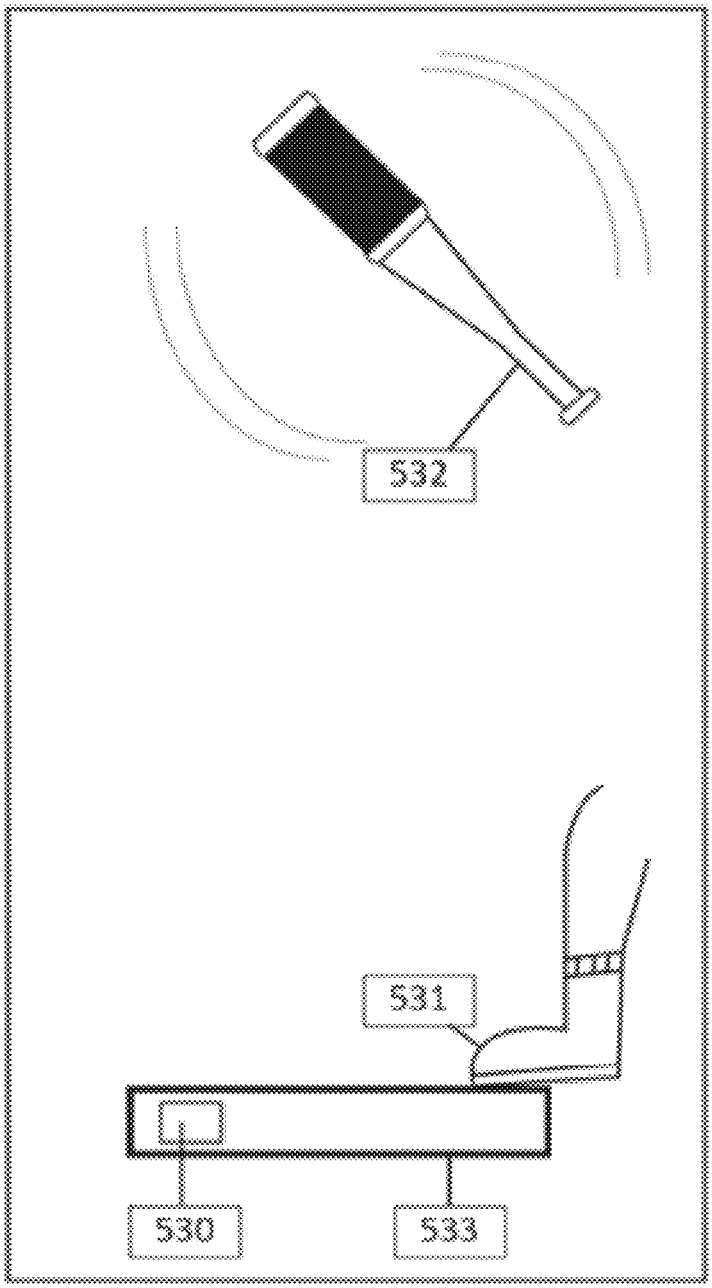
FIG. 7 is a diagram illustrating an example of triggering a pitch in accordance with one embodiment described herein.

To trigger a pitch, the ball pitching devices 300, 600 may be programmed such that when a player steps on or waves a bat over home plate, or an area in the floor designated as home plate, a pitching cycle is initiated. For example, as shown in FIG. 7, a sensor 530 may be installed under a home plate 533.

In one embodiment, the sensor 530 may be an infrared (IR) sensor and the home plate 533 may be IR-transparent. The sensor 530 may alternatively be an ultrasonic sensor, or any other appropriate form of sensor known in the art. In some examples, the sensor 530 is configured to communicate with a controller associated with the ball pitching devices 300, 600 (e.g., the controller 346) such that, upon detecting a foot 531 or a bat 532 over home plate 533, a pitching cycle starts.

Additionally, an impending pitch may be signaled through light emitted from a lighting system installed around home plate and/or around the launching positions 323, 526 of the ball pitching devices 300, 600, wherein the lighting system is also designed such that it can be controlled by controllers of the ball pitching devices 300, 600.

Together with ball collection and transport system 200 shown in FIG. 3A, the ball pitching devices 300, 600 enables balls to be pitched to any location within a strike zone, or intentionally out of a strike zone, and for balls to be collected, stored, and transported after being pitched.

Figure 8:
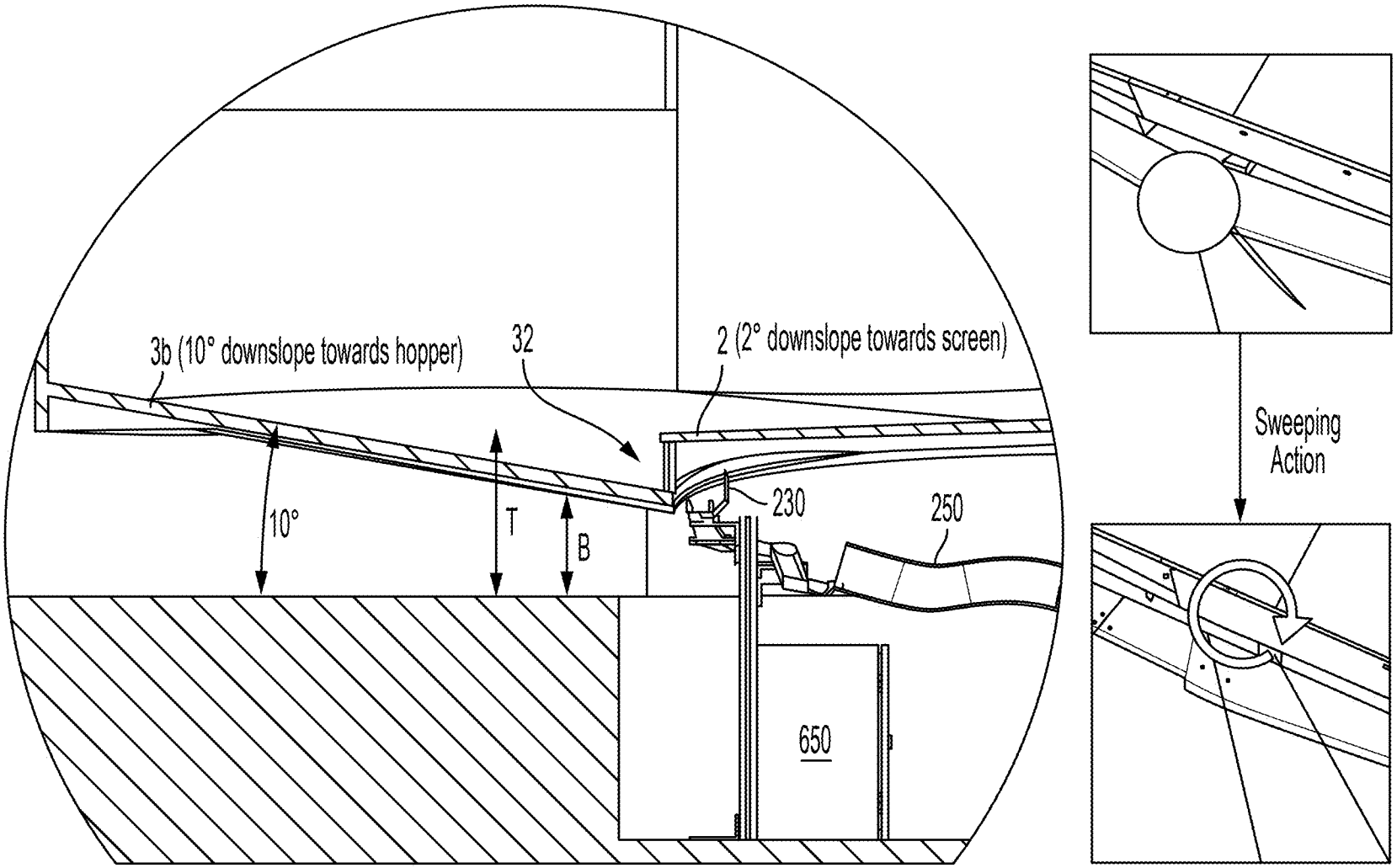
FIG. 8 is a diagram illustrating a hopper in accordance with one embodiment described herein.

FIG. 8 illustrates a side view of the hopper 32. In the embodiment shown, the hopper funnels balls towards an opening that has a bottom edge a height B from the entry of the hose 250 and a top edge a height T from the entry of the hose 250. The difference T-B is at least slightly larger than the diameter of the balls to be collected in the hopper 32.

Balls from the hopper 32 may enter the hose 250 one-at-a-time, as described above. On the right-hand side of FIG. 8 is shown an example of an agitator (e.g., sweeper) that may be placed at the entrance of the hopper 32 and used automatically and/or on-demand, continuously and/or periodically, to cause balls that may be stuck near the hopper orifice to roll into the orifice.

FIG. 8 also shows a cabinet 650 that includes control and communications circuitry associated with the ball pitching system 100. Although such circuitry is shown as being located below-ground and proximate to the ball pitching system 100, it is to be understood that in alternative embodiments all or a portion of control/communications functionality may be implemented by devices that are located elsewhere in a player bay or even external to a player bay.

Moreover, while certain control and communication operations are described herein as being based on wired connections, it is to be understood that such operations may be based on wireless connections in alternative embodiments.

Figure 9:
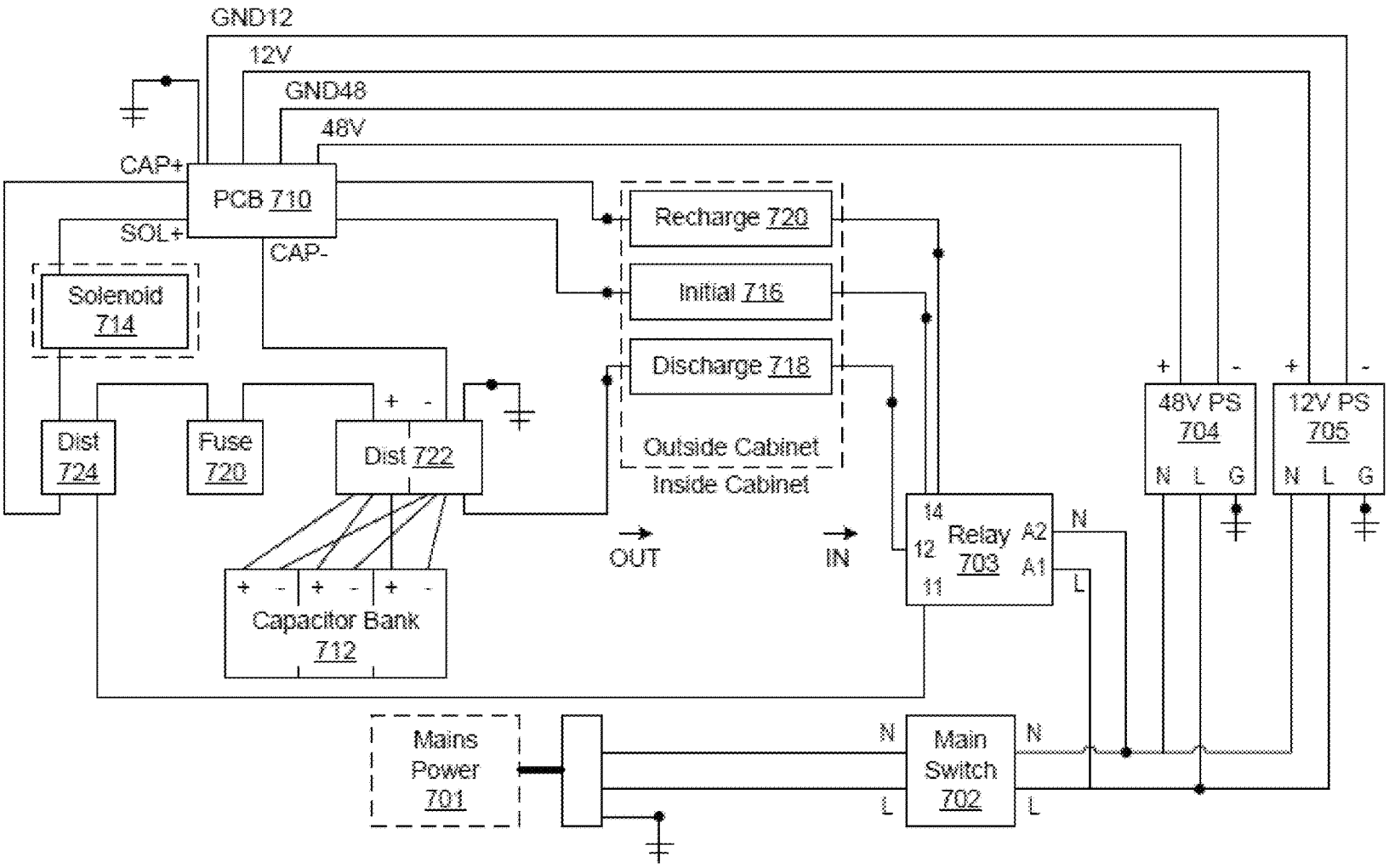
FIGS. 9 and 10 are connection diagrams in accordance with embodiments described herein.
Figure 10:
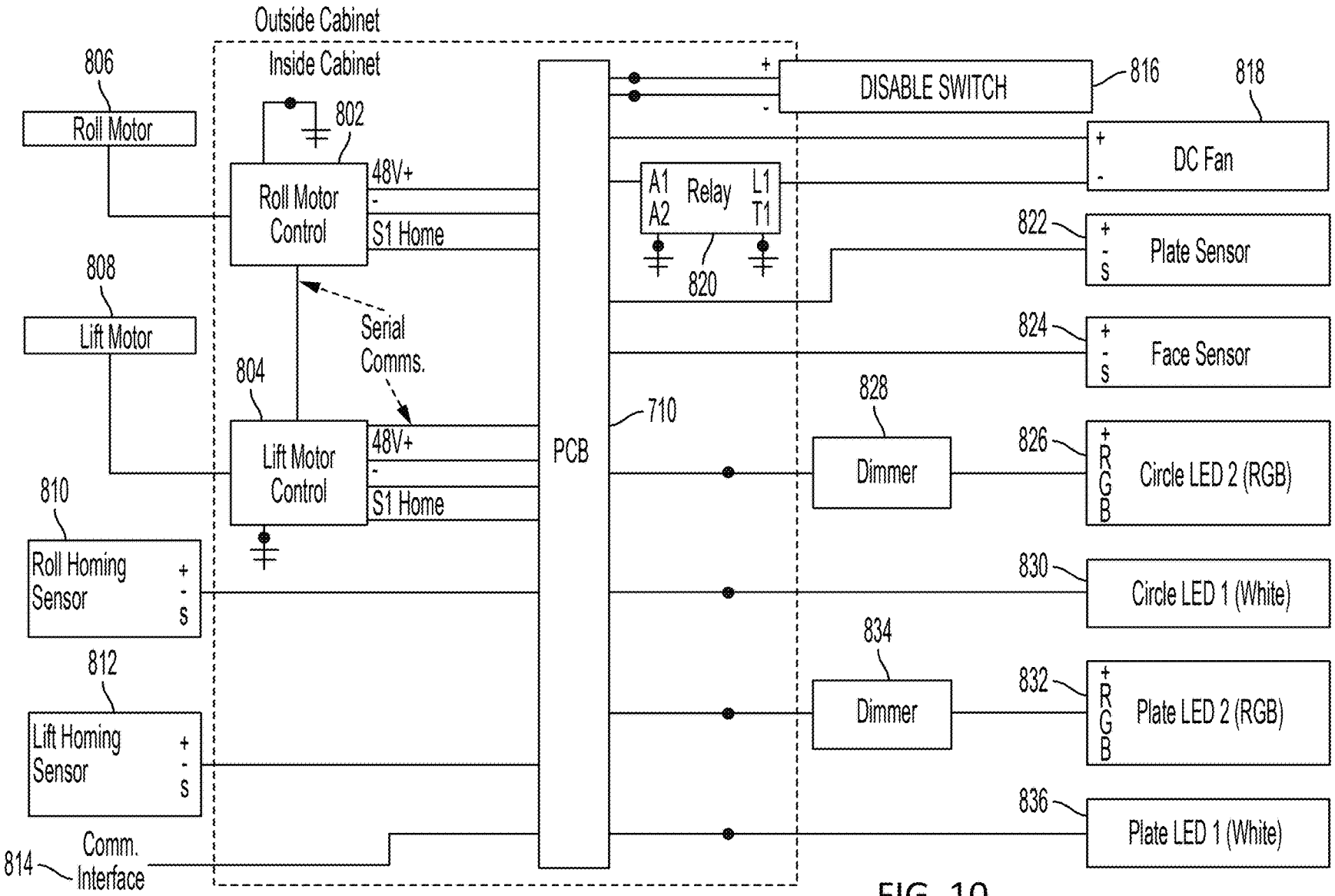

FIGS. 9-10 illustrate examples of connections (e.g., wiring) involving components of the cabinet 650 in accordance with illustrative non-limiting embodiments. In FIGS. 9-10, a dashed line is used to delineate components/functions inside the cabinet 650 vs. those outside the cabinet 650. Further, potential terminal/junctions are shown in FIGS.

9-10 using black dots, but it is to be understood that these locations are for example only and are not to be considered limiting.

Referring to FIG. 9, a mains power supply (PS) may be coupled to a main switch 702, which in turn provides line (L) and neutral (N) power connections to a relay 703, a 48-volt (V) power supply 704, and a 12V power supply 705. Multiple power supplies may be provided because certain functions (e.g., driving and/or controlling motors) may be higher voltage whereas other functions (e.g., LED lighting control and sensor operation) may be lower voltage.

The power supplies 704, 705 may be coupled to a printed circuit board (PCB) 710 that performs/controls various functions via hardware, firmware, software (e.g., executed by a controller or processor), or some combination thereof. For example, the PCB 710 may control the initial charging, discharging, and recharging of a capacitor bank 712 via respective resistors 716, 718, and 720.

The resistors may control the rate at which the capacitor bank 712 is initially charged upon system startup (716), that rate at which the capacitor bank 712 discharges upon system shut down (718), and the rate at which the capacitor bank recharges between pitches (720). The different resistor values may limit the current into or out of the capacitor bank 712.

The PCB 710 may include an onboard adjustable direct current (DC) convertor (not shown) that receives the 48V DC supply as input and converts it to a different magnitude (e.g., between 24V and 48V, such as approximately 28V).

In the illustrated example, the capacitor bank 712 includes three capacitors connected in parallel to provide a high overall capacitance (e.g., around one farad (1F)). In other examples, the capacitor bank 712 may include a different number of capacitors and/or provide a different amount of overall capacitance.

The capacitor bank 712 is configured to drive a magnetic field associated with a solenoid 714, which in turn may cause ferro-magnetic plunger (or moveable piston) to accelerate towards and imparting a launching force on a ball, as described above with reference to the ball pitching devices 300, 600. Due to the high capacitance of the capacitance bank 712, a large current (e.g., approximately 120 amperes (amps)) may be applied to the solenoid 714, albeit for a short duration (e.g., less than 100 milliseconds (ms), such as approximately 40 ms in an example).

In other examples, different amounts of current may be applied over different durations of times to provide various launching forces. In some examples, a fuse 720 and power distribution blocks 722, 724 may be included to enhance safety during operation and for connection, disconnection, and maintenance tasks.

In a particular embodiment, the PCB 710 is configured to adjust the frequency, speed, and magnitude of discharging at the capacitor bank 712. In some examples, this may control the magnetic field of the solenoid 714 and thus the initial launch velocity of a ball struck by the ferro-magnetic plunger/piston, as well as when the next ball is launched.

Initial launch velocity and launch timing may be controlled responsive to hardwiring/programming as well as responsive to input received from an external device, as further described with reference to FIG. 10.

In addition to power control, the PCB 710 may perform communication and motor control. To illustrate, referring to FIG. 10, the PCB 710 may be coupled to a roll motor controller 802 and a lift (alternatively referred to herein as "tilt") motor controller 804.

The roll motor controller 804 may provide signals (e.g., motor control input(s)) to a roll motor 806, such as a stepper motor that causes a ball launcher (e.g., the ball pitching device 300) to roll about a roll axis. Similarly, the lift motor controller 804 may provide signals (e.g., motor control input(s)) to a lift motor 808, such as a stepper motor that causes a ball launcher (e.g., the ball pitching device 300) to tilt about a tilt axis.

As used herein, adjusting "tilt" or "lift" adjusts a launch angle of a ball relative to the ground, whereas adjusting "roll" adjusts the launch angle of the ball relative to a vertical direction that is orthogonal to the ground.

In other examples, the PCB 710 is configured to operate one or more motor controllers to control the positioning of an impulse mechanism of the ball launcher (e.g., the ball pitching device 600). For example, the PCB 710 may control actuators and/or motors configured to adjust the first and second adjustment stages of the ball pitching device 600.

In some examples, an open-loop stepper motor is configured to natively determine its "current" position upon powerup. Thus, in embodiments where the motors 806, 808 are open-loop stepper motors, homing sensors may be used to establish a "home" position for the stepper motors, such as upon powerup.

For example, the PCB 710 may be coupled to a roll homing sensor 810 and to a lift homing sensor 812. The homing sensors 810, 812 may detect physical contact with a portion of the ball pitching device 300 at one end of the respective axis of motion (e.g., when the ball pitching device 300 is rolled all the way to the left or right and when the ball pitching device 300 is tilted all the way up or down).

Alternatively, the homing sensors 810, 812 may be non-contact sensors (e.g., inductive sensors) that detect when metal of the ball pitching device 300 is in front of them. The PCB 710 may signal the stepper motors 806, 808 to control roll and tilt of the ball pitching system 100 relative to the detected "home" positions.

In some examples, a controller (e.g., Arduino controller, microprocessor, etc.) is seated on the PCB 710 and executes an application programming interface (API) that is accessible to an external device. To illustrate, the PCB 710 (or the controller) may be coupled to or include a communication interface 814.

In some cases, the communication interface 814 may be a universal serial bus (USB) interface. USB signals provided to the PCB 710 (or the controller) may include data that causes modification to the timing and trajectory of ball launches, such as via the roll motor 806, the lift motor 808, and the discharging of the capacitor bank 712. Thus, the described techniques may enable controlling ball launch timing and trajectory from an external device, such as a device (e.g., separate computer) connected via USB.

However, it is to be understood that a wired communication interface 814 is provided merely as an example and is not to be considered limiting. In an alternative example, the communication interface 814 includes a wireless communication interface and the timing/trajectory of ball launches can be controlled wirelessly via a local network or even the internet.

The PCB 710 may also control additional functions. In the illustrated example, the PCB 710 is coupled to a direct current (DC) fan 818 via a relay 820, a plate sensor 822, a face sensor 824, color LED lights 826 and 832, and white LED lights 830 and 836. In particular examples, the color and white LED lights may be LED light strips that are individually controllable (e.g., four light controls).

The fan 818 may be used to cool the ball pitching system 100 (e.g., due to heat generated at the solenoid 714), and may in some examples be triggered based on readings from a thermocouple and/or thermal sensor (not shown) within or near the solenoid 714. The plate sensor 822 may be configured to detect when a player steps on home plate and/or when a player waves a bat over home plate, signaling that he or she is ready for the ball pitching system 100 to launch balls.

The face sensor 824 may be an infrared, vision, and/or proximity-based sensor that is placed in or near the hole through which balls are launched, so that balls are not launched if a player, player's face, etc. are in the line of fire.

As described with reference to FIG. 1, in certain embodiments the periphery of home plate 4 and the pitch circle (e.g., hole 33) may be outfitted with lights. For example, the lights 826 and 830 may provide white and multi-color lighting capability for the pitch circle, respectively.

Similarly, the lights 836 and 832 may provide white and multi-color lighting capability for home plate 4. In the illustrated example, the color lights 826 and 832 are connected to the PCB 710 via respective dimmers 828 and 834. The illustrated lighting arrangement may enable the PCB 710 to provide various light-based signaling in the player bay.

For example, different light colors, light flashing patterns, and/or light dimming patterns may be used to indicate status information, a pitch countdown or impending pitch, etc. As another example, when the pitch circle or home plate is blue, it may indicate to the player to try and aim for a target (e.g., blue or other easily noticeable/distinguishable color) shown on the screen 12.

The PCB 710 may be coupled, in some cases, to a disable switch 816. The disable switch 816 may, for example, serve as a master kill switch that can be used to quickly shut off some or all functionality in the player bay.

It is to be understood that certain components shown in FIGS. 9 and/or 10 are selected for inclusion based at least in part on the use of a solenoid/plunger-based ball launcher, and the solenoid/plunger may drive several other costs (e.g., power use, electronics, electrical components, etc.) in the overall system. If a different launch mechanism is used, different components may be present.

For example, if a pneumatic ball launching mechanism were to be employed, the PCB 710 may control storage and/or release of compressed air (e.g., from a per-pitch accumulator of from a larger tank that is refilled less frequently) rather than charging/discharging cycles of the capacitor bank 712.

As another example, if a mechanical ball launching mechanism such as a spring were used, the PCB 710 may control compression and release of the spring (and may be coupled to sensors that monitor stress and strain on the spring to determine if/when a maintenance may be required). In other examples, the ball launching mechanism may be hydraulic.

Figure 12:
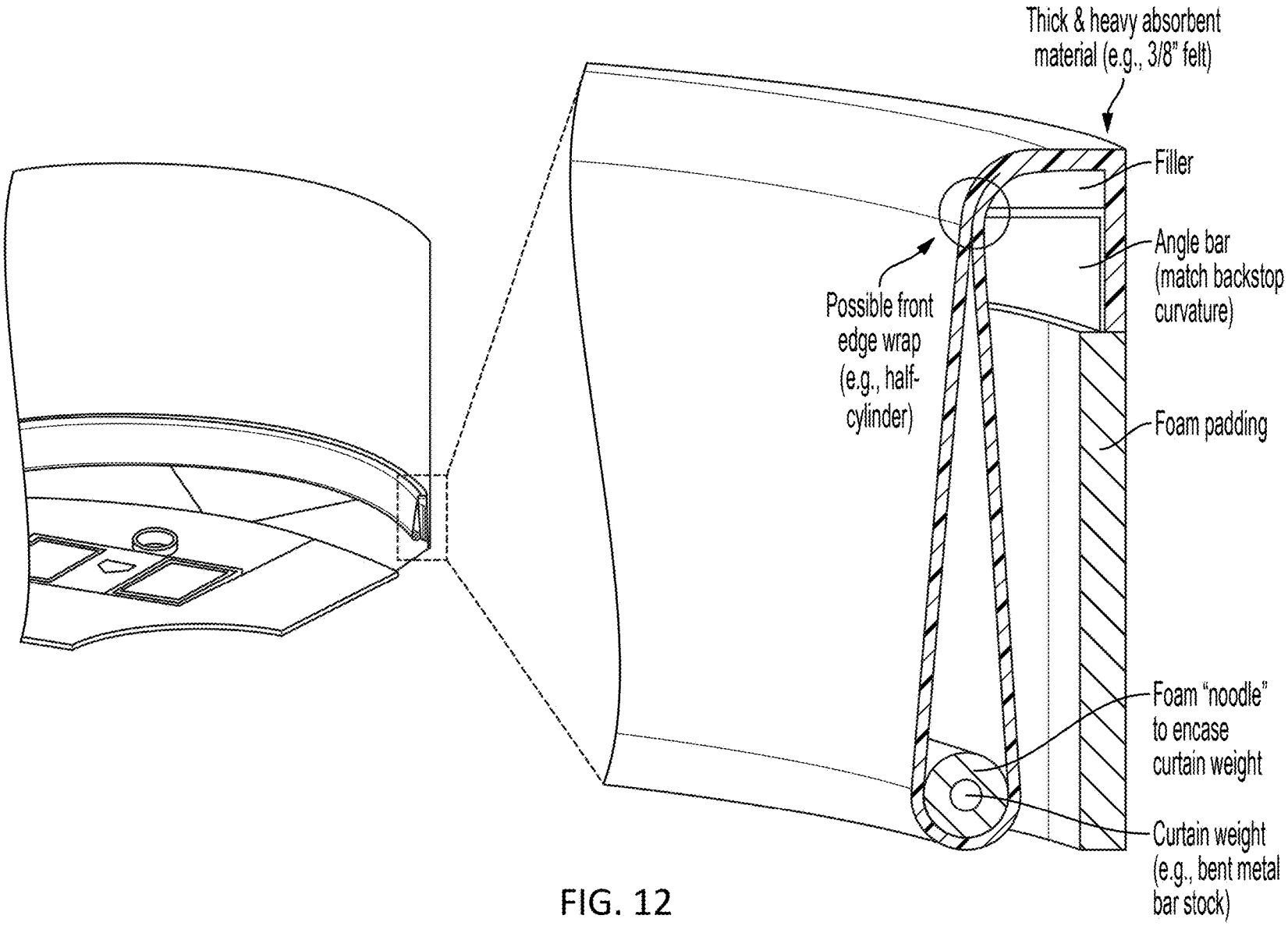
FIG. 12 is a diagram illustrating a backstop in accordance with one embodiment described herein.

FIG. 12 is a diagram to illustrate an example of a backstop that may be used to provide a continuous wrap under the screen 12 of a player bay, the backstop having a curvature that is substantially similar to the curvature of the screen 12 (the screen 12 being curved may assist in automated ball collection, provide an immersive user experience, and provide a more natural feeling to baseball/softball players because baseball/softball outfields are usually similarly curved).

As shown in FIG. 12, the backstop may include various layers. For example, a curtain weight, such as bent metal stock or a chain, may be inserted into or wrapped with a foam noodle or other flexible encasement, and may hang in a sling at the bottom of the backstop. The wrap fabric may be a thick and absorbent material, such as ⅜" felt.

Behind the wrap fabric may be a foam padding, an angle bar whose curvature matches the backstop's curvature, and a filler material. The backstop may "deaden" (e.g., absorb a large amount of kinetic energy from) balls that hit the backstop, so that such balls drop onto the collection deck 3 and roll into the hopper 32.

In one example, angled nets can be included to trap and/or direct balls onto the collection deck 3. In some examples, angled nets can be used to feed balls into the hopper 32 directly.

Figure 13A:
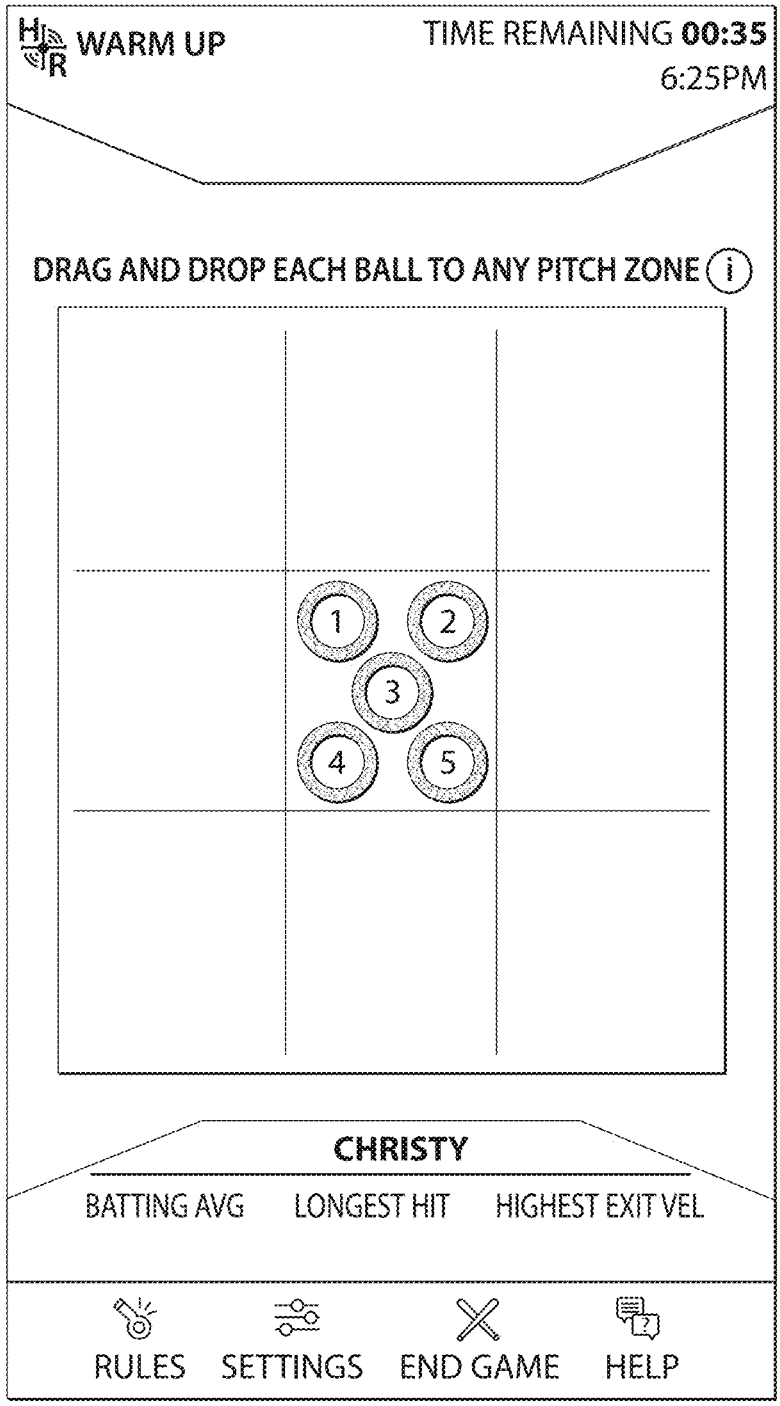
FIGS. 13A, 13B, and 13C illustrate a graphical user interface (GUI) in accordance with embodiments described herein.

Various graphical user interfaces (GUIs) may be displayed by computing devices and/or mobile devices associated with a bay. For example, FIG. 13A shows an example of GUI that may be used to determine which area of the strike zone each of the next five pitches should be launched into.

Figure 13B:
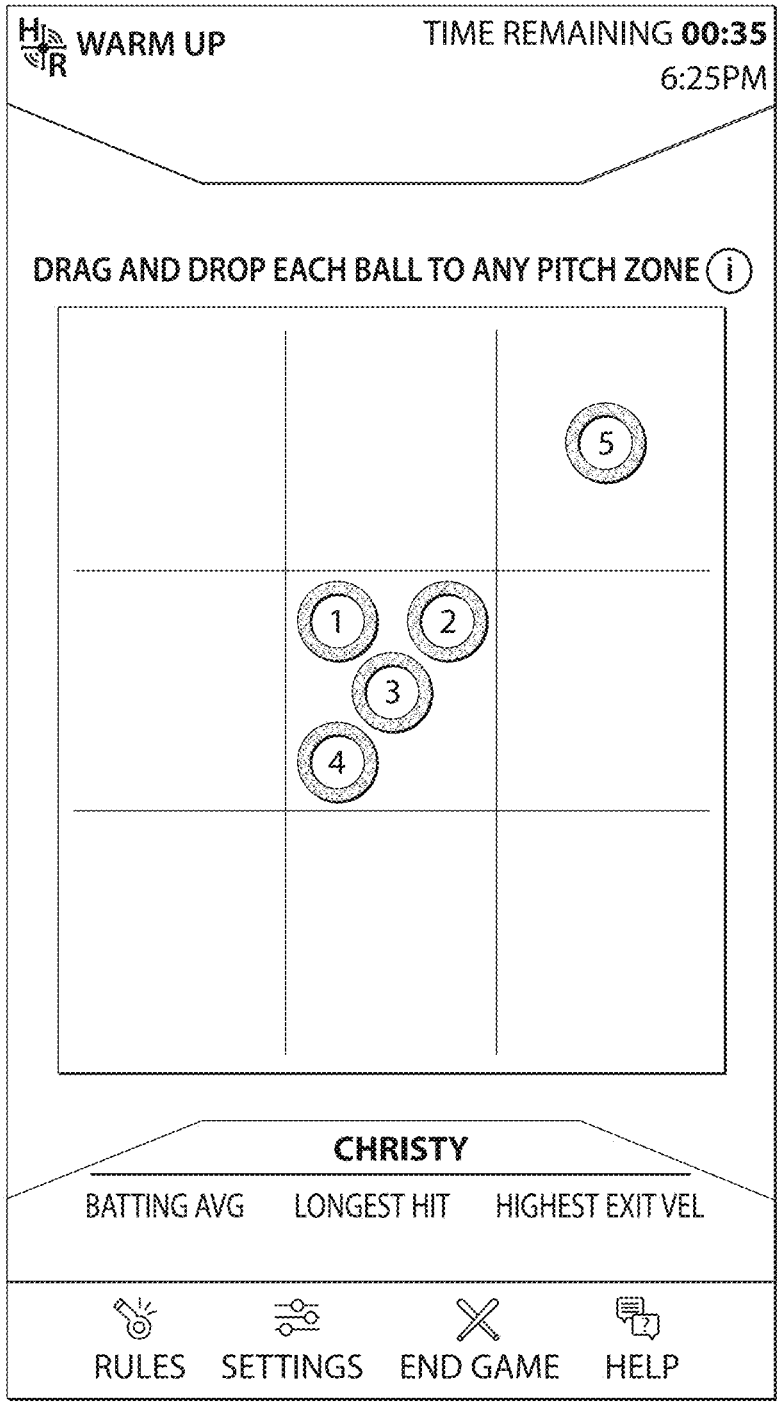
Figure 13C:
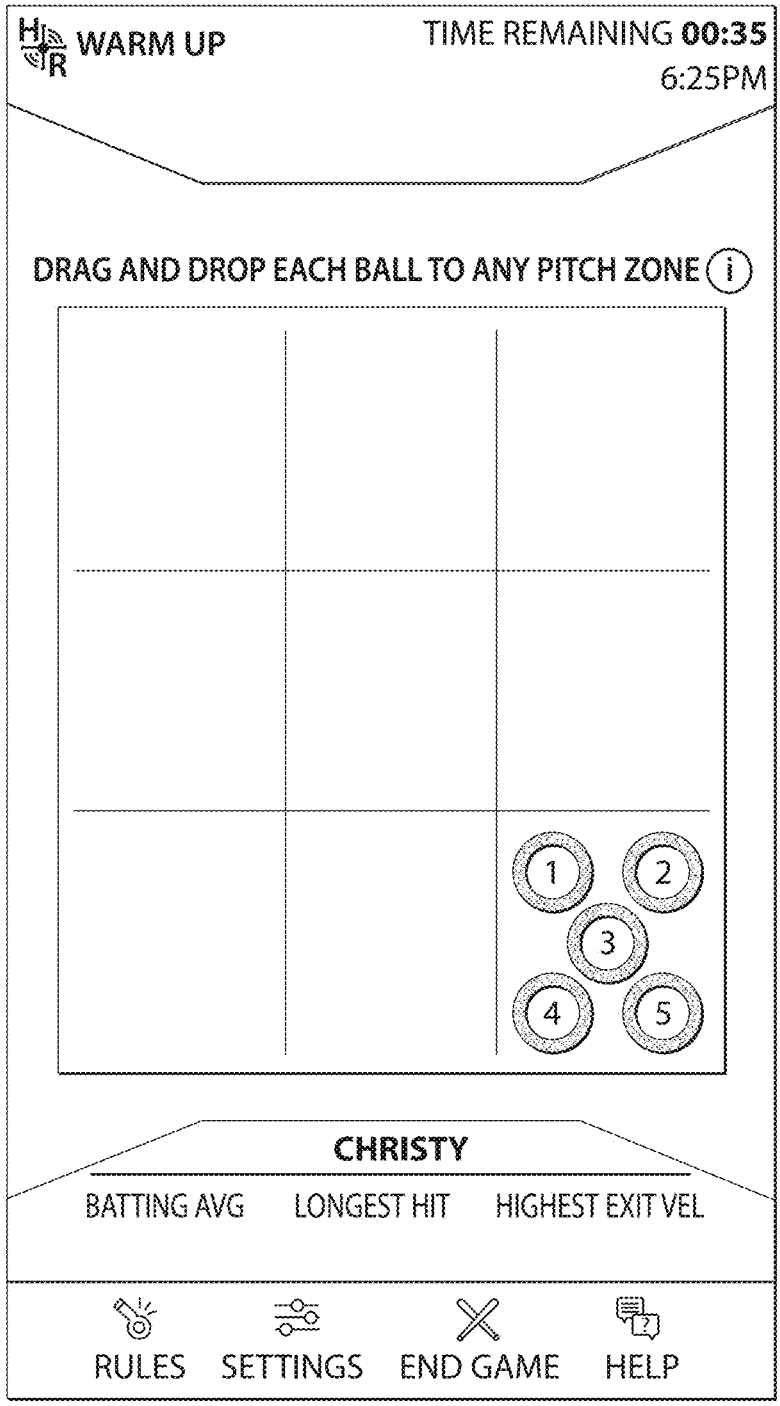

In FIG. 13B, the fifth pitch is targeted to the upper right portion of the strike zone. In FIG. 13C, all five pitches have been targeted to the lower right portion of the strike zone.

Although one and five pitches, respectively, are shown being moved to the same portion of zone, it is to be understood that individual pitches may be moved to various portions of the strike zone, may be left alone, or may be moved outside the strike zone, in any order, without impacting the destination of other pitches in the set of five pitches. The number of pitches in the set (i.e., five) is also for illustration only and not to be considered limiting.

In some examples, depending on a gameplay/training difficulty selected by a user, only certain pitches may be moveable, and the icons non-moveable pitches may be "grayed out" and/or non-selectable. To illustrate, in a low difficulty mode, none of the five pitches may be moveable.

In a medium difficulty mode, only pitches four and five (i.e., the last two pitches) may be moveable while the first three pitches are locked into being strikes down the middle. In a high difficulty mode, all pitches may be moveable. In an illustrative aspect, there may be a bonus scoring factor (e.g., multiplier) applied to the outcome of the moveable pitches or pitches that have actually been moved from the middle of the strike zone.

Once the set of five pitches has been pitched, the five pitch icons may "snap back" to the center of the strike zone for the next batter (e.g., FIG. 13B or FIG. 13C may eventually transition back to FIG. 13A). FIGS. 13A, 13B, and 13C thus represent respective sequences of "frames" of various animated GUIs in accordance with the present disclosure.

In some embodiments, the pitch location GUI of FIGS. 13A-13C enables a user (who may or may not be the batter) to select the point (or area) at which the ball crosses a vertical plane coincident with the front of home plate 4. In alternative other embodiments, the pitch location GUI of FIG. 13A-13C enables the user to select a point (or area) within or outside the strike zone at which the ball will be present at some point in its flight, though not necessarily when at the vertical plane coincident with front of home plate 4.

In a particular embodiment, in response to a user dragging a pitch to a different location on a screen of a computing device, the computing device converts the location into a roll motor control input, a lift motor control input, and/or a launch velocity control input, and such control inputs are communicated to the PCB 710.

In an alternative example, the desired location of the pitch (as selected by the user on-screen) is communicated to the PCB 710 (or the controller thereon), where the location is converted into a roll motor control input, a lift motor control input, and/or a launch velocity control input.

Figure 14:
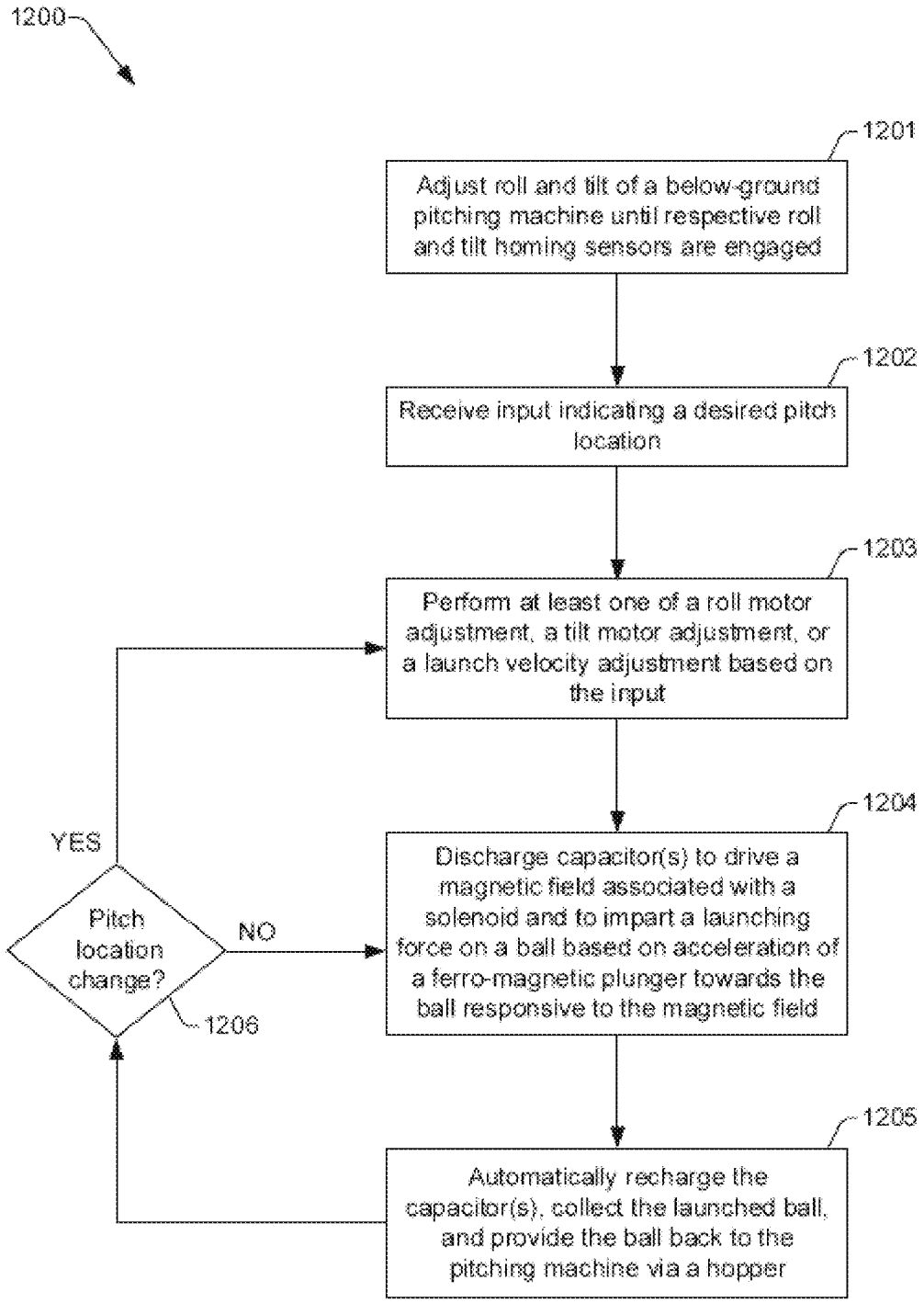
FIG. 14 is a flow diagram illustrating a method of operating player bay layouts in accordance with one embodiment described herein.

Referring to FIG. 14, a method 1200 of operation in accordance with the present disclosure is shown. The method 1200 includes adjusting roll and tilt of a ball launcher, or pitching machine, until respective roll and tilt homing sensors are engaged, at 1201. For example, upon powerup of the ball pitching system 100 or in response to a reset signal, roll of the ball pitching system 100 may be adjusted clockwise or counterclockwise until the roll homing sensor 810 is engaged.

In some aspects, the roll homing sensor 810 is an inductance-based sensor that detects when part of the ball pitching system 100 is proximate to or in contact with the roll homing sensor 810. Similarly, tilt of the ball pitching system 100 may be adjusted up or down until the lift homing sensor 812 is engaged. In some aspects, the lift homing sensor 812 is an inductance-based sensor that detects when part of the ball pitching system 100 is proximate to or in contact with the lift homing sensor 812.

The method 1200 also includes receiving input indicating a desired pitch location, at 1202. For example, such input may be received via a GUI, as described with reference to FIGS. 13A-13C, and may be received via the communications interface 814.

The method 1200 further includes performing at least one of a roll motor adjustment, a tilt motor adjustment, or a launch velocity adjustment based on the input, at 1203. For example, the roll motor control 802 may signal the roll motor 806 and cause component(s) of the ball pitching system 100 to roll about a first axis of motion.

As another example, the lift motor control 804 may signal the lift motor 808 and cause component(s) of the ball pitching system 100 to tilt about a second axis of motion. As yet another example, the PCB 710 may adjust the initial launch velocity by controlling the charging voltage of the capacitor bank 712, the coil ON time, and/or a PWM signal input to a switch to cause current to be applied to the coil (e.g., the solenoid 714) at varying duty cycles.

The method 1200 includes discharging capacitor(s) to drive a magnetic field associated with a solenoid and to impart a launching force on a ball based on acceleration of a ferro-magnetic plunger towards the ball responsive to the magnetic field, at 1204. For example, the capacitor bank 712 may be discharged to drive the magnetic field associated with the solenoid 714.

The method 1200 also includes automatically recharging the capacitor(s), collecting the launched ball, and providing the ball back to the pitching machine via a hopper, at 1205. For example, the PCB 710 may automatically recharge the capacitor bank 712. As another example, a struck ball may hit the screen and/or backstop (e.g., the backstop of FIG. 12) and may roll into the hopper 32 due to the downward slope of the collection deck 3.

A ball that is missed by the player may also roll into the hopper, due to the downward slope of the pitch deck 2. The hopper 32 may provide the ball to the ball pitching device 300 via a single-file feeding arrangement, for example as described above.

The method 1200 further includes determining whether the next pitch should be launched to the same location or two a different location, at 1206. When the next pitch is to be launched to a different location, the method 1200 returns to 1203 to adjust roll, tilt, and/or launch velocity. When the next pitch is to be launched to the same location as the previous pitch, the method 1200 returns to 1204 and discharges capacitor(s) without first adjusting roll/tilt/launch velocity.

Certain embodiments have been described herein with reference to a "below-ground" pitching machine. It should be noted that "ground" in this context is not necessarily ground level. Rather, "ground" refers to the level at which the batter is positioned (e.g., the elevation of home plate) or the level of a deck (e.g., the collection deck 3 or the pitch deck 2) that includes a hole (e.g., the hole 33) though which the ball enters the hitting area (and likely the hitter's field of view).

It will be appreciated that placing the pitching machine "below-ground" helps facilitate automatic ball collection, for example by using sloped decks, as described with reference to FIG. 1. It is therefore understood that when an embodiment is described as having a ball that travels upward through "a hole in the ground", this means that the ball is travelling through a hole that is at approximately the same elevation as the batter's feet (e.g., and home plate), although the pitching machine and the hole in the ground may both be above actual geographic ground level.

In alternative examples, the ball launcher or pitching machine may not be disposed "below-ground." Rather, according to the present disclosure, the ball launcher or pitching machine may be placed "on the ground", i.e., at the same elevation as the batter's feet (e.g., and home plate). In such embodiments, the pitching machine may have a protection mechanism to protect components from being struck by batted balls. Automated ball collection may not be present or may be modified as compared to the automated ball collection mechanisms described herein.

Figure 15B:
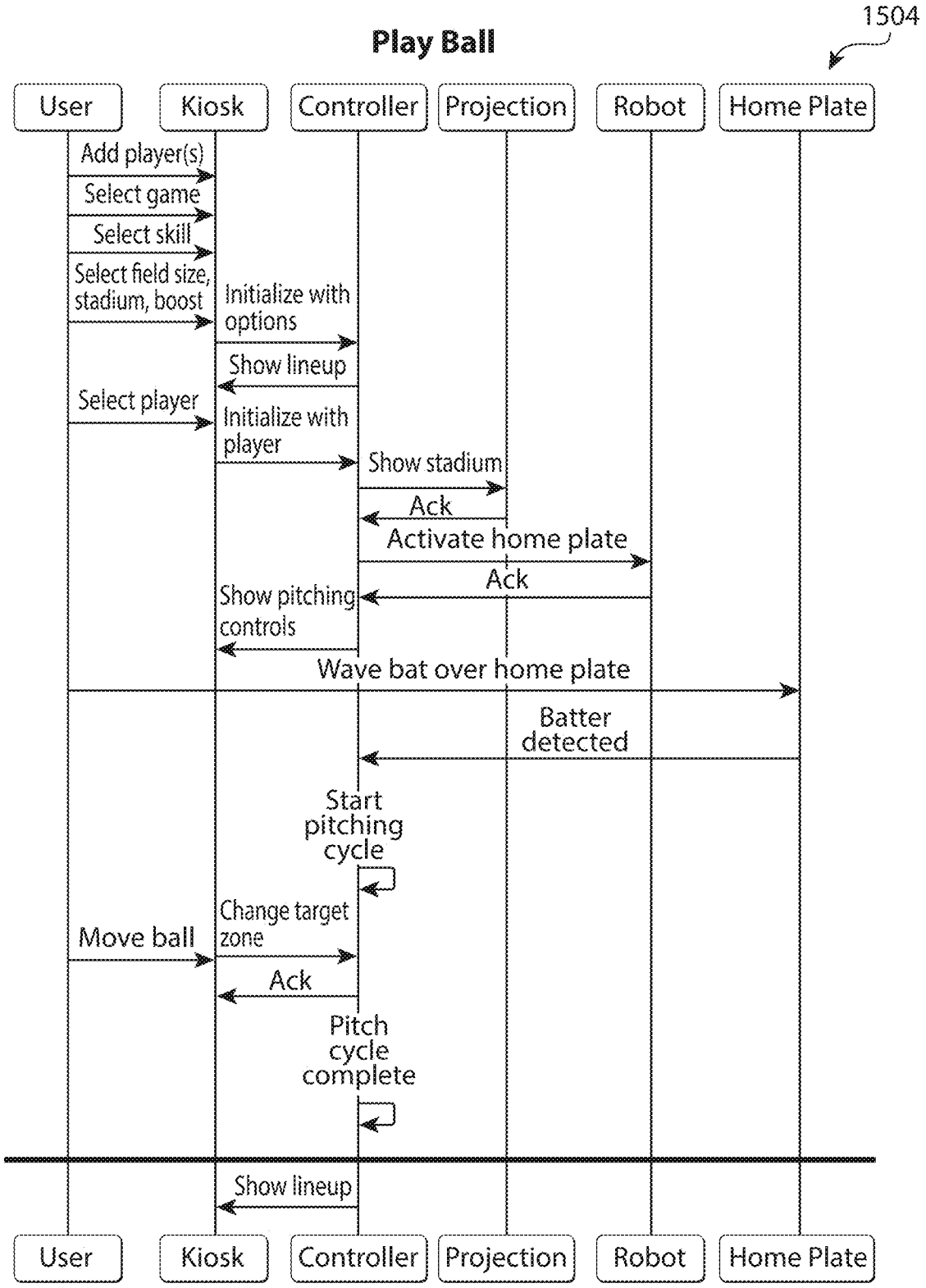
Figure 15C:
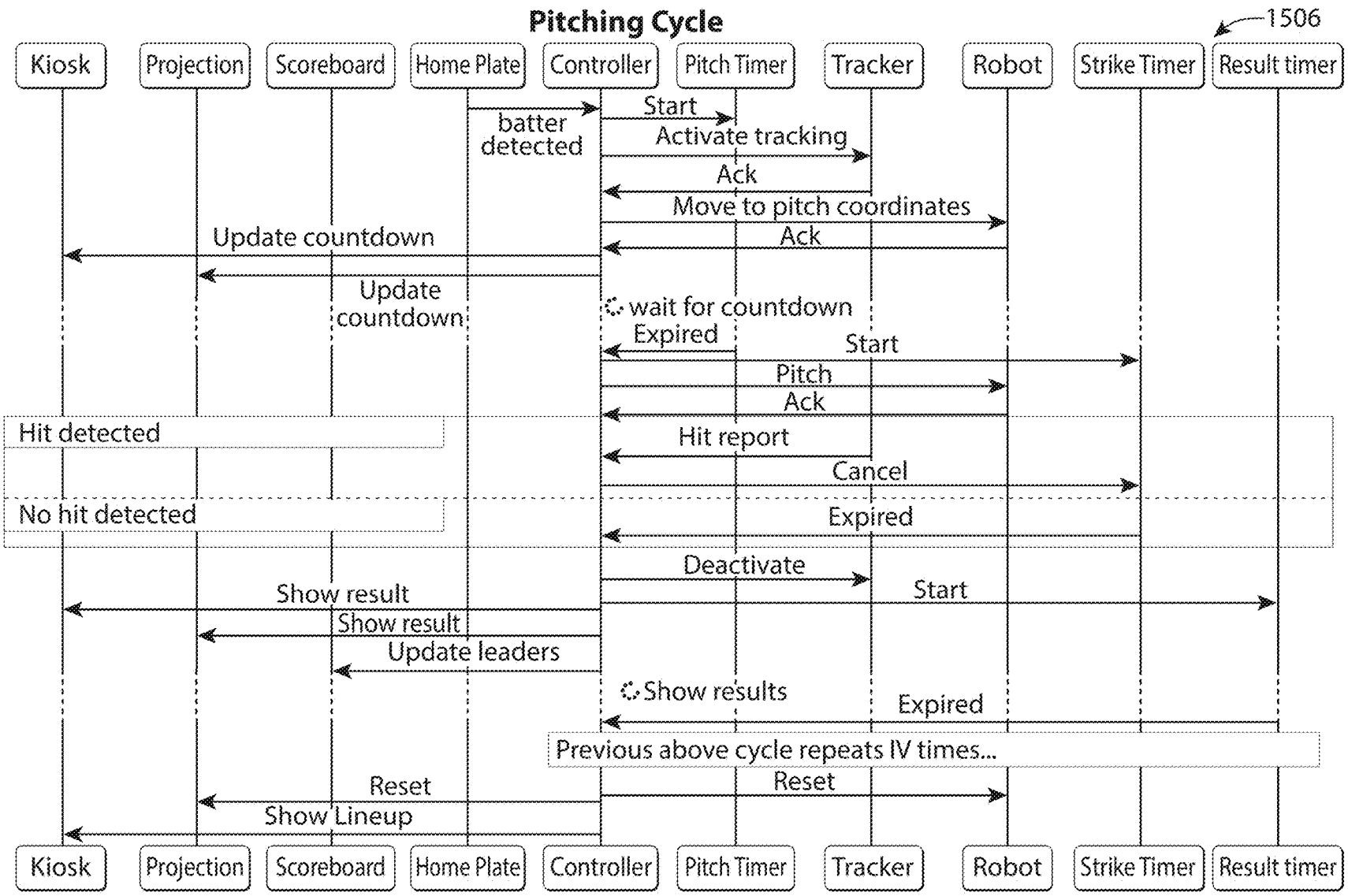
Figure 16A:
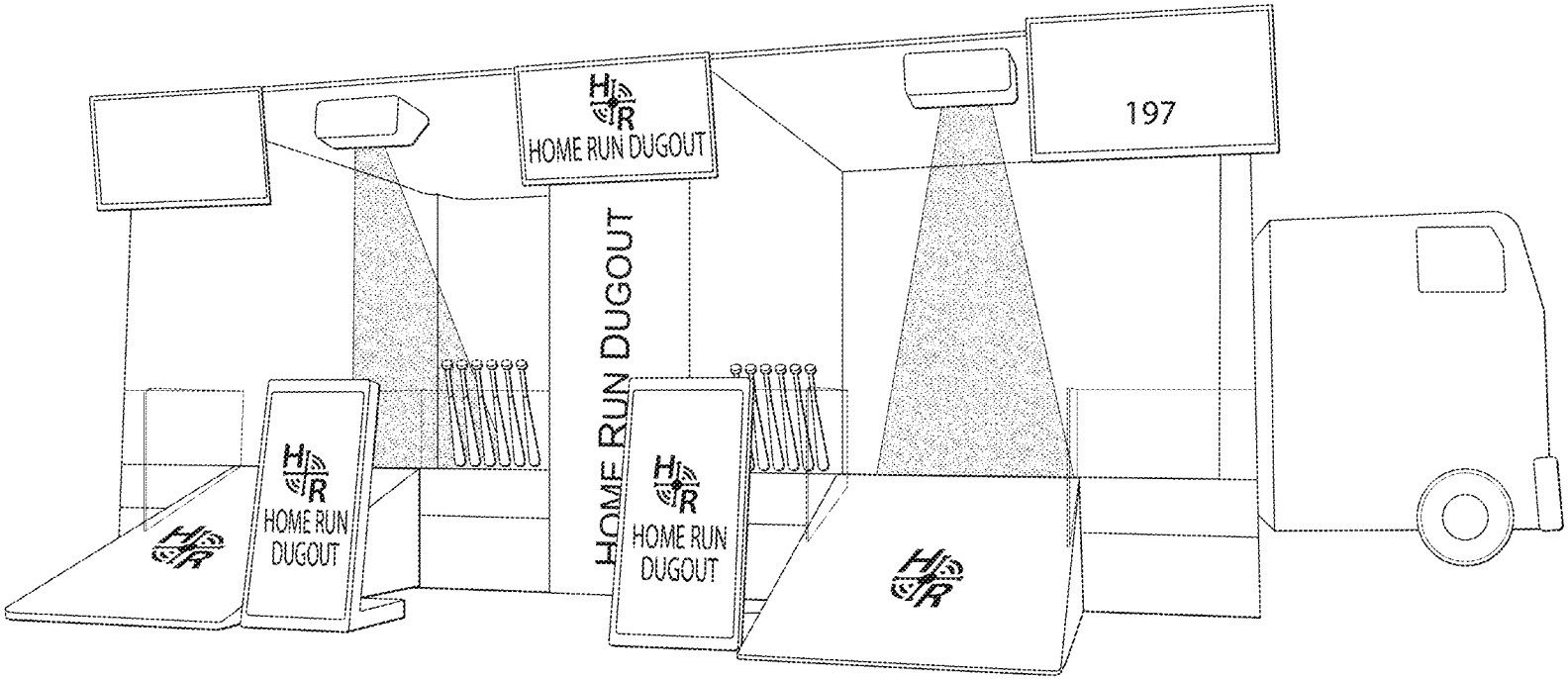
FIGS. 16A, 16B, 16C, and 16D are diagrams illustrating examples of player bay layouts in accordance with embodiments described herein.
Figure 16B:
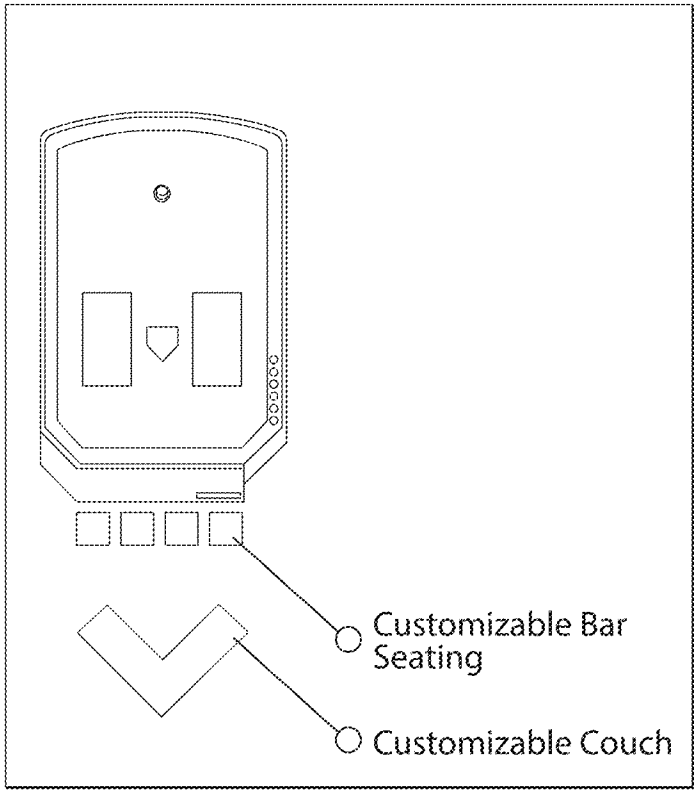
Figure 16B:
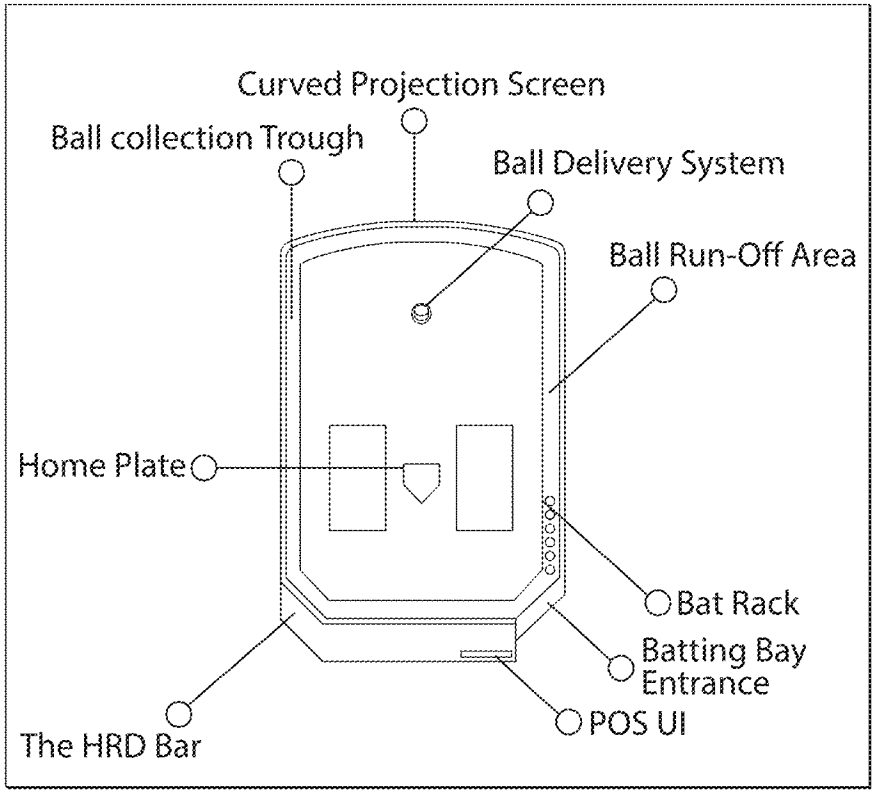
Figure 16C:
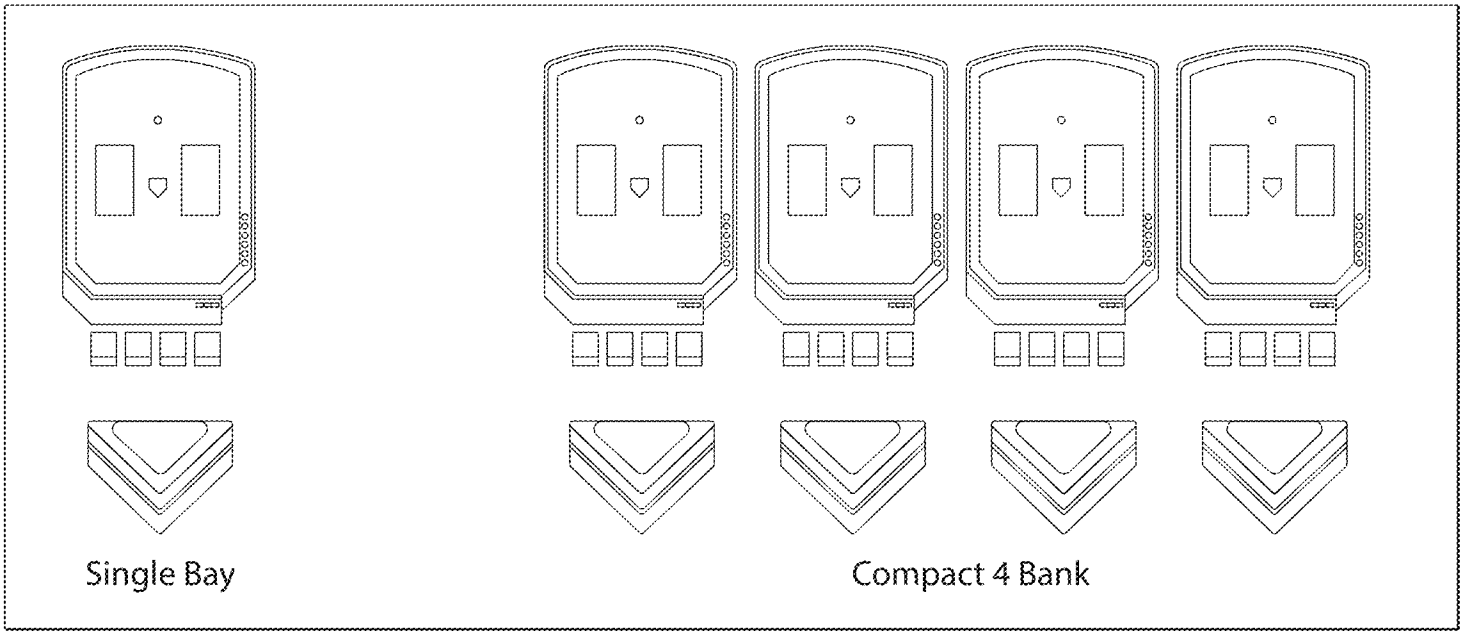
Figure 16D:
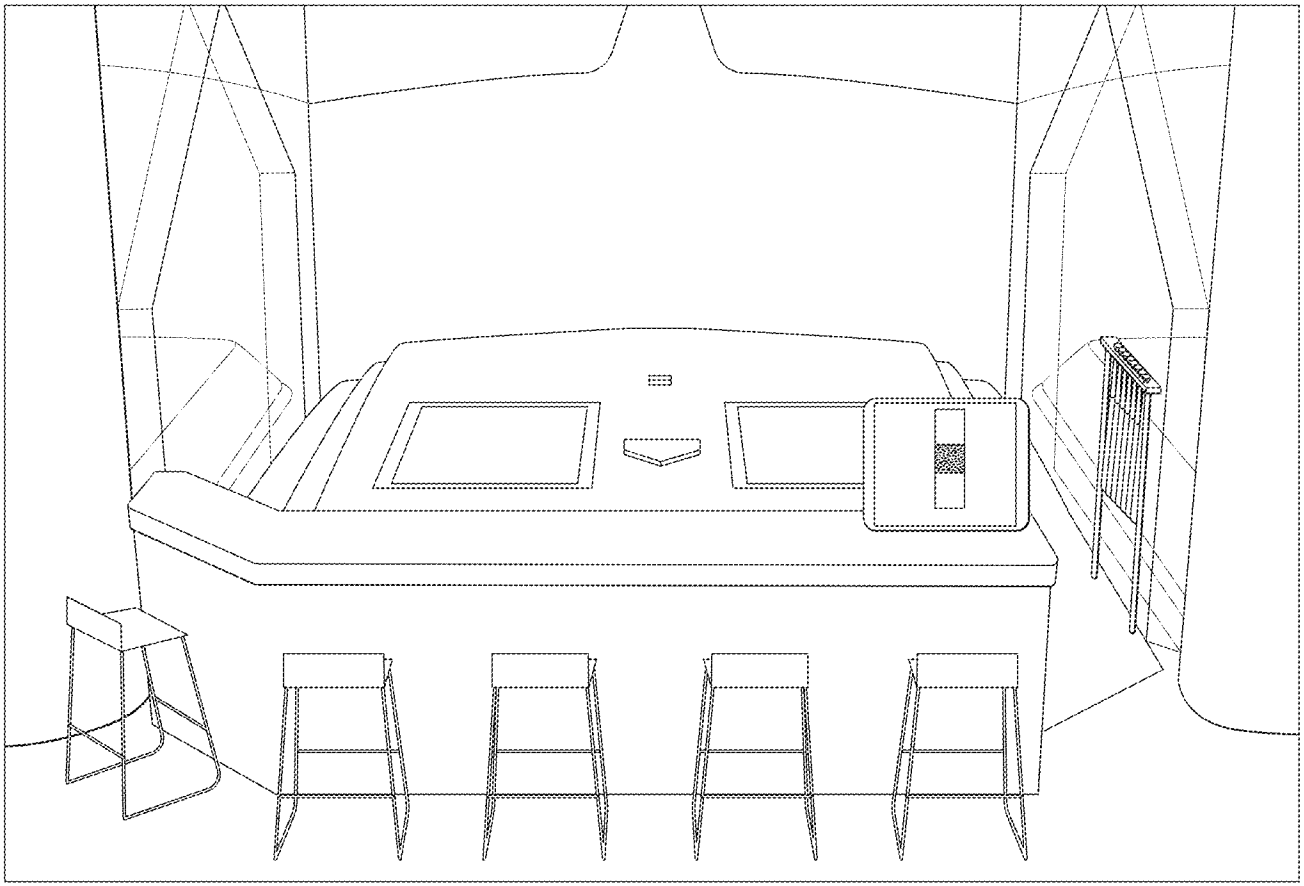

FIGS. 15A-15C include flow chart diagrams illustrating various control processes in accordance with aspects described herein. For example, FIG. 15A illustrates an activation process 1502 corresponding to the activation of a player bay. As shown, a user may interact with a kiosk (or another device) to enable and setup the player bay.

In one example, based on the user interaction, at least one controller of the system is configured to enable and setup a ball tracking system, a robot (i.e., the ball pitching devices 300, 600), a server or computer system, a projection system, and a scoreboard. The activation process 1502 may also include error handling sequences (e.g., a failure to enable equipment in the player bay).

FIG. 15B illustrates a gameplay process 1504 corresponding to operation of the player bay. For example, once the player bay has been activated, a user may setup various gameplay parameters such as game modes, skill levels, stadium preferences, etc.

After the gameplay parameters have been selected, at least one controller of the system is configured to initialize the system equipment (i.e., the projection system, the ball pitching devices 300, 600, etc.) based on the selected gameplay parameters. Once the system equipment has been initialized, the process 1504 may start a first pitching cycle based on a user signal (e.g., waving a bat over home plate).

FIG. 15C illustrates a pitching cycle process 1506 corresponding to a pitching cycle during operation of the player bay. As shown, a batter may be detected by home plate and at least one controller of the system may activate the ball tracking system and operate the robot (i.e., the ball pitching devices 300, 600) to prepare to deliver a pitch based on desired pitch parameters (e.g. trajectory).

In one example, the process 1506 may include a pitch timer to control the pitch frequency of the pitching cycle.

For example, the pitch timer may reset each time a batter is detected and the ball pitching device 300, 600 may launch the pitch each time the pitch timer expires. As shown, the pitch cycle process 1506 can include other functions such as a strike timer corresponding to whether a pitch was hit or missed by the batter.

In some examples, the pitching cycle process 1506 is configured to receive pitch parameters from an external device. For example, while a first user (i.e., batter) is playing, a second user (i.e., pitcher) may control pitch parameters of the pitch cycle using an external device (e.g., a mobile phone) or the kiosk.

FIGS. 16A-16D illustrate alternative layouts for one or multiple player bays, including "mobile" layouts (e.g., on a vehicle), substantially rectangular layouts, substantially diamond-shaped layouts, etc. Further, although not shown in FIGS. 16A-16D, in some embodiments, bays may also be vertically stacked.

It is to be understood that the order of steps or operations described with reference to the foregoing figures is to be considered illustrative, not limiting. In alternate embodiments, the order of steps may be different. Further, one or more steps may be optional and/or replaced by other steps. In addition, one or more steps may be consolidated.

In accordance with various embodiments of the present disclosure, one or more methods, functions, and modules described herein may be implemented by software programs executable by a computer system. Further, implementations can include distributed processing, component/object distributed processing, and/or parallel processing.

Particular implementations can be implemented using a computer system executing a set of instructions that cause the computer system to perform any one or more of the methods or computer-based functions disclosed herein. A computer system may include a laptop computer, a desktop computer, a server computer, a mobile phone, a tablet computer, a set-top box, a media player, one or more other computing devices, or any combination thereof.

The computer system may be connected, e.g., using a network, to other computer systems or peripheral devices. For example, the computer system or components thereof can include or be included within any one or more of the computing components described herein with reference to the figures.

In a networked deployment, the computer system may operate in the capacity of a server or as a client user computer in a server-client user network environment, or as a peer computer system in a peer-to-peer (or distributed) network environment. The term "system" can include any collection of systems or sub-systems that individually or jointly execute a set, or multiple sets, of instructions to perform one or more computer functions.

In a particular implementation, the instructions can be embodied in a non-transitory computer-readable or processor-readable medium. The terms "computer-readable medium" and "processor-readable medium" include a single medium or multiple media, such as a centralized or distributed database, and/or associated caches and servers that store one or more sets of instructions.

The terms "computer-readable medium" and "processor-readable medium" also include any medium that is capable of storing a set of instructions for execution by a processor or that cause a computer system to perform any one or more of the methods or operations disclosed herein.

For example, a computer-readable or processor-readable medium or storage device may include random access memory (RAM), flash memory, read-only memory (ROM), programmable read-only memory (PROM), erasable programmable read-only memory (EPROM), electrically erasable programmable read-only memory (EEPROM), registers, a hard disk, a removable disk, a disc-based memory (e.g., compact disc read-only memory (CD-ROM)), or any other form of storage medium or device.

Certain aspects and embodiments are directed toward providing a system for pitching, collecting, and transporting balls. Particular aspects are directed to a system that enables a convenient use of a standalone pitching machine for pitching balls, with a capability to control the trajectory of the pitch.

Aspects disclosed herein may be designed such that they can be used in batting bays, which may include indoor or outdoor batting areas where players can practice hitting balls against a hitting screen or into an open field. Aspects disclosed herein may also designed be for use in backyards as well as in youth games and practice sessions.

According to one implementation of the techniques described herein, a system includes a storage area configured to store a ball. The system also includes a below-ground launcher configured to impart a launching force to the ball received from the storage area. The launching force corresponds to a launch direction of the ball and a launch velocity of the ball, and the launching force causes the ball to travel upwards through a hole in the ground.

According to another implementation of the techniques described herein, a system includes a storage area configured to store a ball. The system also includes a launcher configured to impart a launching force to the ball received from the storage area. The launching force corresponds to a launch direction of the ball and a launch velocity of the ball.

According to another implementation of the techniques described herein, a batting bay includes a hopper configured to provide, to a ball launcher, a ball that rolls into the hopper. The batting bay also includes a batter's box area that is substantially flat. The batting bay further includes a screen and a pitch circle disposed between the batter's box area and the screen. Balls are launched upwards through the pitch circle towards a strike zone.

The batting bay includes a pitch deck at least partially surrounding the batters box area and having a first downward slope towards the screen. The batting bay also includes a collection deck disposed between the hopper and the screen, and at last a portion of collection deck has a second downward slope towards the hopper.

Having thus described several aspects of at least one embodiment of this invention, it is to be appreciated various alterations, modifications, and improvements will readily occur to those skilled in the art. Such alterations, modifications, and improvements are intended to be part of this disclosure and are intended to be within the spirt of and scope of this invention. Accordingly, the foregoing description and drawings are by way of example only.

What is claimed is:

1. A ball pitching device comprising:

a launching surface for receiving balls, the launching surface being configured to receive and hold a ball in a launching position prior to the ball being launched;

a launching system including at least one impulse mechanism configured to impact the ball in the launching position;

one or more control components configured to control at least one of a pitch power and a pitch trajectory of the ball launched from the launching position, wherein the one or more control components are configured to control a position of the at least one impulse mechanism to adjust the position of the at least one impulse mechanism relative to the launching position and thereby control the pitch trajectory by adjusting a point of contact between the at least one impulse mechanism and the ball; and a first mechanical system configured to adjust the position of the at least one impulse mechanism in a first dimension and second mechanical system configured to adjust the position of the at least impulse mechanism in a second dimension independent from the first dimension.

2. The ball pitching device of claim 1, wherein the first and second dimensions correspond to dimensions of an x-y plane.

3. The ball pitching device of claim 1, wherein the one or more control components are further configured to control at least one of the first and second mechanical systems to adjust the position of the at least one impulse mechanism and the pitch trajectory.

4. The ball pitching device of claim 3, further comprising an angled mount on which the launching surface and the launching system are disposed.

5. The ball pitching device of claim 4, further comprising a third mechanical system configured to adjust an amount of tilt provided by the angled mount, the one or more control components being further configured to control the third mechanical system to adjust the amount of tilt provided by the angled mount and the pitch trajectory.

6. The ball pitching device of claim 1, further comprising a casing on which the launching surface is disposed.

7. The ball pitching device of claim 6, further comprising a third mechanical system configured to tilt the casing about a first axis and a fourth mechanical system configured to roll the casing around a second axis.

8. The ball pitching device of claim 7, wherein the one or more control components are further configured to control at least one of the third and fourth mechanical systems to adjust the pitch trajectory.

9. The ball pitching device of claim 1, wherein the at least one impulse mechanism includes a pneumatic cylinder disposed below the launching position and at least one moveable piston, the pneumatic cylinder configured to accelerate the at least one moveable piston toward the launching position.

10. The ball pitching device of claim 9, wherein the one or more control components are further configured to adjust an amount of pressure in the pneumatic cylinder and to control the pitch power.

11. The ball pitching device of claim 1, wherein the at least one impulse mechanism includes an electromagnetic solenoid disposed below the launching position and at least one moveable piston, the at least one moveable piston being a ferromagnetic piston and the solenoid being configured to accelerate the at least one movable piston toward the launching position.

12. The ball pitching device of claim 11, wherein the launching system further includes a power source configured to apply a current to the electromagnetic solenoid, the one or more control components being configured to control the pitch power by adjusting an amount of current applied to the electromagnetic solenoid.

13. The ball pitching device of claim 12, wherein the power source includes one or more capacitors, the one or more capacitors being selectively coupled to the electromagnetic solenoid to apply the current to the electromagnetic solenoid, and the one or more control components being configured to adjust a charging voltage applied to the one or more capacitors and to adjust the amount of current applied to the electromagnetic solenoid by the one or more capacitors.

14. The ball pitching device of claim 1, wherein the launching position includes a circular aperture defined in the launching surface, the aperture having a diameter smaller than a diameter of the ball, allowing the ball to be held in the launching position and to be impacted by the at least one impulse mechanism via the aperture.

15. The ball pitching device of claim 1, wherein the launching surface is configured to receive a series of balls via a ball handling mechanism connected to the ball pitching device.

16. The ball pitching device of claim 15, wherein the ball handling mechanism includes a carousel system configured to rotate around a bearing to receive the series of balls and provide each ball of the series of balls to the launching surface one at a time.

17. The ball pitching device of claim 15, wherein the one or more control components are further configured to operate the ball handling mechanism and control a pitch frequency of the ball pitching device.

18. The ball pitching device of claim 1, wherein the one or more control components are further configured to communicate with an external device, the external device being configured to control the ball pitching device.

* * * * *